US008480438B2

(12) United States Patent
Mattson

(10) Patent No.: US 8,480,438 B2
(45) Date of Patent: Jul. 9, 2013

(54) CONTACT SET ARRANGEMENT FOR RIGHT ANGLE JACK

(75) Inventor: Loren J. Mattson, Richfield, MN (US)

(73) Assignee: ADC Telecommunications, Inc., Berwyn, PA (US)

( * ) Notice: Subject to any disclaimer, the term of this patent is extended or adjusted under 35 U.S.C. 154(b) by 0 days.

(21) Appl. No.: 13/273,703

(22) Filed: Oct. 14, 2011

(65) Prior Publication Data

US 2012/0184141 A1 Jul. 19, 2012

Related U.S. Application Data

(60) Provisional application No. 61/405,945, filed on Oct. 22, 2010.

(51) Int. Cl.
*H01R 23/025* (2011.01)

(52) U.S. Cl.
USPC ..... 439/676

(58) Field of Classification Search
USPC ..... 439/676, 941, 620.11, 620.17, 620.23, 439/501, 528, 620.22, 955
See application file for complete search history.

(56) References Cited

U.S. PATENT DOCUMENTS

| | | | | |
|---|---|---|---|---|
| 5,197,895 | A * | 3/1993 | Stupecky | 439/194 |
| 5,382,182 | A * | 1/1995 | Shen et al. | 439/676 |
| 5,415,570 | A * | 5/1995 | Sarkissian | 439/676 |
| 5,660,567 | A * | 8/1997 | Nierlich et al. | 439/620.21 |
| 6,244,908 | B1 * | 6/2001 | Hammond et al. | 439/676 |
| 6,422,895 | B1 | 7/2002 | Lien | |
| 6,431,892 | B1 * | 8/2002 | Shupe et al. | 439/188 |
| 6,641,443 | B1 * | 11/2003 | Itano et al. | 439/676 |
| 6,663,436 | B1 * | 12/2003 | Arnett et al. | 439/676 |
| 6,786,776 | B2 * | 9/2004 | Itano et al. | 439/676 |
| 7,314,392 | B2 * | 1/2008 | Pharn et al. | 439/676 |
| 7,314,393 | B2 * | 1/2008 | Hashim | 439/676 |
| 7,914,310 | B2 * | 3/2011 | Johansson et al. | 439/284 |
| 2006/0234564 | A1 | 10/2006 | Pharn et al. | |
| 2011/0115494 | A1 | 5/2011 | Taylor et al. | |

FOREIGN PATENT DOCUMENTS

| | | |
|---|---|---|
| DE | 10 2008 034 261 A1 | 1/2010 |
| DE | 10 2008 052 857 A1 | 4/2010 |
| WO | WO 00/65696 | 11/2000 |

* cited by examiner

*Primary Examiner* — Tulsidas C Patel
*Assistant Examiner* — Phuongchi T Nguyen
(74) *Attorney, Agent, or Firm* — Merchant & Gould P.C.

(57) ABSTRACT

A connector system includes a jack module mounted to a circuit board, which is connected to at least one processor. The jack module is configured to receive a plug connector having a first set of contacts spaced from a second set of contacts. The jack module includes a first contact arrangement configured to engage the first set of contacts of the plug and a second contact arrangement configured to engage the second set of contacts of the plug. The second contact arrangement is provided on a media reading interface, which may provide presence sensing. The first and second contact arrangements engage landings on the circuit board. One example jack module defines a right-angle jack.

20 Claims, 51 Drawing Sheets

CONTACT SET ARRANGEMENT FOR RIGHT ANGLE JACK

CROSS REFERENCE TO RELATED APPLICATIONS

This application claims the benefit of U.S. Provisional Application No. 61/405,945, filed Oct. 22, 2010, and titled "Contact Set Arrangement for Right Angle Jack," the disclosure of which is hereby incorporated herein by reference.

BACKGROUND

In communications infrastructure installations, a variety of communications devices can be used for switching, cross-connecting, and interconnecting communications signal transmission paths in a communications network. Some such communications devices are installed in one or more equipment racks to permit organized, high-density installations to be achieved in limited space available for equipment.

Communications devices can be organized into communications networks, which typically include numerous logical communication links between various items of equipment. Often a single logical communication link is implemented using several pieces of physical communication media. For example, a logical communication link between a computer and an inter-networking device such as a hub or router can be implemented as follows. A first cable connects the computer to a jack mounted in a wall. A second cable connects the wall-mounted jack to a port of a patch panel, and a third cable connects the inter-networking device to another port of a patch panel. A "patch cord" cross connects the two together. In other words, a single logical communication link is often implemented using several segments of physical communication media.

Network management systems (NMS) are typically aware of logical communication links that exist in a communications network, but typically do not have information about the specific physical layer media (e.g., the communications devices, cables, couplers, etc.) that are used to implement the logical communication links. Indeed, NMS systems typically do not have the ability to display or otherwise provide information about how logical communication links are implemented at the physical layer level.

SUMMARY

The present disclosure relates to communications connector assemblies and arrangements that provide physical layer management (PLM) capabilities. In accordance with certain aspects, the disclosure relates to a contact set arrangement that can be used in connector assemblies and/or connector arrangements.

BRIEF DESCRIPTION OF THE DRAWINGS

The accompanying drawings, which are incorporated in and constitute a part of the description, illustrate several aspects of the present disclosure. A brief description of the drawings is as follows.

DETAILED DESCRIPTION

Figure 1:
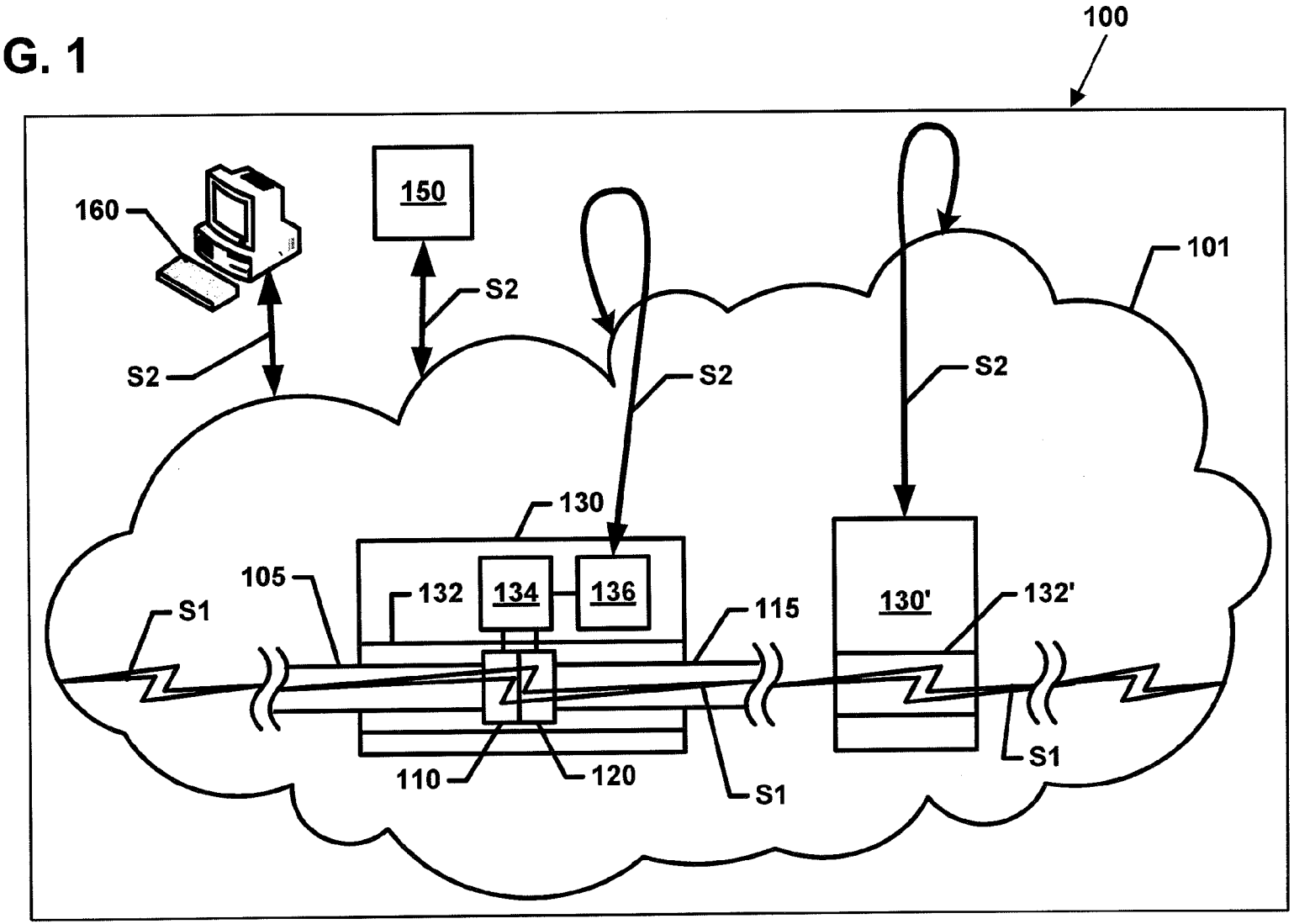
FIG. 1 is a diagram of a portion of an example communications and data management system in accordance with aspects of the present disclosure.

FIG. 1 is a diagram of a portion of an example communications and data management system 100. The example system 100 shown in FIG. 1 includes a part of a communications network 101 along which communications signals S1 pass. In one example implementation, the network 101 can include an Internet Protocol network. In other implementations, however, the communications network 101 may include other types of networks.

The communications network 101 includes interconnected network components (e.g., connector assemblies, inter-networking devices, internet working devices, servers, outlets, and end user equipment (e.g., computers)). In one example implementation, communications signals S1 pass from a computer to a wall outlet to a port of communication panel, to a first port of an inter-networking device, out another port of the inter-networking device, to a port of the same or another communications panel, to a rack mounted server.

The portion of the communications network 101 shown in FIG. 1 includes first and second connector assemblies 130, 130' at which communications signals S1 pass from one portion of the communications network 101 to another portion of the communications network 101. Non-limiting examples of connector assemblies 130, 130' include, for example, rack-mounted connector assemblies (e.g., patch panels, distribution units, and media converters for fiber and copper physical communication media), wall-mounted connector assemblies (e.g., boxes, jacks, outlets, and media converters for fiber and copper physical communication media), and inter-networking devices (e.g., switches, routers, hubs, repeaters, gateways, and access points). In the example shown, the first connector assembly 130 defines at least one port 132 configured to communicatively couple at least a first media segment 105 to at least a second media segment 115 to enable the communication signals S1 to pass between the media segments 105, 115.

The at least one port 132 of the first connector assembly 130 may be directly connected to a port 132' of the second connector assembly 130'. As the term is used herein, the port 132 is directly connected to the port 132' when the communications signals S1 pass between the two ports 132, 132' without passing through an intermediate port. For example, routing a patchcord between port 132 and port 132' directly connects the ports 132, 132'.

The port 132 of the first connector assembly 130 also may be indirectly connected to the port 132' of the second connector assembly 130'. As the term is used herein, the port 132 is indirectly connected to the port 132' when the communications signals S1 pass through an intermediate port when traveling between the ports 132, 132'. For example, in one implementation, the communications signals S1 may be routed over one media segment from the port 132 at the first connector assembly 130 to a port of a third connector assembly at which the media segment is coupled to another media segment that is routed from the port of the third connector assembly to the port 132' of the second connector assembly 130'.

Non-limiting examples of media segments include optical fibers, which carry optical data signals, and electrical conductors (e.g., CAT-5, 6, and 7 twisted-pair cables), which carry electrical data signals. Media segments also can include electrical plugs, fiber optic connectors (e.g., SC, LC, FC, LX.5, or MPO connectors), adapters, media converters, and other physical components terminating to the fibers, conductors, or other such media segments. The techniques described here also can be used with other types of connectors including, for example, BNC connectors, F connectors, DSX jacks and plugs, bantam jacks and plugs.

In the example shown, each media segment 105, 115 is terminated at a plug or connector 110, 120, respectively, which is configured to communicatively connect the media segments 105, 115. For example, in one implementation, the port 132 of the connector assembly 130 can be configured to align ferrules of two fiber optic connectors 110, 120. In another implementation, the port 132 of the connector assembly 130 can be configured to electrically connect an electrical plug with an electrical socket (e.g., a jack). In yet another implementation, the port 132 can include a media converter configured to connect an optical fiber to an electrical conductor.

In accordance with some aspects, the connector assembly 130 does not actively manage (e.g., is passive with respect to) the communications signals S1 passing through port 132. For example, in some implementations, the connector assembly 130 does not modify the communications signal S1 carried over the media segments 105, 115. Further, in some implementations, the connector assembly 130 does not read, store, or analyze the communications signal S1 carried over the media segments 105, 115.

In accordance with aspects of the disclosure, the communications and data management system 100 also provides physical layer information (PLI) functionality as well as physical layer management (PLM) functionality. As the term is used herein, "PLI functionality" refers to the ability of a physical component or system to identify or otherwise associate physical layer information with some or all of the physical components used to implement the physical layer of the system. As the term is used herein, "PLM functionality" refers to the ability of a component or system to manipulate or to enable others to manipulate the physical components used to implement the physical layer of the system (e.g., to track what is connected to each component, to trace connections that are made using the components, or to provide visual indications to a user at a selected component).

As the term is used herein, "physical layer information" refers to information about the identity, attributes, and/or status of the physical components used to implement the physical layer of the communications system 101. In accordance with some aspects, physical layer information of the communications system 101 can include media information, device information, and location information.

As the term is used herein, "media information" refers to physical layer information pertaining to cables, plugs, connectors, and other such media segments. In accordance with some aspects, the media information is stored on or in the media segments, themselves. In accordance with other aspects, the media information can be stored at one or more data repositories for the communications system, either alternatively or in addition to the media, themselves. Non-limiting examples of media information include a part number, a serial number, a plug or other connector type, a conductor or fiber type, a cable or fiber length, cable polarity, a cable or fiber pass-through capacity, a date of manufacture, a manufacturing lot number, information about one or more visual attributes of physical communication media (e.g., information about the color or shape of the physical communication media or an image of the physical communication media), and an insertion count (i.e., a record of the number of times the media segment has been connected to another media segment or network component). Media information also can include testing or media quality or performance information. The testing or media quality or performance information, for example, can be the results of testing that is performed when a particular segment of media is manufactured.

As the term is used herein, "device information" refers to physical layer information pertaining to the communications panels, inter-networking devices, media converters, computers, servers, wall outlets, and other physical communications devices to which the media segments attach. In accordance with some aspects, the device information is stored on or in the devices, themselves. In accordance with other aspects, the device information can be stored at one or more data repositories for the communications system, either alternatively or in addition to the devices, themselves. Non-limiting examples of device information include a device identifier, a device type, port priority data (that associates a priority level with each port), and port updates (described in more detail herein).

As the term is used herein, "location information" refers to physical layer information pertaining to a physical layout of a building or buildings in which the network 101 is deployed. Location information also can include information indicating where each communications device, media segment, network component, or other component that is physically located within the building. In accordance with some aspects, the location information of each system component is stored on or in the respective component. In accordance with other aspects, the location information can be stored at one or more data repositories for the communications system, either alternatively or in addition to the system components, themselves.

In accordance with some aspects, one or more of the components of the communications network 101 is configured to store physical layer information pertaining to the component as will be disclosed in more detail herein. In FIG. 1, the connectors 110, 120, the media segments 105, 115, and/or the connector assemblies 130, 130' may store physical layer information. For example, in FIG. 1, each connector 110, 120 may store information pertaining to itself (e.g., type of connector, data of manufacture, etc.) and/or to the respective media segment 105, 115 (e.g., type of media, test results, etc.).

In another example implementation, the media segments 105, 115 or connectors 110, 120 may store media information that includes a count of the number of times that the media segment (or connector) has been inserted into port 132. In such an example, the count stored in or on the media segment is updated each time the segment (or plug or connector) is inserted into port 132. This insertion count value can be used, for example, for warranty purposes (e.g., to determine if the connector has been inserted more than the number of times specified in the warranty) or for security purposes (e.g., to detect unauthorized insertions of the physical communication media).

In accordance with certain aspects, one or more of the components of the communications network 101 also can read the physical layer information from one or more media segments retained thereat. In certain implementations, one or more network components includes a media reading interface that is configured to read physical layer information stored on or in the media segments or connectors attached thereto. For example, in one implementation, the connector assembly 130 includes a media reading interface 134 that can read media information stored on the media cables 105, 115 retained within the port 132. In another implementation, the media reading interface 134 can read media information stored on the connectors or plugs 110, 120 terminating the cables 105, 115, respectively.

In some implementations, some types of physical layer information can be obtained by the connector assembly 130 from a user at the connector assembly 130 via a user interface (e.g., a keypad, a scanner, a touch screen, buttons, etc.). The connector assembly 130 can provide the physical layer information obtained from the user to other devices or systems that are coupled to the network 101 (as described in more detail herein). In other implementations, some or all physical layer information can be obtained by the connector assembly 130 from other devices or systems that are coupled to the network 101. For example, physical layer information pertaining to media that is not configured to store such information can be entered manually into another device or system that is coupled to the network 101 (e.g., at the connector assembly 130, at the computer 160, or at the aggregation point 150).

In some implementations, some types of non-physical layer information (e.g., network information) can be obtained by one network component from other devices or systems that are coupled to the network 101. For example, the connector assembly 130 may pull non-physical layer information from one or more components of the network 101. In other implementations, the non-physical layer information can be obtained by the connector assembly 130 from a user at the connector assembly 130.

In accordance with some aspects of the disclosure, the physical layer information read by a network component may be processed or stored at the component. For example, in certain implementations, the first connector assembly 130 shown in FIG. 1 is configured to read physical layer information stored on the connectors 110, 120 and/or on the media segments 105, 115 using media reading interface 134. Accordingly, in FIG. 1, the first connector assembly 130 may store not only physical layer information about itself (e.g., the total number of available ports at that assembly 130, the number of ports currently in use, etc.), but also physical layer information about the connectors 110, 120 inserted at the ports and/or about the media segments 105, 115 attached to the connectors 110, 120.

In some implementations, the connector assembly 130 is configured to add, delete, and/or change the physical layer information stored in or on the segment of physical communication media 105, 115 (i.e., or the associated connectors 110, 120). For example, in some implementations, the media information stored in or on the segment of physical communication media 105, 115 can be updated to include the results of testing that is performed when a segment of physical media is installed or otherwise checked. In other implementations, such testing information is supplied to the aggregation point 150 for storage and/or processing. In some implementations, modification of the physical layer information does not affect the communications signals S1 passing through the connector assembly 130.

In other implementations, the physical layer information obtained by the media reading interface (e.g., interface 134 of FIG. 1) may be communicated (see PLI signals S2) over the network 101 for processing and/or storage. The components of the communications network 101 are connected to one or more aggregation devices 150 (described in greater detail herein) and/or to one or more computing systems 160. For example, in the implementation shown in FIG. 1, each connector assembly 130 includes a PLI port 136 that is separate from the "normal" ports 132 of the connector assembly 130. Physical layer information is communicated between the connector assembly 130 and the network 101 through the PLI port 136. In the example shown in FIG. 1, the connector assembly 130 is connected to a representative aggregation device 150, a representative computing system 160, and to other components of the network 101 (see looped arrow) via the PLI port 136.

The physical layer information is communicated over the network 101 just like any other data that is communicated over the network 101, while at the same time not affecting the communication signals S1 that pass through the connector assembly 130 on the normal ports 132. Indeed, in some implementations, the physical layer information may be communicated as one or more of the communication signals S1 that pass through the normal ports 132 of the connector assemblies 130, 130'. For example, in one implementation, a media segment may be routed between the PLI port 136 and one of the "normal" ports 132. In such an implementation, the physical layer information may be passed along the communications network 101 to other components of the communications network 101 (e.g., to the one or more aggregation points 150 and/or to the one or more computer systems 160). By using the network 101 to communicate physical layer information pertaining to it, an entirely separate network need not be provided and maintained in order to communicate such physical layer information.

In other implementations, however, the communications network 101 includes a data network along which the physical layer information described above is communicated. At least some of the media segments and other components of the data network may be separate from those of the communications network 101 to which such physical layer information pertains. For example, in some implementations, the first connector assembly 130 may include a plurality of fiber optic adapters defining ports at which connectorized optical fibers are optically coupled together to create an optical path for communications signals Sl. The first connector assembly 130 also may include one or more electrical cable ports at which the physical layer information (see PLI signals S2) are passed to other parts of the data network. (e.g., to the one or more aggregation points 150 and/or to the one or more computer systems 160).

Figure 2:
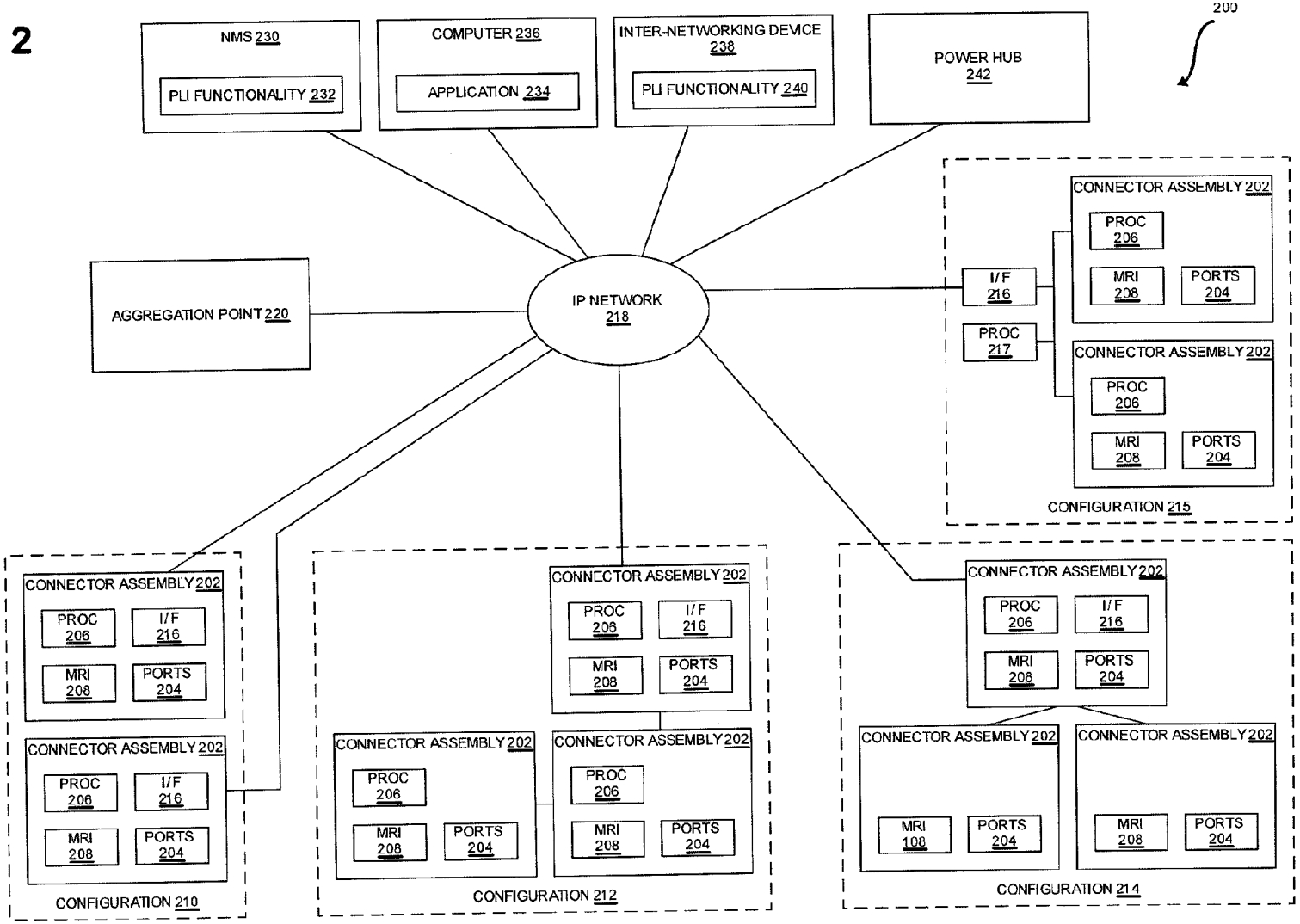
FIG. 2 is a block diagram of one implementation of a communications management system that includes PLI functionality as well as PLM functionality in accordance with aspects of the present disclosure.

FIG. 2 is a block diagram of one example implementation of a communications management system 200 that includes PLI functionality as well as PLM functionality. The management system 200 comprises a plurality of connector assemblies 202. The system 200 includes one or more connector assemblies 202 connected to an IP network 218. The connector assemblies 202 shown in FIG. 2 illustrate various implementations of the connector assembly 130 of FIG. 1.

Each connector assembly 202 includes one or more ports 204, each of which is used to connect two or more segments of physical communication media to one another (e.g., to implement a portion of a logical communication link for communication signals S1 of FIG. 1). At least some of the connector assemblies 202 are designed for use with segments of physical communication media that have physical layer information stored in or on them. The physical layer information is stored in or on the segment of physical communication media in a manner that enables the stored information, when the segment is attached to a port 204, to be read by a programmable processor 206 associated with the connector assembly 202.

In the particular implementation shown in FIG. 2, each of the ports 204 of the connector assemblies 202 comprises a respective media reading interface 208 via which the respective programmable processor 206 is able to determine if a physical communication media segment is attached to that port 204 and, if one is, to read the physical layer information stored in or on the attached segment (if such media information is stored therein or thereon). The programmable processor 206 associated with each connector assembly 202 is communicatively coupled to each of the media reading interfaces 208 using a suitable bus or other interconnect (not shown).

In the particular implementation shown in FIG. 2, four example types of connector assembly configurations are shown. In the first connector assembly configuration 210 shown in FIG. 2, each connector assembly 202 includes its own respective programmable processor 206 and its own respective network interface 216 that is used to communicatively couple that connector assembly 202 to an Internet Protocol (IP) network 218.

In the second type of connector assembly configuration 212, a group of connector assemblies 202 are physically located near each other (e.g., in a bay or equipment closet). Each of the connector assemblies 202 in the group includes its own respective programmable processor 206. However, in the second connector assembly configuration 212, some of the connector assemblies 202 (referred to here as "interfaced connector assemblies") include their own respective network interfaces 216 while some of the connector assemblies 202 (referred to here as "non-interfaced connector assemblies") do not. The non-interfaced connector assemblies 202 are communicatively coupled to one or more of the interfaced connector assemblies 202 in the group via local connections. In this way, the non-interfaced connector assemblies 202 are communicatively coupled to the IP network 218 via the network interface 216 included in one or more of the interfaced connector assemblies 202 in the group. In the second type of connector assembly configuration 212, the total number of network interfaces 216 used to couple the connector assemblies 202 to the IP network 218 can be reduced. Moreover, in the particular implementation shown in FIG. 2, the non-interfaced connector assemblies 202 are connected to the interfaced connector assembly 202 using a daisy chain topology (though other topologies can be used in other implementations and embodiments).

In the third type of connector assembly configuration 214, a group of connector assemblies 202 are physically located near each other (e.g., within a bay or equipment closet). Some of the connector assemblies 202 in the group (also referred to here as "master" connector assemblies 202) include both their own programmable processors 206 and network interfaces 216, while some of the connector assemblies 202 (also referred to here as "slave" connector assemblies 202) do not include their own programmable processors 206 or network interfaces 216. Each of the slave connector assemblies 202 is communicatively coupled to one or more of the master connector assemblies 202 in the group via one or more local connections. The programmable processor 206 in each of the master connector assemblies 202 is able to carry out the PLM functions for both the master connector assembly 202 of which it is a part and any slave connector assemblies 202 to which the master connector assembly 202 is connected via the local connections. As a result, the cost associated with the slave connector assemblies 202 can be reduced. In the particular implementation shown in FIG. 2, the slave connector assemblies 202 are connected to a master connector assembly 202 in a star topology (though other topologies can be used in other implementations and embodiments).

Each programmable processor 206 is configured to execute software or firmware that causes the programmable processor 206 to carry out various functions described below. Each programmable processor 206 also includes suitable memory (not shown) that is coupled to the programmable processor 206 for storing program instructions and data. In general, the programmable processor 206 determines if a physical communication media segment is attached to a port 204 with which that processor 206 is associated and, if one is, to read the identifier and attribute information stored in or on the attached physical communication media segment (if the segment includes such information stored therein or thereon) using the associated media reading interface 208.

In the fourth type of connector assembly configuration 215, a group of connector assemblies 202 are housed within a common chassis or other enclosure. Each of the connector assemblies 202 in the configuration 215 includes their own programmable processors 206. In the context of this configuration 215, the programmable processors 206 in each of the connector assemblies are "slave" processors 206. Each of the slave programmable processor 206 is also communicatively coupled to a common "master" programmable processor 217 (e.g., over a backplane included in the chassis or enclosure). The master programmable processor 217 is coupled to a network interface 216 that is used to communicatively couple the master programmable processor 217 to the IP network 218.

In this configuration 215, each slave programmable processor 206 is configured to determine if physical communication media segments are attached to its port 204 and to read the physical layer information stored in or on the attached physical communication media segments (if the attached segments have such information stored therein or thereon) using the associated media reading interfaces 208. The physical layer information is communicated from the slave programmable processor 206 in each of the connector assemblies 202 in the chassis to the master processor 217. The master processor 217 is configured to handle the processing associated with communicating the physical layer information read from by the slave processors 206 to devices that are coupled to the IP network 218.

The system 200 includes functionality that enables the physical layer information that the connector assemblies 202 capture to be used by application-layer functionality outside of the traditional physical-layer management application domain. That is, the physical layer information is not retained in a PLM "island" used only for PLM purposes but is instead made available to other applications. In the particular implementation shown in FIG. 2, the management system 200 includes an aggregation point 220 that is communicatively coupled to the connector assemblies 202 via the IP network 218.

The aggregation point 220 includes functionality that obtains physical layer information from the connector assemblies 202 (and other devices) and stores the physical layer information in a data store. The aggregation point 220 can be used to receive physical layer information from various types of connector assemblies 202 that have functionality for automatically reading information stored in or on the segment of physical communication media. Also, the aggregation point 220 and aggregation functionality 224 can be used to receive physical layer information from other types of devices that have functionality for automatically reading information stored in or on the segment of physical communication media. Examples of such devices include end-user devices—such as computers, peripherals (e.g., printers, copiers, storage devices, and scanners), and IP telephones—that include functionality for automatically reading information stored in or on the segment of physical communication media.

The aggregation point 220 also can be used to obtain other types of physical layer information. For example, in this implementation, the aggregation point 220 also obtains information about physical communication media segments that is not otherwise automatically communicated to an aggregation point 220. This information can be provided to the aggregation point 220, for example, by manually entering such information into a file (e.g., a spreadsheet) and then uploading the file to the aggregation point 220 (e.g., using a web browser) in connection with the initial installation of each of the various items. Such information can also, for example, be directly entered using a user interface provided by the aggregation point 220 (e.g., using a web browser).

The aggregation point 220 also includes functionality that provides an interface for external devices or entities to access the physical layer information maintained by the aggregation point 220. This access can include retrieving information from the aggregation point 220 as well as supplying information to the aggregation point 220. In this implementation, the aggregation point 220 is implemented as "middleware" that is able to provide such external devices and entities with transparent and convenient access to the PLI maintained by the access point 220. Because the aggregation point 220 aggregates PLI from the relevant devices on the IP network 218 and provides external devices and entities with access to such PLI, the external devices and entities do not need to individually interact with all of the devices in the IP network 218 that provide PLI, nor do such devices need to have the capacity to respond to requests from such external devices and entities.

For example, as shown in FIG. 2, a network management system (NMS) 230 includes PLI functionality 232 that is configured to retrieve physical layer information from the aggregation point 220 and provide it to the other parts of the NMS 230 for use thereby. The NMS 230 uses the retrieved physical layer information to perform one or more network management functions. The NMS 230 communicates with the aggregation point 220 over the IP network 218.

As shown in FIG. 2, an application 234 executing on a computer 236 can also use the API implemented by the aggregation point 220 to access the PLI information maintained by the aggregation point 220 (e.g., to retrieve such information from the aggregation point 220 and/or to supply such information to the aggregation point 220). The computer 236 is coupled to the IP network 218 and accesses the aggregation point 220 over the IP network 218.

In the example shown in FIG. 2, one or more inter-networking devices 238 used to implement the IP network 218 include physical layer information (PLI) functionality 240. The PLI functionality 240 of the inter-networking device 238 is configured to retrieve physical layer information from the aggregation point 220 and use the retrieved physical layer information to perform one or more inter-networking functions. Examples of inter-networking functions include Layer 1, Layer 2, and Layer 3 (of the OSI model) inter-networking functions such as the routing, switching, repeating, bridging, and grooming of communication traffic that is received at the inter-networking device.

The aggregation point 220 can be implemented on a standalone network node (e.g., a standalone computer running appropriate software) or can be integrated along with other network functionality (e.g., integrated with an element management system or network management system or other network server or network element). Moreover, the functionality of the aggregation point 220 can be distribute across many nodes and devices in the network and/or implemented, for example, in a hierarchical manner (e.g., with many levels of aggregation points). The IP network 218 can include one or more local area networks and/or wide area networks (e.g., the Internet). As a result, the aggregation point 220, NMS 230, and computer 236 need not be located at the same site as each other or at the same site as the connector assemblies 202 or the inter-networking devices 238.

Also, power can be supplied to the connector assemblies 202 using conventional "Power over Ethernet" techniques specified in the IEEE 802.3af standard, which is hereby incorporated herein by reference. In such an implementation, a power hub 242 or other power supplying device (located near or incorporated into an inter-networking device that is coupled to each connector assembly 202) injects DC power onto one or more of the wires (also referred to here as the "power wires") included in the copper twisted-pair cable used to connect each connector assembly 202 to the associated inter-networking device.

Figure 3:
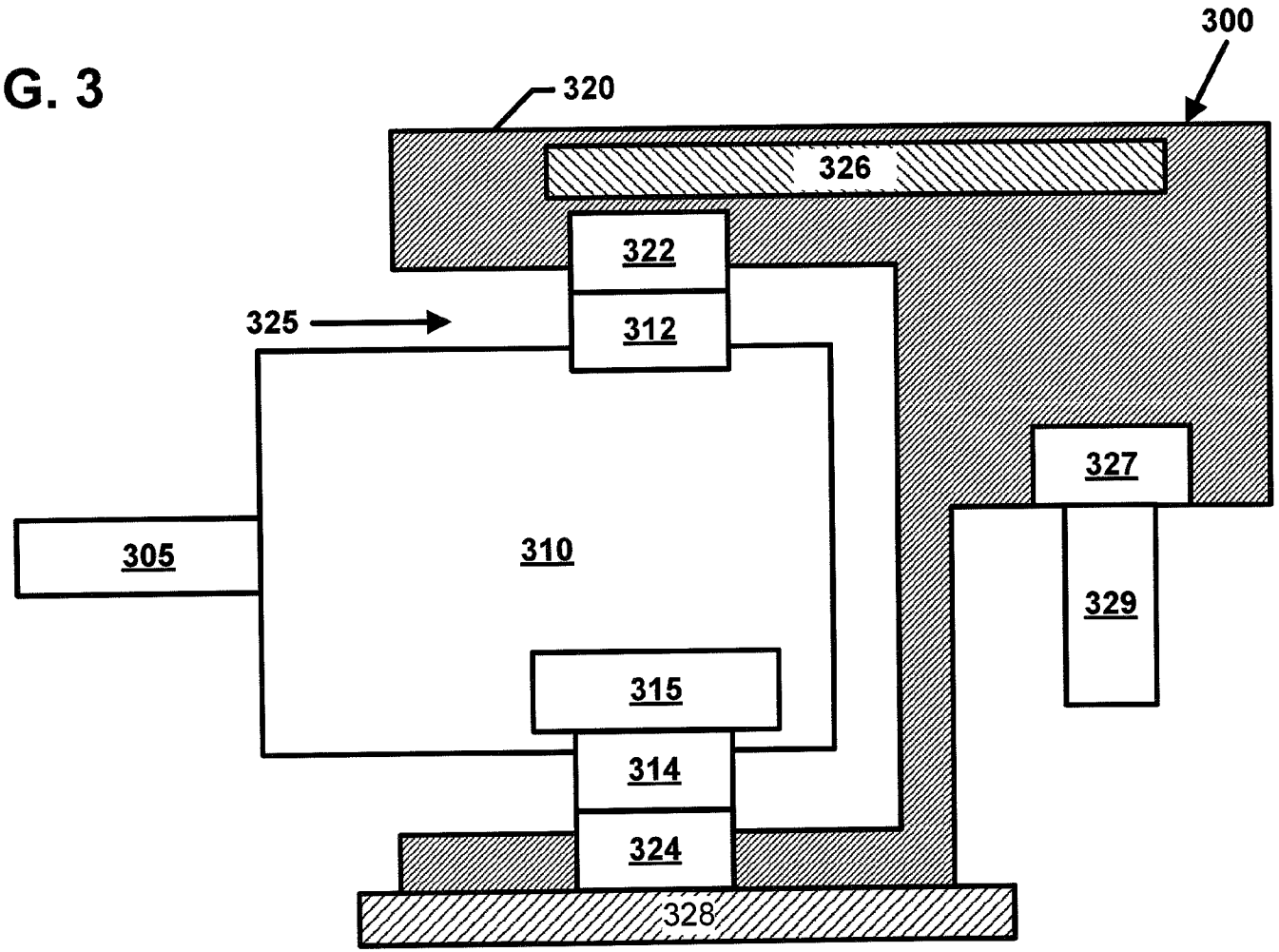
FIG. 3 is a block diagram of one high-level example of a port and media reading interface that are suitable for use in the management system of FIG. 2 in accordance with aspects of the present disclosure.

FIG. 3 is a schematic diagram of one example connection system 300 including a connector assembly 320 configured to collect physical layer information from a connector arrangement 310. The example connection system 300 shown includes a jack module 320 and an electrical plug 310. The connector arrangement 310 terminates at least a first electrical segment (e.g., a conductor cable) 305 of physical communications media and the connector assembly 320 terminates at least second electrical segments (e.g., twisted pairs of copper wires) 329 of physical communications media. The connector assembly 320 defines at least one socket port 325 in which the connector arrangement 310 can be accommodated.

Each electrical segment 305 of the connector arrangement 310 carries communication signals (e.g., communications signals S1 of FIG. 1) to primary contact members 312 on the connector arrangement 310. The connector assembly 320 includes a primary contact arrangement 322 that is accessible from the socket port 325. The primary contact arrangement 322 is aligned with and configured to interface with the primary contact members 312 to receive the communications signals (S1 of FIG. 1) from the primary contact members 312 when the connector arrangement 310 is inserted into the socket 325 of the connector assembly 320.

The connector assembly 320 is electrically coupled to one or more printed circuit boards. For example, the connector assembly 320 can support or enclose a first printed circuit board 326, which connects to insulation displacement contacts (IDCs) 327 or to another type of electrical contacts. The IDCs 327 terminate the electrical segments 329 of physical communications media (e.g., conductive wires). The first printed circuit board 326 manages the primary communication signals carried from the conductors terminating the cable 305 to the electrical segments 329 that couple to the IDCs 327.

In accordance with some aspects, the connector arrangement 310 can include a storage device 315 configured to store physical layer information. The connector arrangement 310 also includes second contact members 314 that are electrically coupled (i.e., or otherwise communicatively coupled) to the storage device 315. In one implementation, the storage device 315 is implemented using an EEPROM (e.g., a PCB surface-mount EEPROM). In other implementations, the storage device 315 is implemented using other non-volatile memory device. Each storage device 315 is arranged and configured so that it does not interfere or interact with the communications signals communicated over the media segment 305.

The connector assembly 320 also includes a second contact arrangement (e.g., a media reading interface) 324. In certain implementations, the media reading interface 324 is accessible through the socket port 325. The second contact arrangement 324 is aligned with and configured to interface with the second contact members 314 of the media segment to receive the physical layer information from the storage device 315 when the connector arrangement 310 is inserted into the socket 325 of the connector assembly 320.

In some such implementations, the storage device interfaces 314 and the media reading interfaces 324 each comprise three (3) leads—a power lead, a ground lead, and a data lead. The three leads of the storage device interface 314 come into electrical contact with three (3) corresponding leads of the media reading interface 324 when the corresponding media segment is inserted in the corresponding port 325. In certain example implementations, a two-line interface is used with a simple charge pump. In still other implementations, additional leads can be provided (e.g., for potential future applications). Accordingly, the storage device interfaces 314 and the media reading interfaces 324 may each include four (4) leads, five (5) leads, six (6) leads, etc.

The storage device 315 also may include a processor or micro-controller, in addition to the storage for the physical layer information. In some example implementations, the micro-controller can be used to execute software or firmware that, for example, performs an integrity test on the cable 305 (e.g., by performing a capacitance or impedance test on the sheathing or insulator that surrounds the cable 305, (which may include a metallic foil or metallic filler for such purposes)). In the event that a problem with the integrity of the cable 305 is detected, the micro-controller can communicate that fact to a programmable processor (e.g., processor 206 of FIG. 2) associated with the port using the storage device interface (e.g., by raising an interrupt). The micro-controller also can be used for other functions.

The connector assembly 320 also can support or enclose a second printed circuit board 328, which connects to the second contact arrangement 324. The second printed circuit board 328 manages the physical layer information communicated from a storage device 315 through second contacts 314, 324. In the example shown, the second printed circuit board 328 is positioned on an opposite side of the connector assembly 320 from the first printed circuit board 326. In other implementations, the printed circuit boards 326, 328 can be positioned on the same side or on different sides. In one implementation, the second printed circuit board 328 is positioned horizontally relative to the connector assembly 320 (see FIG. 3). In another implementation, the second printed circuit board 328 is positioned vertically relative to the connector assembly 320.

The second printed circuit board 328 can be communicatively connected to one or more programmable electronic processors and/or one or more network interfaces. In one implementation, one or more such processors and interfaces can be arranged as components on the printed circuit board 328. In another implementation, one of more such processor and interfaces can be arranged on a separate circuit board that is coupled to the second printed circuit board 328. For example, the second printed circuit board 328 can couple to other circuit boards via a card edge type connection, a connector-to-connector type connection, a cable connection, etc. The network interface is configured to send the physical layer information to the data network (e.g., see signals S2 of FIG. 1).

Figure 4:
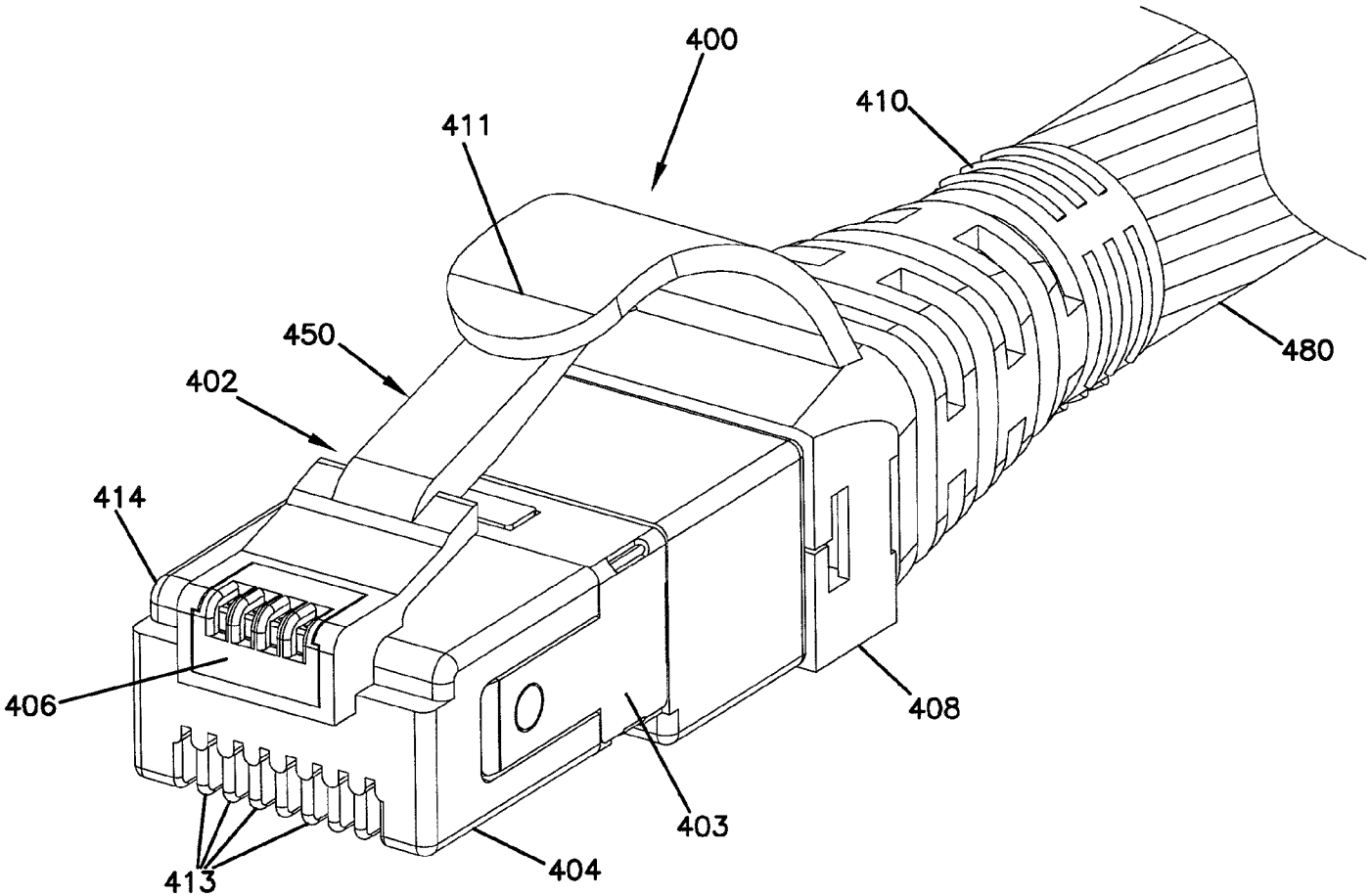
FIGS. 4-6 show one example plug connector including primary contacts and secondary contacts in accordance with aspects of the present disclosure.
Figure 5:
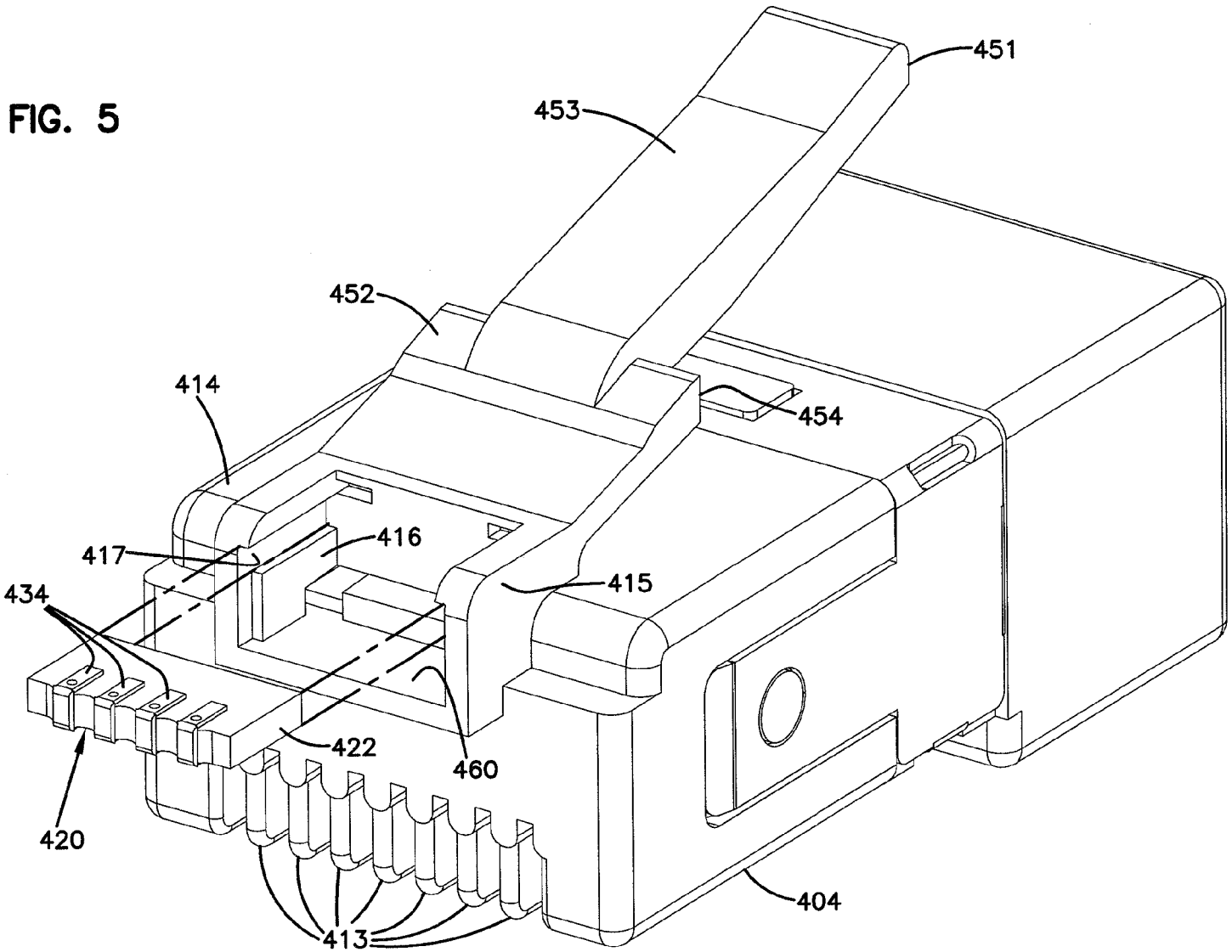
Figure 6:
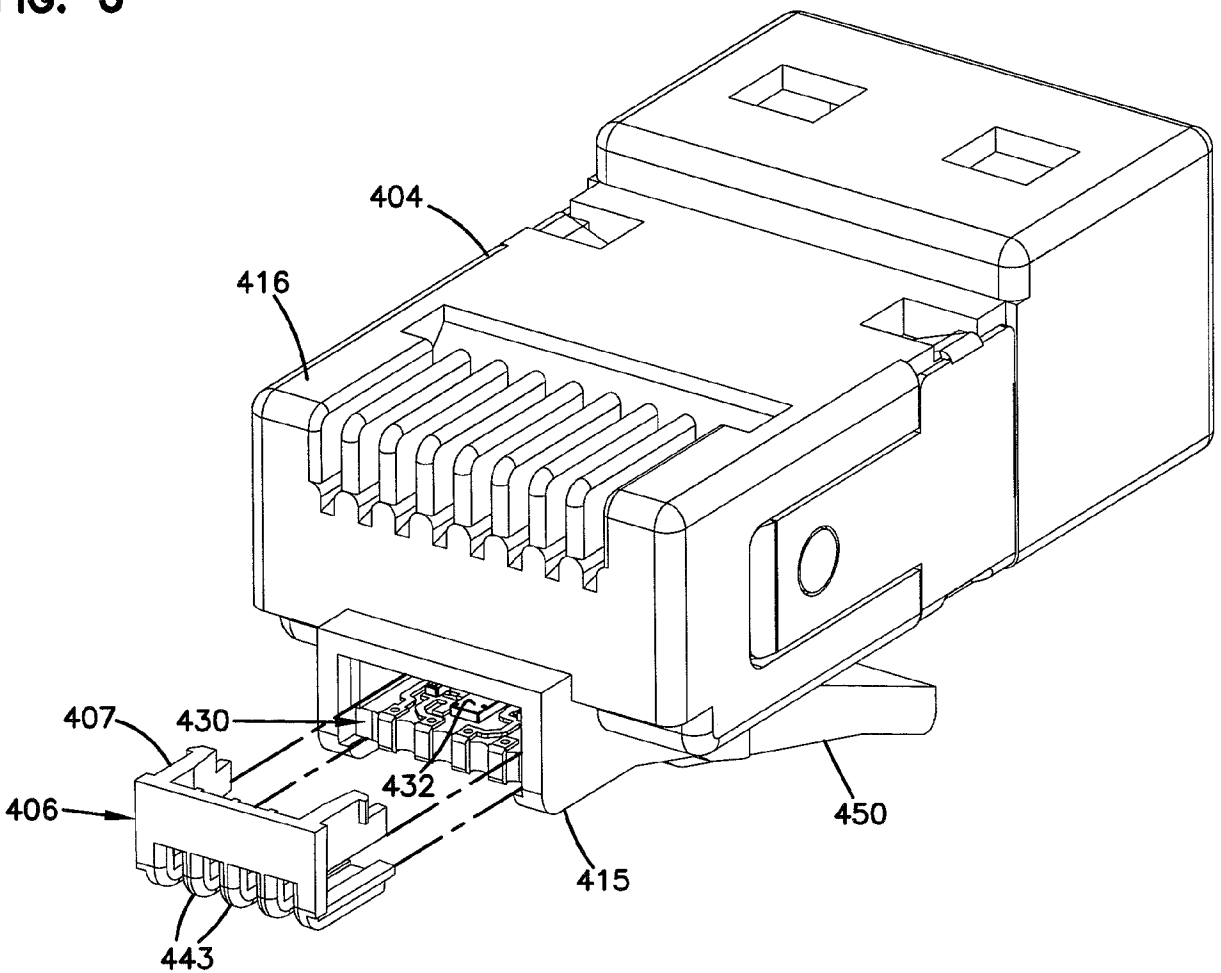
Figure 68:
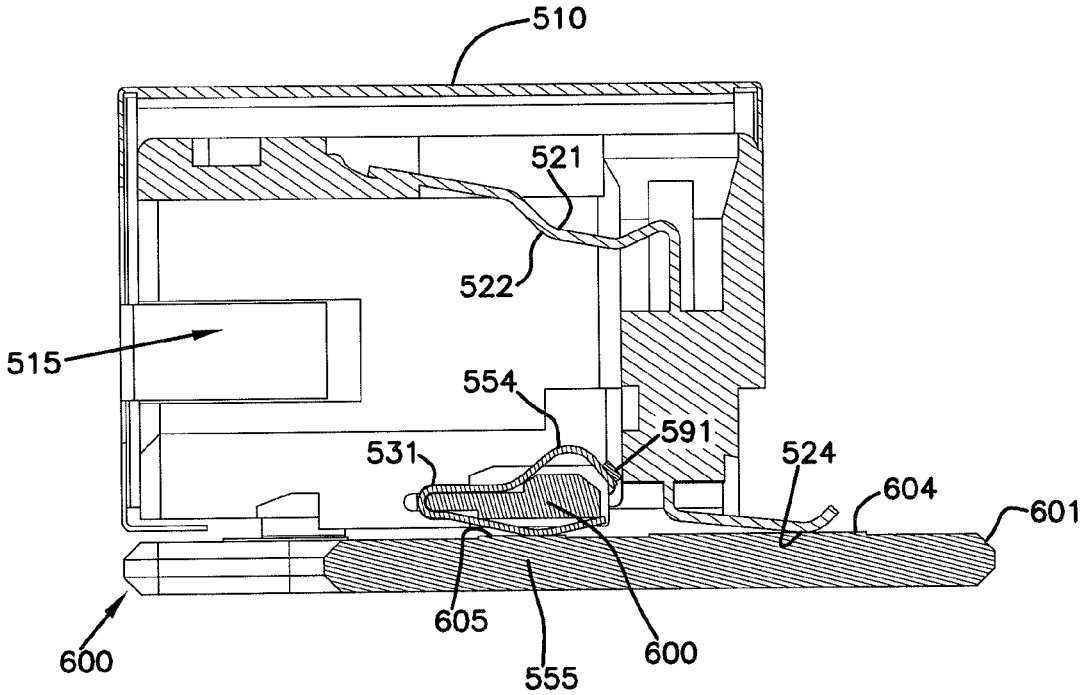

FIGS. 4-68 provide an example implementation of components for electrical (e.g., copper) communications applications in physical layer management networks. FIGS. 4-6 show an example of a connector arrangement 400 in the form of a modular plug 402 for terminating an electrical telecommunications cable 480. The connector arrangement 400 is configured to be received, for signal transmission, within a port of a connector assembly, such as connector assembly 500 (FIGS. 7-11). In accordance with one aspect, the connector arrangement 400 includes a plug 402, such as an RJ plug, that connects to the end of an electrical segment of telecommunications media, such as twisted pair copper cable 480. In one embodiment, a shield can be mounted to the plug nose body 404. For example, the shield can be snap-fit to the plug nose body 404.

The plug 402 includes a plug nose body 404 (FIGS. 5-6) configured to hold at least main signal contacts 412. The plug 402 also includes a wire manager 408 for managing the twisted wire pairs and a strain relief boot 410. For example, the plug nose body 404 defines one or more openings 405 in which lugs 409 on the wire manager 408 can latch. In accordance with some aspects, the wire manager 408 and boot 410 are integrally formed. In another implementation, the boot 410 can be connected to the wire manager 408 via a rotation-latch mechanism. In other implementations, the boot 410 can otherwise secure to the wire manager 408.

In the example shown, the plug nose body 404 has a first side 414 (FIG. 5) and a second side 416 (FIG. 6). The first side 414 of the plug nose body 404 includes a key member 415 and a finger tab 450 that extends outwardly from the key member 415. The key member 415 and finger tab 450 facilitates aligning and securing the connector arrangement 400 to a connector assembly as will be described in more detail herein. In certain implementations, the finger tab 450 attaches to the plug nose body 404 at the key member 415. In one implementation, the finger tab 450 and at least a portion of the key member 415 are unitary with the plug nose body 404.

The finger tab 450 is sufficiently resilient to enable a distal end 451 of the finger tab 450 to flex or pivot toward and away from the plug nose body 404. Certain types of finger tabs 450 include at least one cam follower surface 452 and a latch surface 454 for latching to the connector assembly as will be described in more detail herein. In certain implementations, the finger tab 450 includes two cam follower surfaces 452 located on either side of a handle extension 453 (see FIG. 5). Depressing the handle extension 453 moves the latch surfaces 454 toward the plug nose body 404. In certain implementations, the wire manager 408 and/or boot 410 include a flexible grip surface 411 that curves over at least the distal end 451 of the handle extension 453 to facilitate depressing of the handle extension 453 (e.g., see FIG. 4).

The second side 416 of the plug nose body 404 is configured to hold the main signal contacts 412, which are electrically connected to the twisted pair conductors of the telecommunications cable 480. Ribs 413 protect the main signal contacts 412. In the example shown, the plug 402 is insertable into a port of a mating jack of a connector assembly, such as jack module 510 (see FIG. 11). The main signal contacts 412 are configured to electrically connect to contacts 530 positioned in the jack module 510 for signal transmission.

The connector arrangement 400 also includes a storage device 430 (FIG. 6) that is configured to store information (e.g., an identifier and/or attribute information) pertaining to the segment of physical communications media (e.g., the plug 402 and/or the electrical cable 480 terminated thereby). In one implementation, the media storage device 430 includes an EEPROM 432. Circuit contacts 434 (FIG. 5) of the storage device 430 permit connection of the EEPROM 432 to a media reading interface, such as media reading interface 540 (FIG. 12) of the connector assembly 500. In other implementations, however, the storage device 430 can include any suitable type of memory.

The storage device 430 is mounted to or accommodated within the modular plug 402 (see FIG. 6). For example, the storage device 430 can be mounted to a circuit board 420, which can be positioned on or in the plug nose body 404 of connector arrangement 400. In some implementations, the circuit board 420 is mounted to an exterior surface of the plug nose body 404. In other implementations, however, the circuit board 420 is mounted within the plug nose body 404. For example, in certain implementations, the plug nose body 404 defines a cavity 460 at a front 401 of the body 404 (FIG. 5). In the example shown, the printed circuit board 420 can be slid along guide grooves 417 defined within the cavity 460 from the front 401 of the plug nose body 404. In other implementations, the printed circuit board 420 can be latched, glued, or otherwise secured within the cavity 460.

In the example shown, a cover section 406 covers or closes the open cavity 460. The cover section 406 includes a body defining ribs 443 that provide access to contacts 434 of the storage device 430 within the cavity 460. For example, in one implementation, contacts of a media reading interface 530 on a patch panel or jack module 510 can extend through the ribs 443 to connect to the circuit contacts 434 on the storage device 430.

Figure 7:
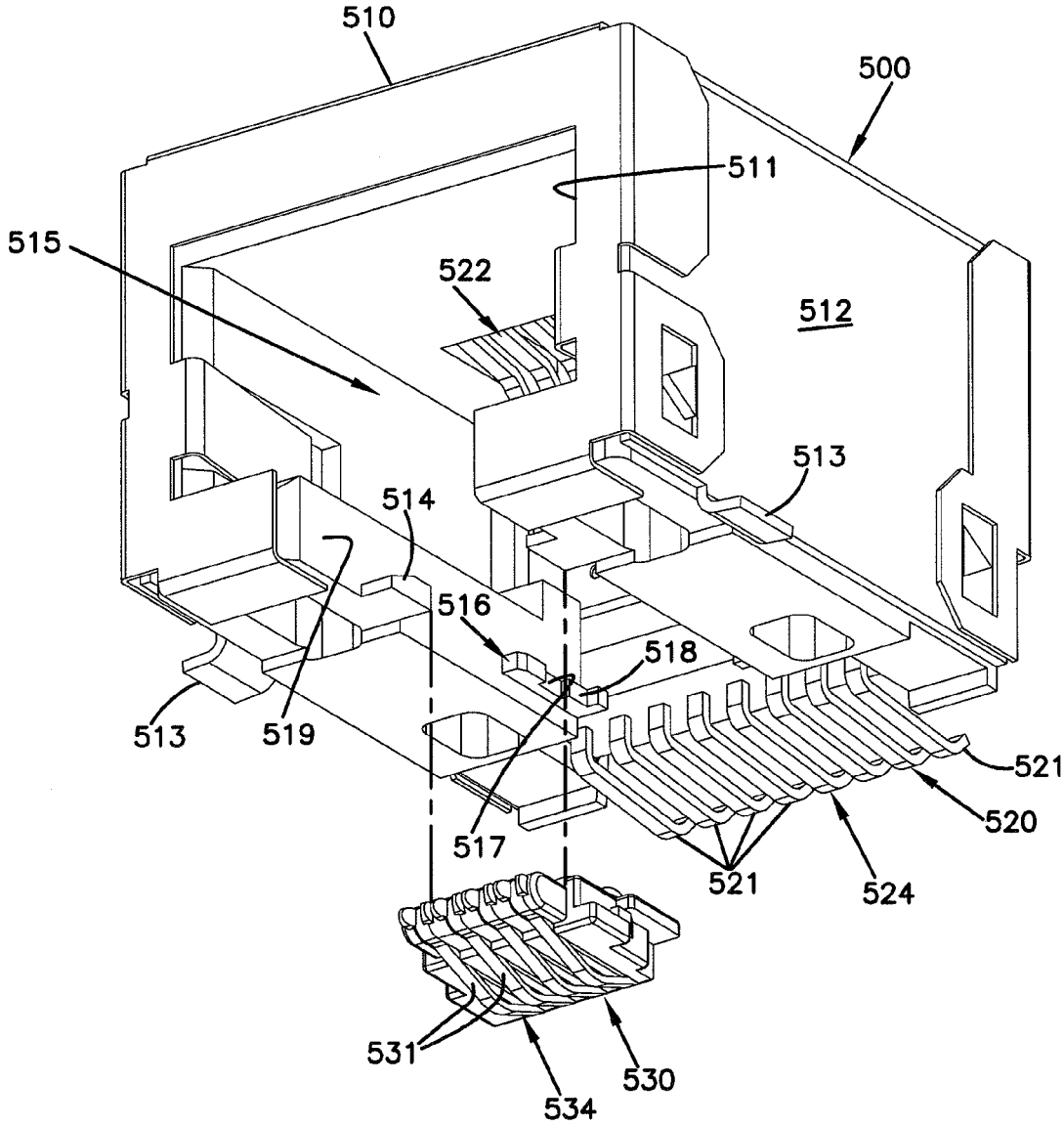
FIG. 7 is a front, bottom perspective view of an example jack module configured in accordance with aspects of the present disclosure with an example media reading interface exploded from an opening of the jack module.
Figure 8:
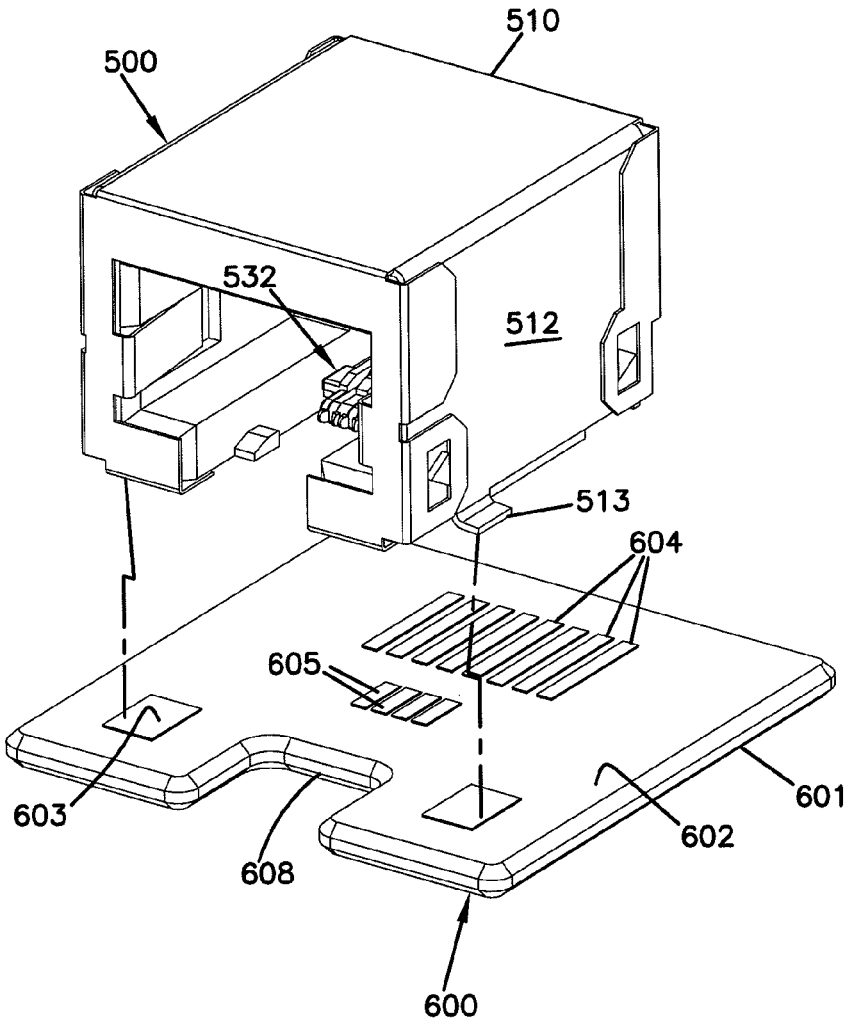
FIGS. 8 and 9 are perspective views of the jack module of FIG. 7 with the media reading interface positioned at the jack module and the jack module being exploded from an example circuit board.
Figure 9:
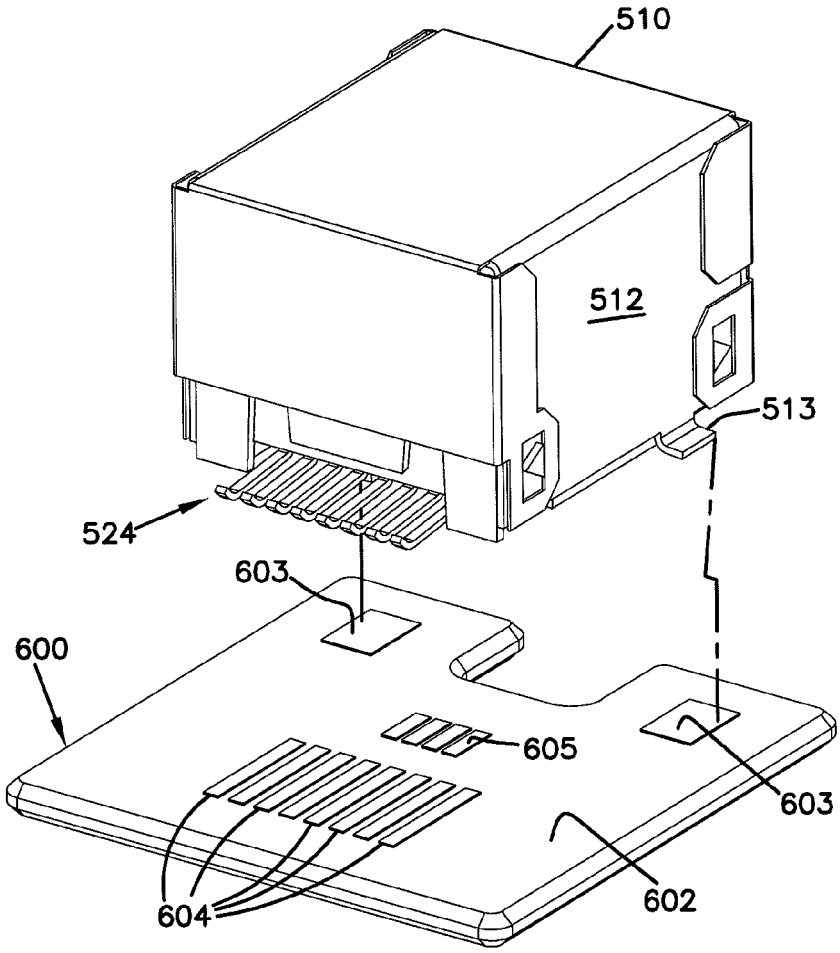
Figure 10:
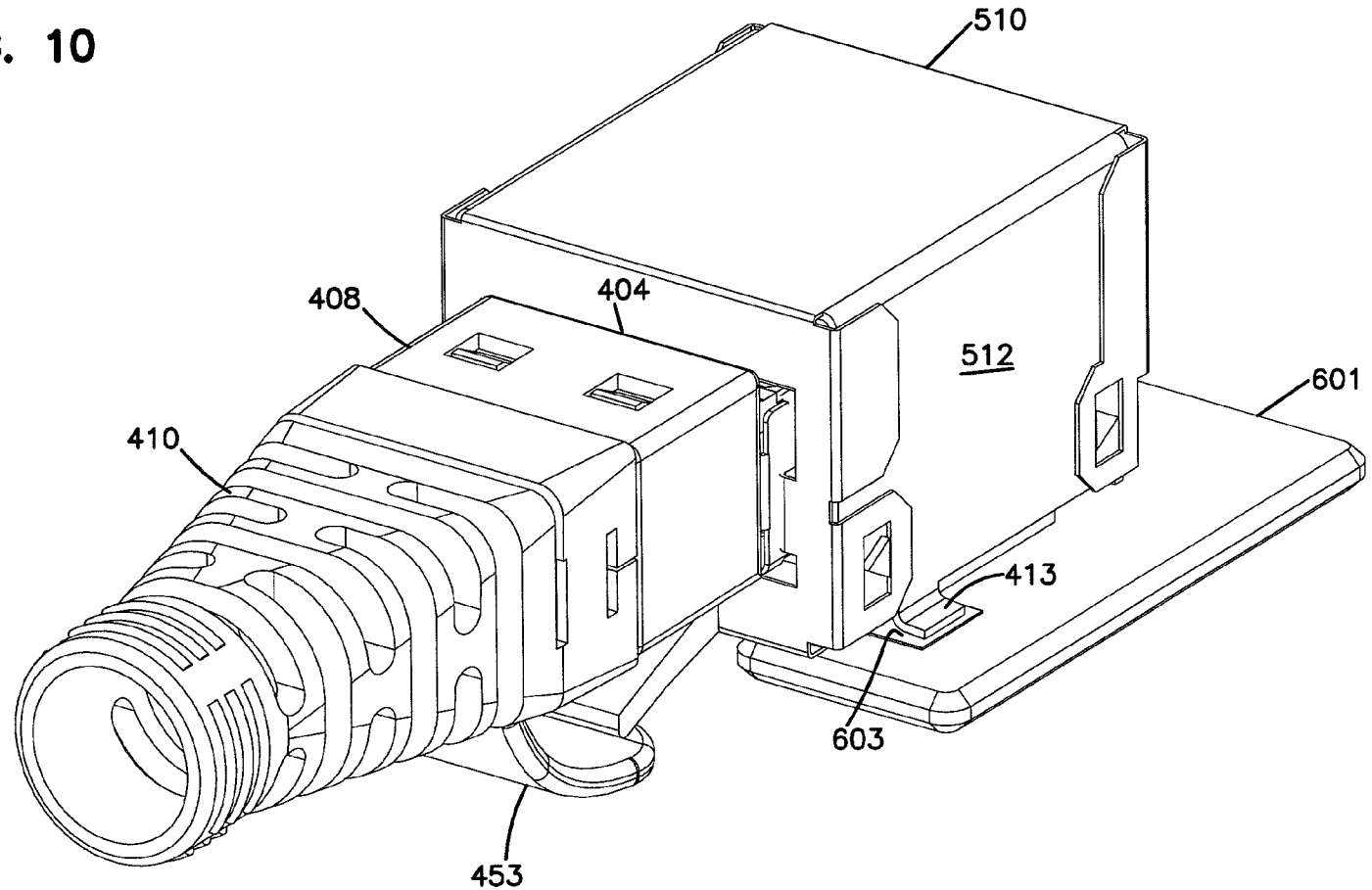
FIG. 10 is a front, top perspective view of the jack module of FIG. 7 mounted to the circuit board of FIGS. 8 and 9 and receiving the plug connector of FIGS. 4-6.

FIGS. 7-9 show one example connector assembly 500 including a jack module 510. The example jack module 510 defines a socket 515 into which the plug 402 can be inserted through an open port 511. In some implementations, the jack module 510 includes a shield 512 that provides grounding for the jack module 510. For example, the shield 512 may be snap-fit around a body of the jack module 510. In certain implementations, the shield 512 includes engagement tabs 513.

As shown in FIGS. 8 and 9, the jack module 510 is configured to mount to a circuit board 600 (e.g., a printed circuit board). In some implementations, the jack module 510 mounts to the board 600 so that the board 600 extends generally parallel to an axis of insertion of the plug 402 into the socket 515. For example, in one implementation, the jack module 510 is a right-angle jack. In other implementations, however, the jack module 510 is configured to mount to the board 600 so that the board 600 extends generally perpendicular to the axis of insertion of the plug 402. In still other implementations, the jack module 510 may be mounted to the board 600 at any desired angle.

The board 600 includes a body 601 having a first side 602 on which contact landings are provided. Certain types of boards 600 include multiple groups of landings. In certain implementations, the board 600 also includes first landings 603 for grounding. In the example shown, two grounding landings 603 are provided at a front of the circuit board body 601. The engagement tabs 513 of the shield 512 align with the grounding landings 603 to ground the jack module 510 to the circuit board 600.

The jack module 510 also includes or accommodates a first contact arrangement 520 and a second contact arrangement 530. In certain implementations, at least a portion of the first contact arrangement 520 is located on a different side of the jack 510 from the second contact arrangement 530. For example, in one implementation, at least a portion of the first contact arrangement 520 is located on an opposite side of the jack 510 from the second contact arrangement 530. In other implementations, however, the contact arrangements 520, 530 can be positioned completely on the same side or completely on different sides of the jack 510.

Each contact arrangement 520, 530 includes one or more contact members 521, 531, respectively. A first portion 522 of the first contact arrangement 520 is configured to electrically connect with the main signal contacts 412 on the plug 402 when the plug 402 is inserted into the socket 515 of the jack module 510 (see FIG. 10). More specifically, inserting the plug 402 into the socket 515 brings the main signal contacts 412 of the plug 402 into physical contact with the contact members 521 at the first portion 522 of the first contact arrangement 520 (see FIG. 11). A first portion 532 of the second contact arrangement 530 is configured to electrically connect to the contacts 434 of the plug storage device 430 when the plug 402 is inserted into the socket 515 of the jack module 510 (see FIG. 10). More specifically, inserting the plug 402 into the socket 515 brings the contacts 434 on the plug storage device 430 into physical contact with the contact members 531 at the first portion 532 of the second contact arrangement 530 (see FIG. 11).

Figure 11:
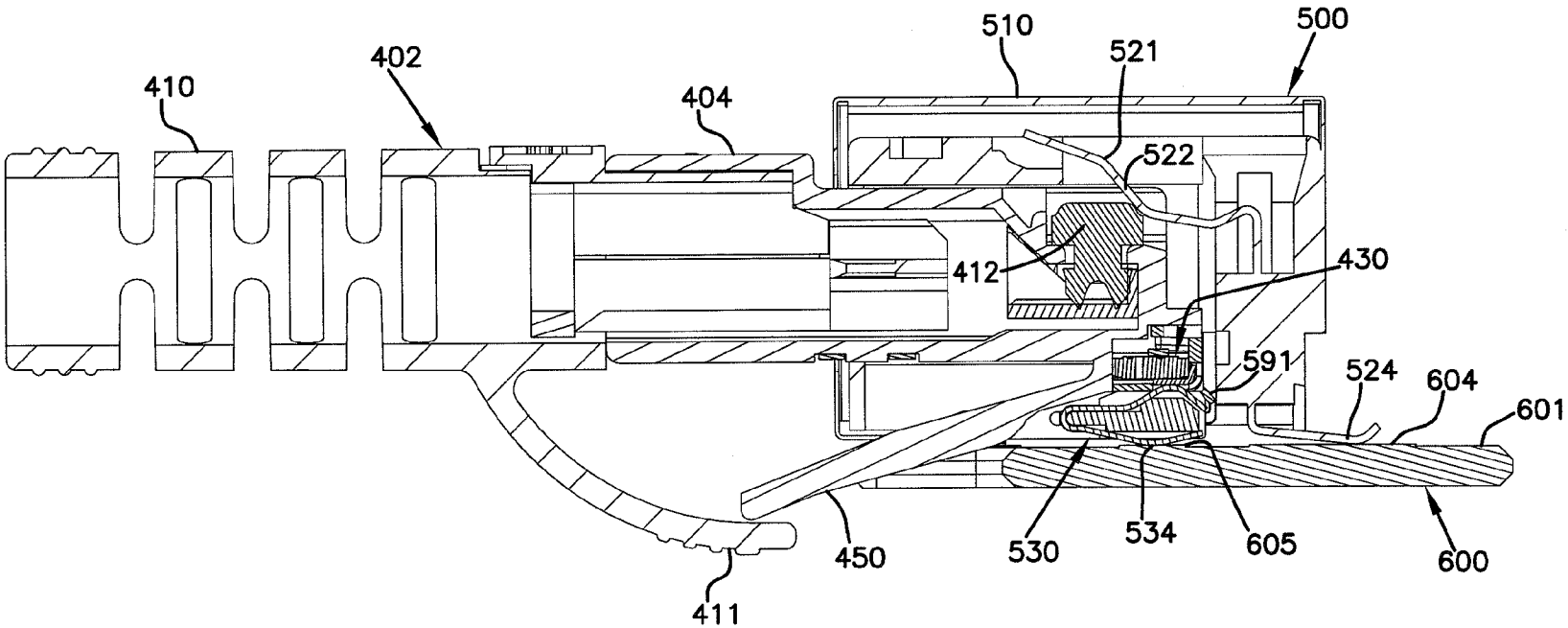
FIG. 11 is a cross-sectional view of the jack module of FIG. 10 taken along a plane defined by an insertion axis of the plug into the jack module.

In some implementations, the circuit board 600 includes second landings 604 (see FIGS. 8 and 9). The second landings 604 are configured to be contacted by a second portion 524 of the first contact arrangement 520 (FIG. 11). The second landings 604 connect the first contact arrangement 520 to a communications network for signal transmission (see FIG. 1). Accordingly, inserting the plug 402 into the socket 515 connects the conductors of the electrical cable 480 to the communications network. In some implementations, the board 600 includes third landings 605 (see FIGS. 8 and 9). The third landings 605 are configured to be contacted by a second portion 534 of the second contact arrangement 530 of the jack module 510 (FIG. 11). The third landings 605 connect the second contact arrangement 530 to a processor of a layer management system, such as programmable processor 206 of FIG. 2. Accordingly, inserting the plug 402 into the socket 515 connects the storage device 430 of the plug 402 to the processor of the management system.

Certain types of jack modules 510 define openings 519 (FIG. 7) through which a connection is made between the plug storage contacts 434 and the second contact arrangement 530. In some implementations, the opening 519 extends through the bottom wall of the jack module 510. In certain implementations, the opening 519 extends between front and rear ends of the jack module 510. In some implementations, guiding structures protrude into the opening 519 from the bottom wall or side walls of the jack module 510.

For example, plug guides 514 extend into the opening 519 toward the front of the jack module 510. The plug guides 514 are located at a position that is inwardly offset from the open port 511 of the jack module 510. The plug guides 514 are shaped to facilitate directing a plug 402 into alignment with the contact arrangements 520, 530 when the plug 402 is inserted into the jack module socket 515. In the example shown, the plug guides 514 ramp upwardly as the plug guides 514 extend into the socket 515. In other implementations, the plug guides 514 may be flat, curved, or otherwise suitably shaped for guiding the plug 402.

Figure 39:
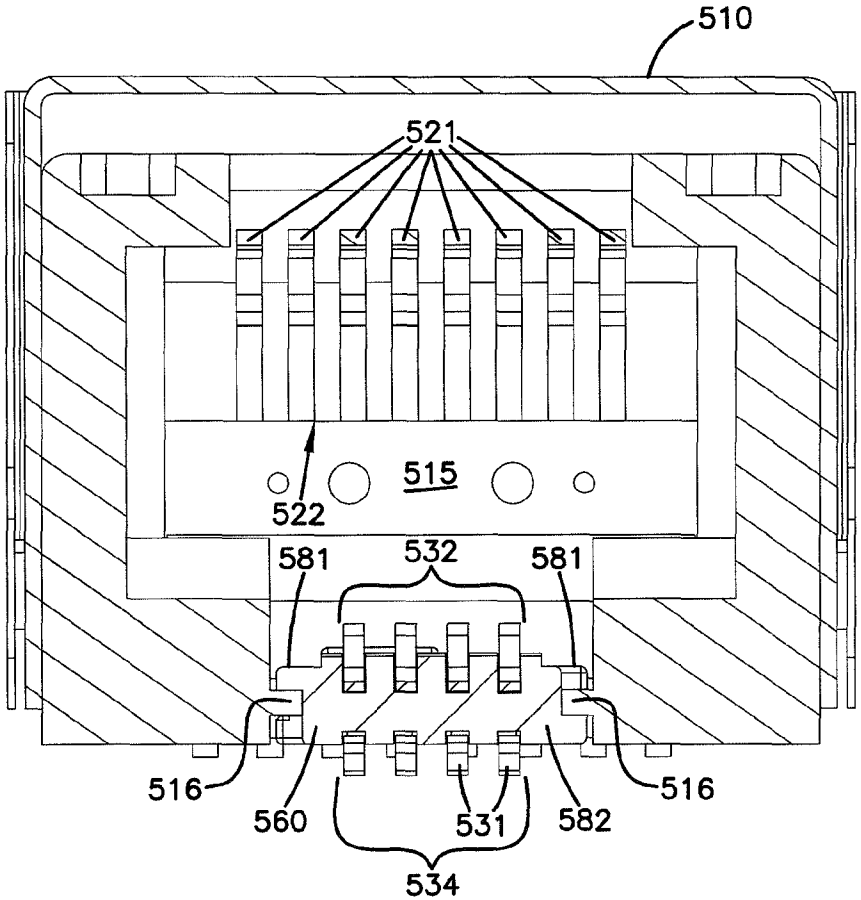
FIG. 39 is a cross-sectional view taken along the 39-39 line of FIG. 38.
Figure 40:
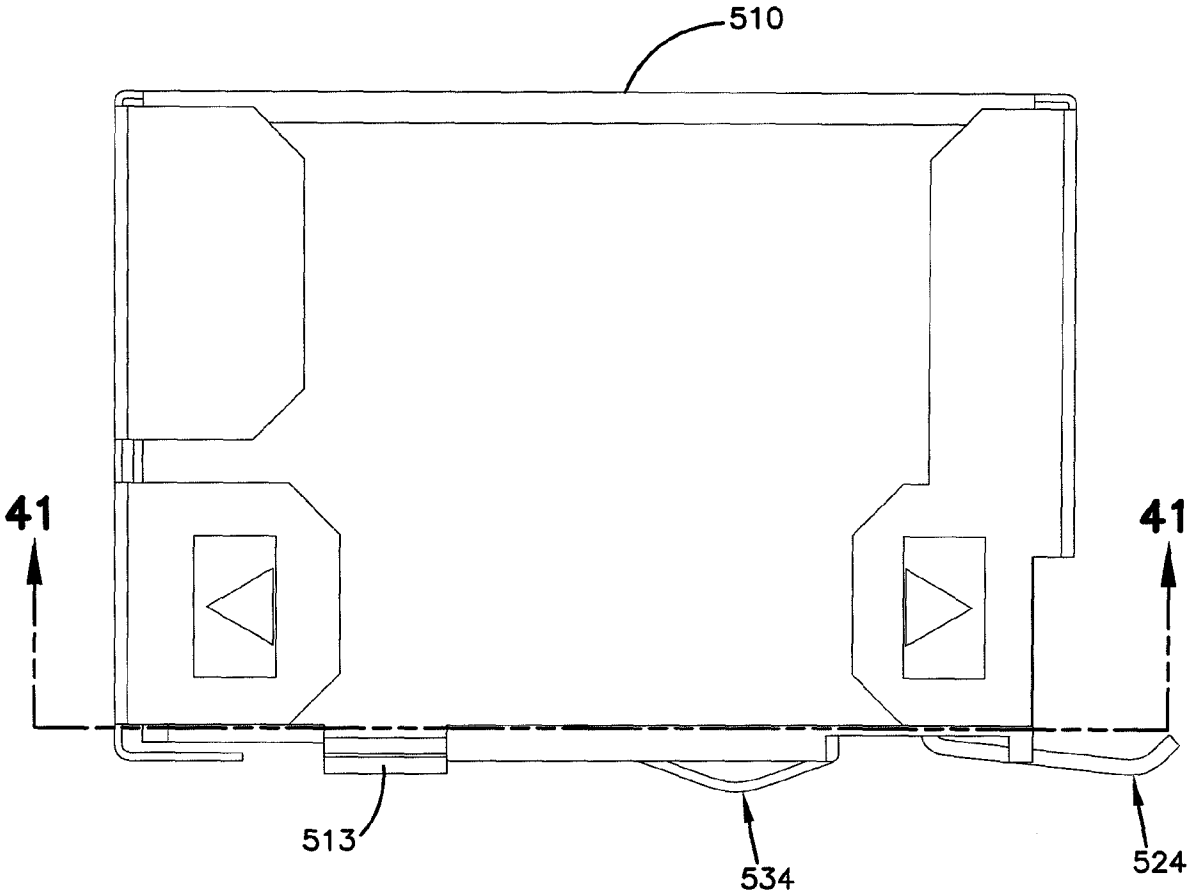
FIG. 40 is a side elevational view of the jack module of FIG. 37.
Figure 41:
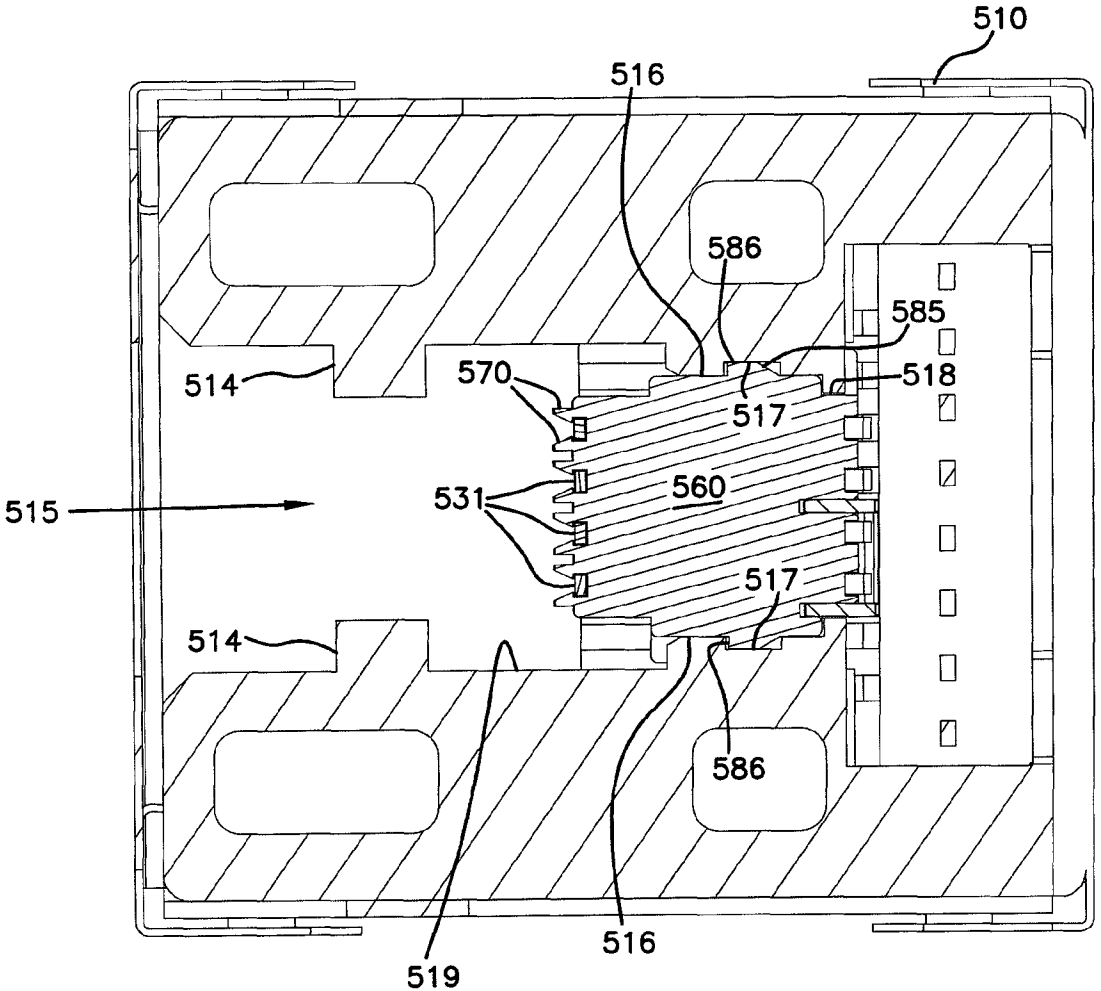
FIG. 41 is a cross-sectional view taken along the 41-41 line of FIG. 40.

In accordance with some aspects, the second contact arrangement 530 mounts to a support body 560 to define a media reading interface 540. The media reading interface 540 is positioned at the opening 519 of the jack 510 and at least a portion of the second contact arrangement 530 extends through the opening 519. In some implementations, the jack modules 510 also include one or more interface guides 516 (FIG. 7) at the opening 519. In the example shown, an interface guide 516 extends into the opening 519 from each side of the bottom surface of the jack module 510 (e.g., see FIGS. 39 and 41). In other implementations, greater or fewer interface guides 516 extend into the opening 519. In the example shown, the interface guides 516 are spaced from the plug guides 514 by about a length of the media reading interface 540. In other implementations, the interface guides 516 may be located closer to or farther away from the plug guides 514.

The guide members 516 are configured to receive and/or support at least a portion of the media reading interface 540. In certain implementations, the interface guides 516 define generally flat top and/or bottom surfaces along which the body of the media reading interface 540 can slide. A front of each interface guide 516 may be ramped to facilitate sliding of the media reading interface 540 rearwardly along the opening 519. In some implementations, the interface guide 516 defines a latching area or notch 517. In the example shown in FIG. 7, the interface guide 516 defines a notch 517 at an intermediate portion along the length of the guide 516. In certain implementations, each interface guide 516 also defines a stop 518 at a rear of the guide 516.

Figure 42:
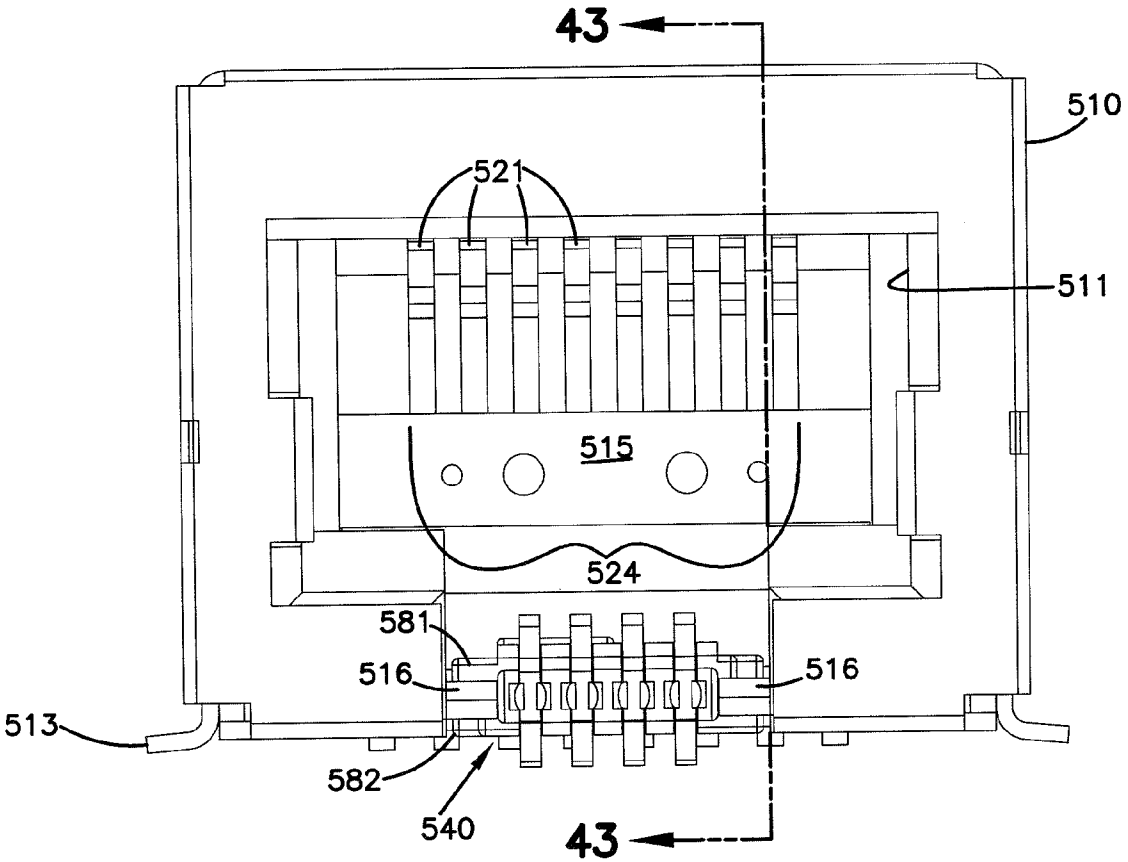
FIG. 42 is a front elevational view of the jack module of FIG. 37.
Figure 43:
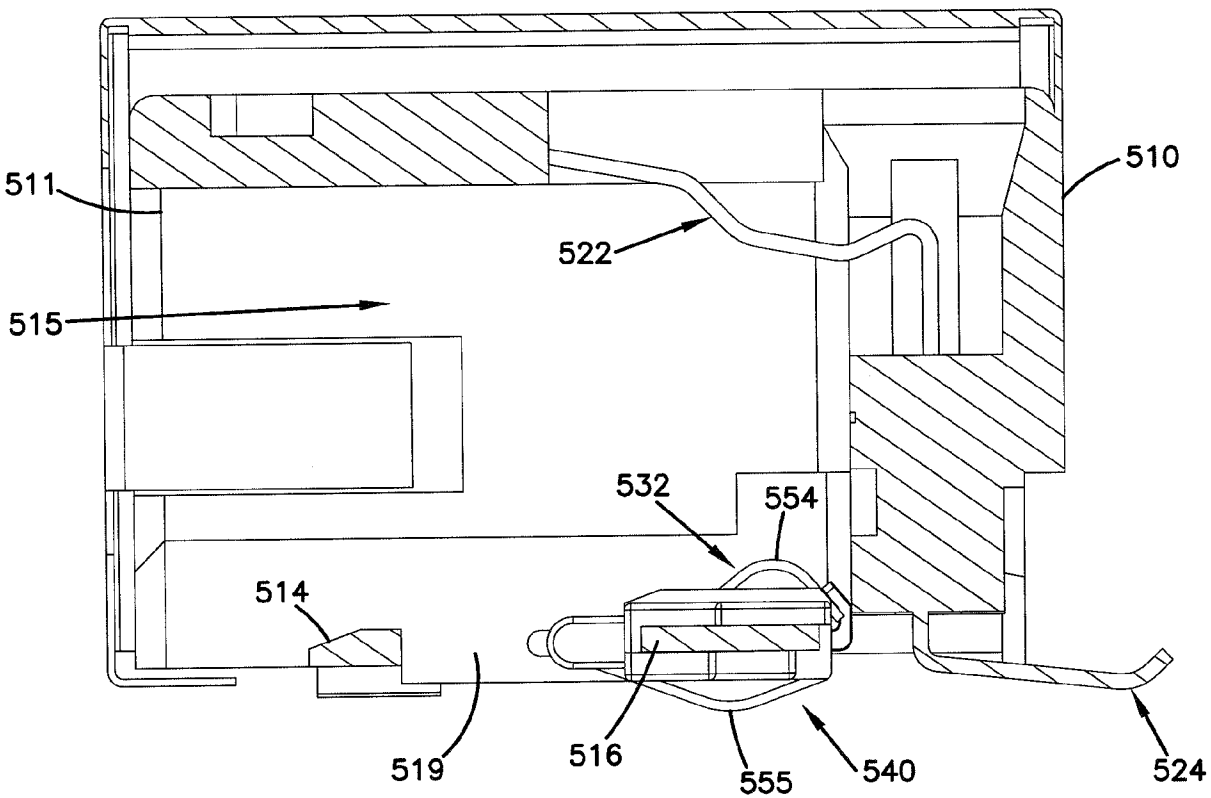
FIG. 43 is a cross-sectional view taken along the 43-43 line of FIG. 42.

In some implementations, the media reading interface 540 mounts within the cavity 515 of the jack module 510 and the second portion 534 of the second contact arrangement 530 extends through the opening 519 to engage the third landings 605 of the circuit board 600. In other implementations, the media reading interface 540 can mount to an exterior of the jack module 510 and the first portion 532 of the second contact arrangement 530 extends through the opening 519 to engage the plug storage contacts 434. In the example shown, the media reading interface 540 mounts to and partially defines a bottom wall of the jack module 510 (e.g., see FIGS. 39, 42, and 43). The first portion 532 of the second contact arrangement 530 extends into the jack socket 515 and the second portion 534 extends external of the jack module housing 510 (see FIG. 43).

FIGS. 12-15 illustrate one example implementation of the media reading interface 540. The media reading interface 540 has a top 542, a bottom 544, a first side 546, and a second side 548. When the media reading interface 540 is installed at the jack housing 510, the top 542 of the interface 540 faces the jack socket 515, the bottom 544 of the interface 540 faces the circuit board 600, the first side 546 faces the open port 511, and the second side 548 faces away from the open port 511 (see FIG. 11). In the example shown in FIG. 15, the first portion 522 of the second contact arrangement 530 is defined at the top 542 of the interface 540 toward the second side 548 and the second portion 534 of the second contact arrangement 530 is defined at the bottom 544 toward the second side 548.

Figure 16:
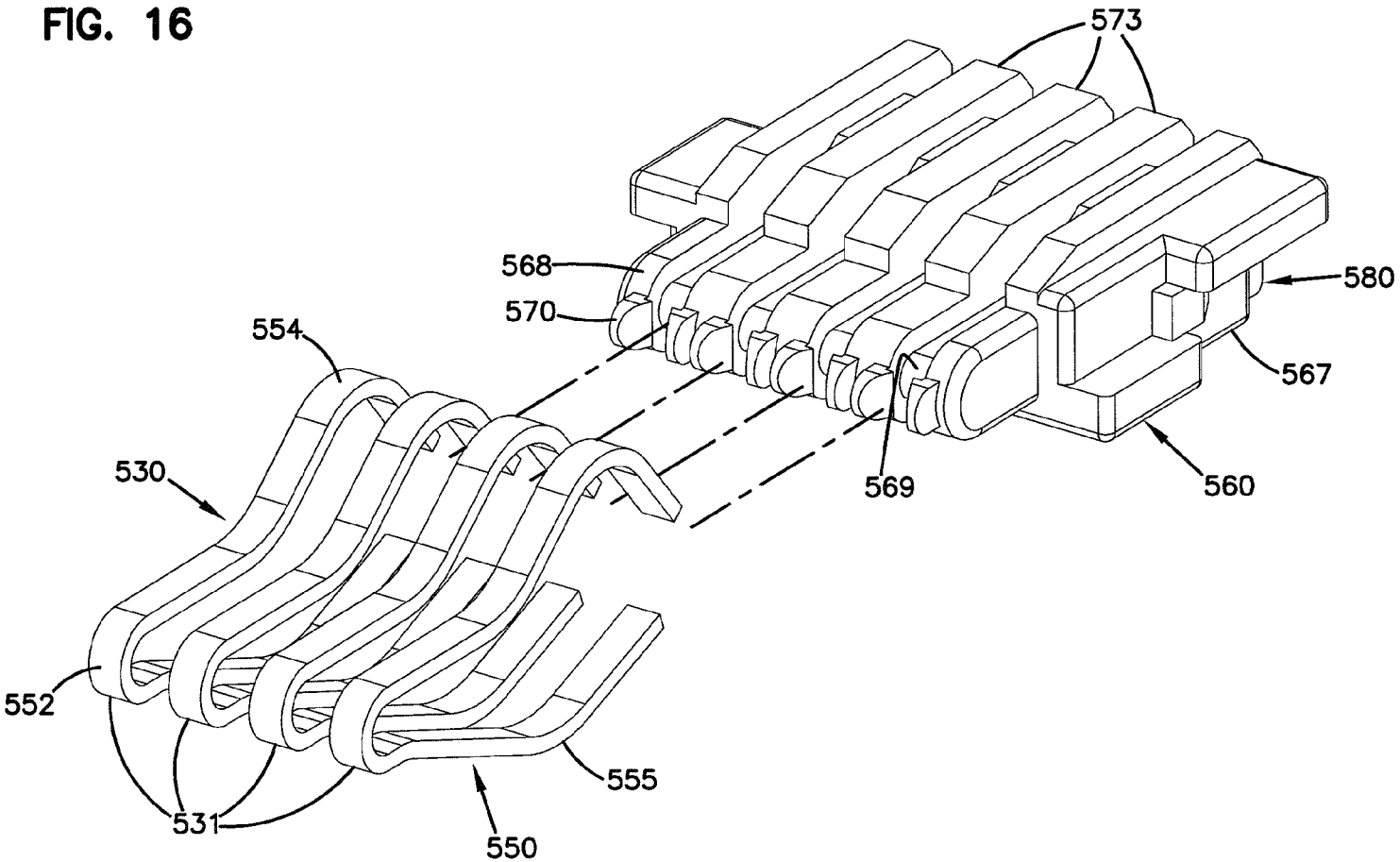
FIG. 16 is a perspective view of the media reading interface of FIGS. 12-15 with the second contact arrangement exploded from the support body.
Figure 17:
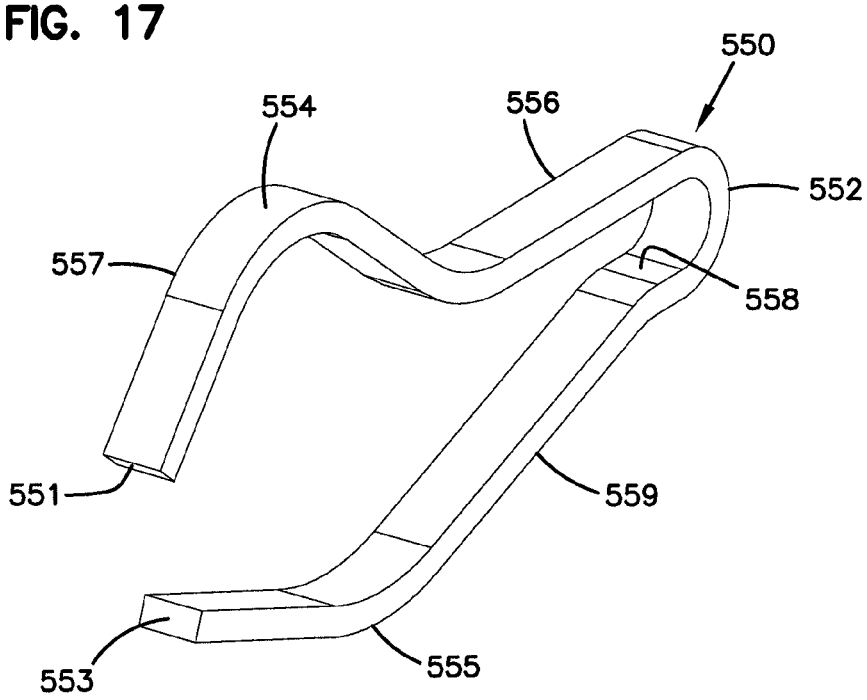
FIGS. 17-20 are perspective views of an example contact member suitable for mounting to a support body to form an example media reading interface in accordance with aspects of the present disclosure.
Figure 18:
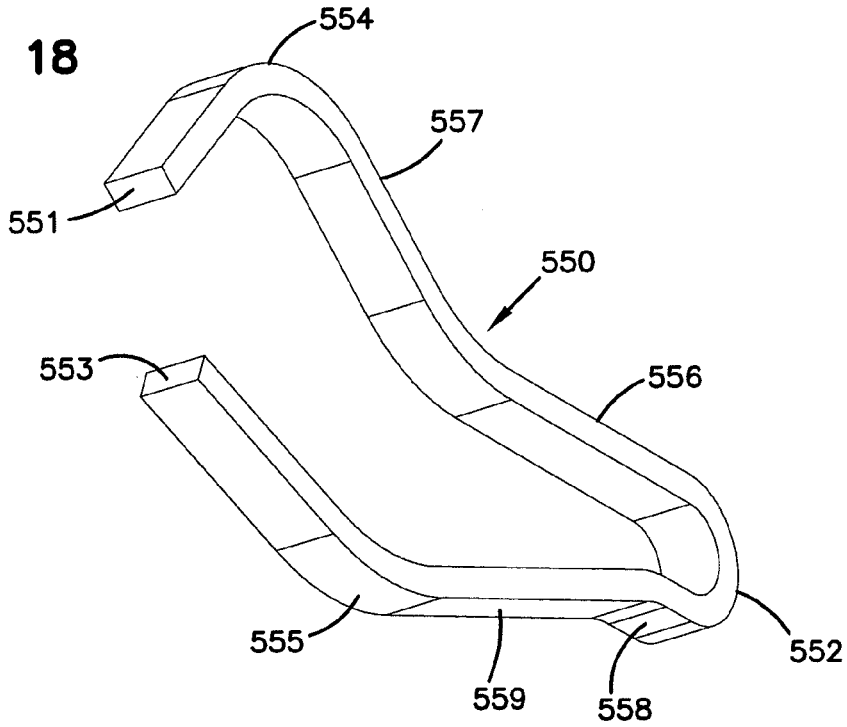
Figure 19:
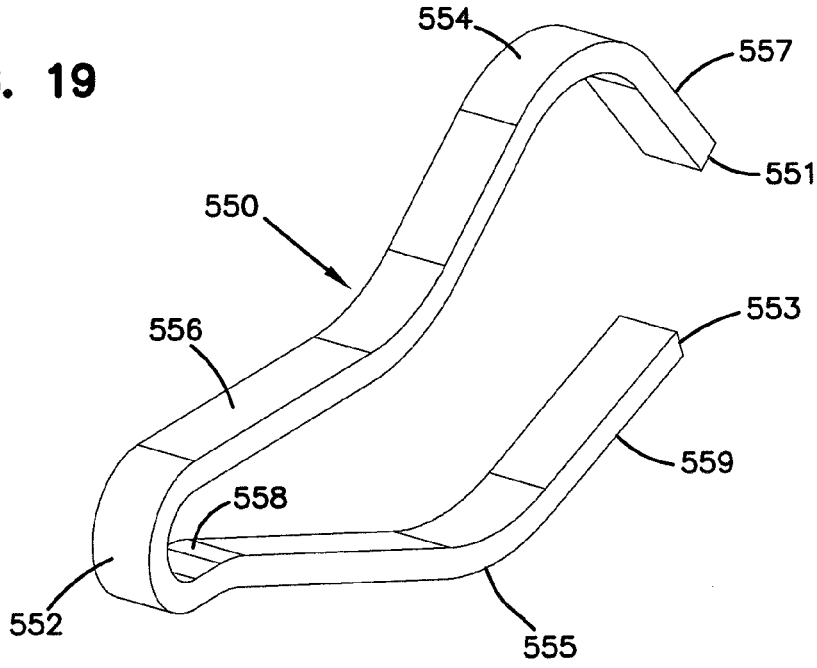
Figure 20:
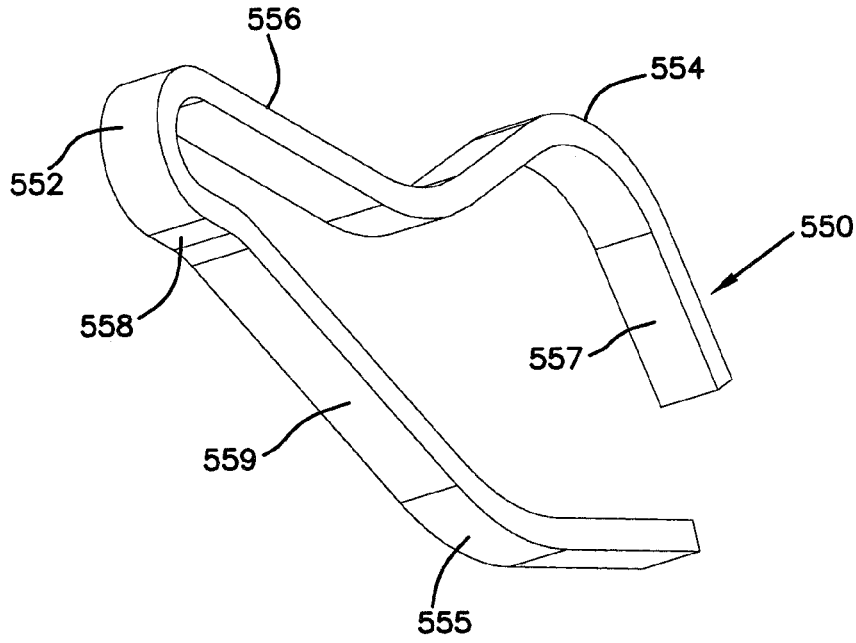

The media reading interface 540 includes one or more contact members 531 positioned on a support body 560 (see FIG. 16). In some implementations, the media reading interface 540 includes four contact members 531 positioned on the support body 560. In the example shown, the four contact members 531 are positioned in parallel on the support body 560. In other implementations, however, greater or fewer contact members 531 may be positioned on the support body 560. For example, in certain implementations, the media reading interface 540 may include a power contact, a grounding contact, and a data contact. In still other implementations, portions of the contact members 531 may extend at angles to each other or cross-over each other.

FIGS. 17-25 illustrate one example contact member 531 including a monolithic (i.e., single-piece) body 550. In some implementations, the example contact member body 550 is formed by bending sheet metal to the proper shape. In other implementations, the example contact member body 550 is formed by laser cutting the proper shape out of metal. In still other implementations, the example contact member body 550 may be formed using deposition, sintering, or other manufacturing techniques. In some implementations, the contact member body 550 is formed from an electrically conductive surface, such as metal. In other implementations, the contact member 550 is formed from an insulating material (e.g., a plastic) having an electrically conductive coating.

The contact member body 550 extends from a first end 551 to a second end 553. The body 550 is folded, bent, or otherwise curved at an intermediate portion 552 to position the ends 551, 553 adjacent each other. In the example shown, the body 550 is curved such that the first end 551 of the body 550 extends directly vertically above the second end 553 (e.g., see FIGS. 22-23). In other implementations, however, the contact member body 550 may be otherwise contoured so that the ends 551, 553 are not vertically aligned.

Figure 15:
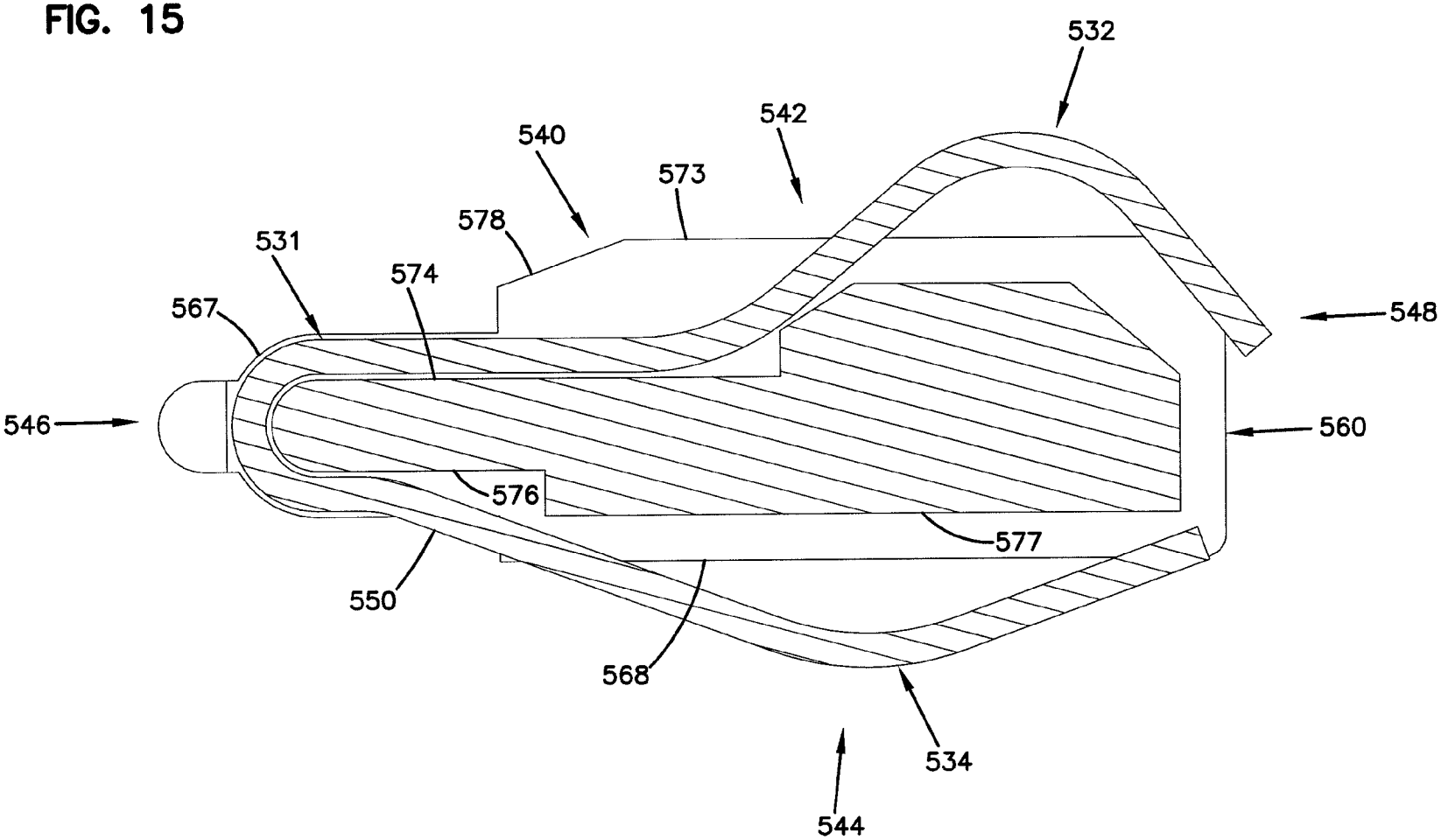
FIG. 15 is a cross-sectional view of the media reading interface taken along the 15-15 line of FIG. 14.

As shown in FIGS. 15 and 16, a first portion of the contact member body 550 extending between the intermediate section 552 and the first end 551 is positioned along the top 542 of the media reading interface 540. A second portion of the contact member body 550 extending between the intermediate section 552 and the second end 553 is positioned along the bottom 544 of the media reading interface 540. The intermediate section 552 of the body 550 extends over the first side 546 of the media reading interface 540. The first portion of the contact member body 550 defines a first contact surface 554 and the second portion of the contact member body 550 defines a second contact surface 555 (see FIG. 21). The first and second contact surfaces 554, 555 form the first and second portions 532, 534 of the second contact arrangement 530.

Figure 21:
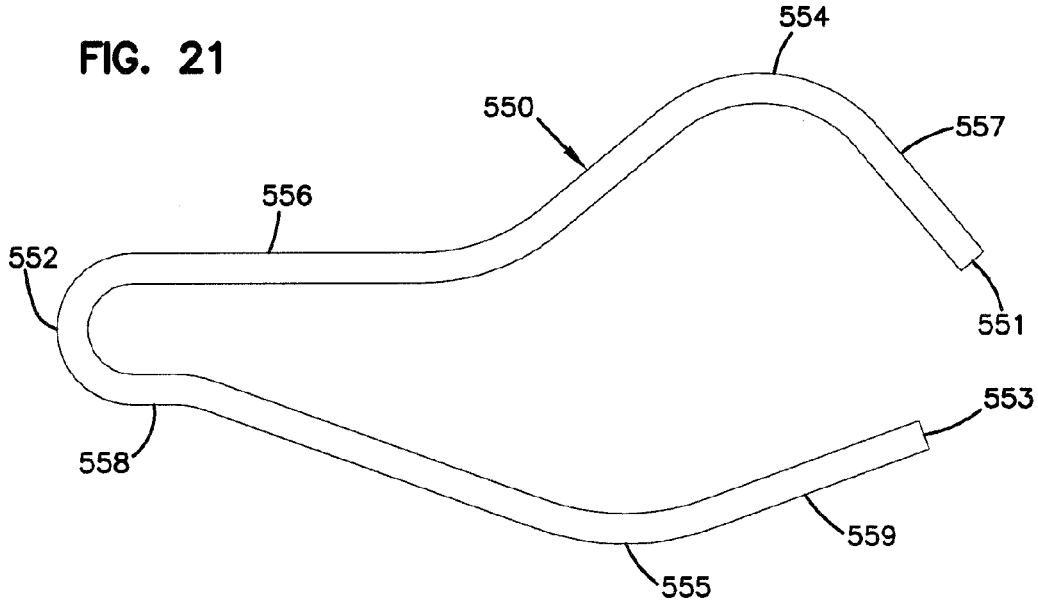
FIG. 21 is a side elevational view of the contact member of FIGS. 17-20.
Figure 22:
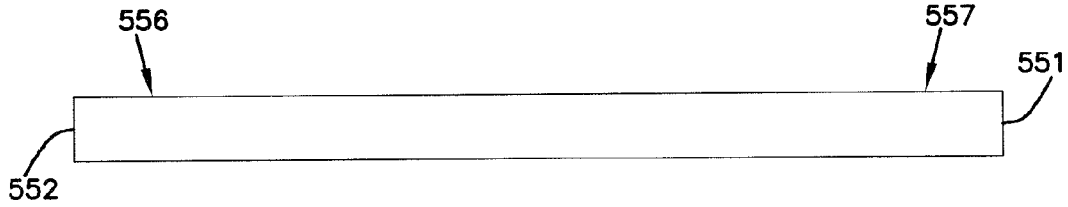
FIGS. 22-23 are top and bottom plan views, respectively, of the contact member of FIGS. 17-20.
Figure 23:
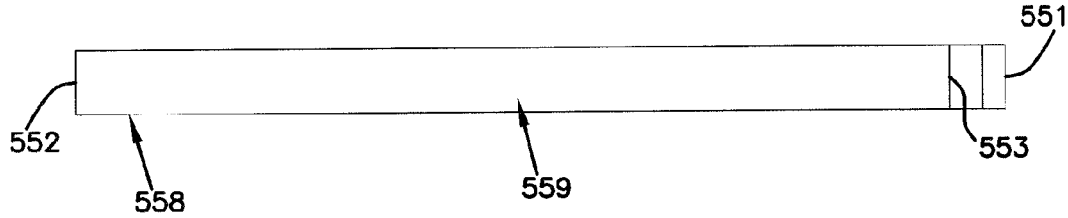
Figure 24:
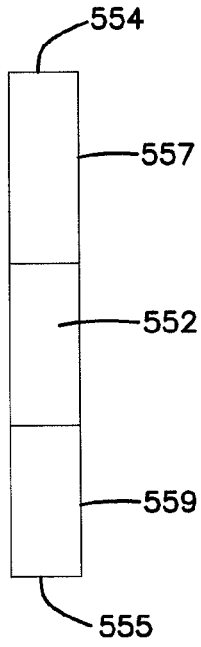
FIGS. 24-25 are rear and front elevational views, respectively, of the contact member of FIGS. 17-20.
Figure 25:
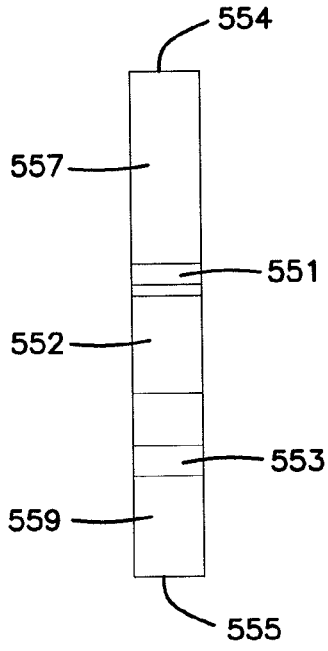
Figure 26:
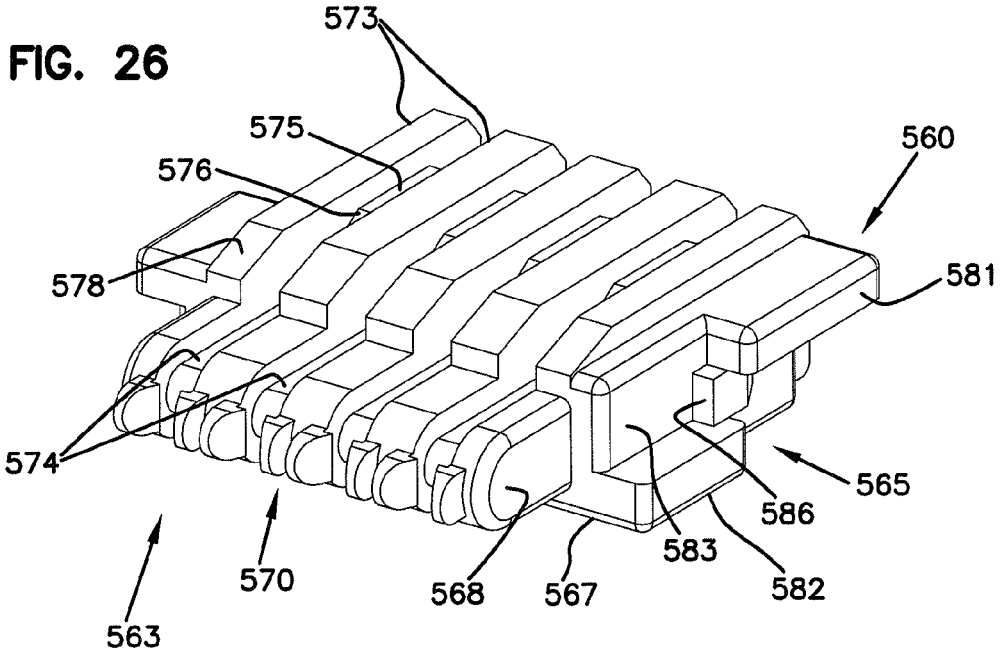
FIGS. 26-29 are perspective views of an example support body on which the contact members of FIGS. 17-20 can be mounted to form the media reading interface of FIGS. 12-13 in accordance with aspects of the present disclosure.

In some implementations, each portion of the contact member body 550 includes a base section 556, 558 and a contact section 557, 559, respectively. For example, as shown in FIG. 21, the first portion of the body 550 includes a first base 556 extending from the intermediate section 552 and a first contact section 557 extending between the first base 556 and the first end 551. The second portion of the body 550 includes a second base 558 extending from the intermediate section 552 and a second contact section 559 extending between the second base 558 and the second end 553.

The base sections 556, 558 extend generally parallel to each other. In some implementations, the first base section 556 is longer than the second base section 558. For example, in certain implementations, the first base section 556 extends along about half a length of the contact member body 550 and the second base section 558 extends along substantially less than half of the length of the body 550 (e.g., see FIG. 21). In other implementations, however, the first base section 556 may be the same length as or shorter than the second base section 558.

The first contact surface 554 is defined on the first contact section 557 of the body 550 and the second contact surface 555 is defined on the second contact section 559 of the body 550. In some implementations, at least portions of the contact sections 557, 559 contour away from each other (see FIG. 21). In the example shown, the first contact section 557 contours farther outwardly from the first base section 556 than the second contact section 559 contours outwardly from the second base section 558 (see FIG. 21). For example, the first contact section 557 may contour farther outwardly, but over a shorter length than the second contact section 559. In other implementations, however, the contact sections 557, 559 may contour outwardly the same distance and/or over the same length of the contact member body 550.

In certain implementations, each contact section 557, 559 defines a flexible spring member. For example, in one implementation, each contact section 557, 559 defines an arch-shaped spring that flexes via movement of the respective end 551, 553. The first contact surface 554 may be formed at a peak of the arch-shaped spring section 557 and the second contact surface 555 may be formed at a trough of the arch-shaped spring section 559. In other implementations, each of the spring members 557, 559 may define a U-shape, a C-shape, a J-shape, an L-shape, a rolled shape, or any other suitable shape. In still other implementations, the first and second contact surfaces 554, 555 may be formed on the base sections 556, 558.

FIGS. 26-35 illustrate one example support body 560 on which the contact members 531 of the second contact arrangement 530 mount to form a media reading interface 540. The example support body 560 has a top 561, a bottom 562, a first end 563, a second end 564, a first side 565, and a second side 566 (see FIGS. 30-33). The support body 560 includes a first section 567 at the first end 563 and a second section 568 at the second end 564. Mounting arrangements 580 are located on the first and second sides 565, 566 of the support body 560, as will be described in more detail herein.

Both sections 567, 568 of the support body 560 define channels 569 at which the contact members 531 can be installed. The channels 569 are defined on the support body 560 to facilitate aligning and securing the contact members 531 to the support body 560. In the example shown, the support body 560 defines four channels 561 in which four contact members 531 are mounted. In other implementations, however, the support body 560 can define a greater or lesser number of channels 569. In general, the number of channels 569 corresponds with the number of contact members 531 in the second contact arrangement 530. In the example shown, the channels 569 extend generally parallel to each other. In other implementations, the channels 569 may extend at an angle to each other.

In some implementations, the channels 569 wrap around multiple sides of the support body 560. For example, in the implementation shown, each channel 569 extends from the first end 563 of the support body 560, over the top 561 of the support body 560, around the second end 564, along the bottom 562, and back toward the first end 563 of the support body 560 (see FIGS. 26-29). In various other implementations, the channels 569 may extend over the first end 563 of the support body 560, along sides 565, 566 of the support body, or in other directions along the support body 560. In still other implementations, each side of the support body 560 over which the contact members 531 extend defines a separate set of channels 569 (i.e., the channels 569 on one side of the body 560 are not continuous with the channels 569 on another side).

Figure 12:
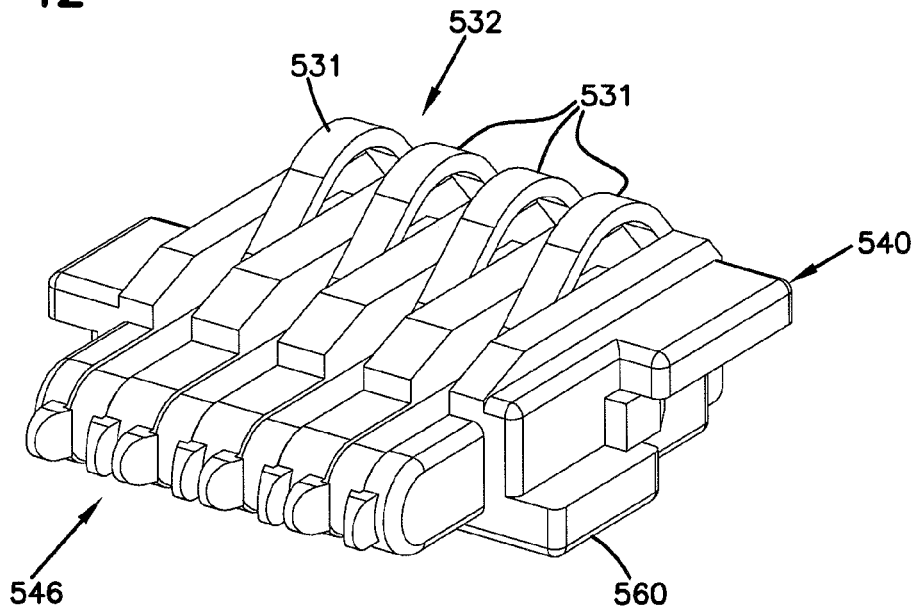
FIGS. 12 and 13 are perspective views of an example media reading interface including a second contact arrangement mounted to a support body in accordance with aspects of the present disclosure.
Figure 13:
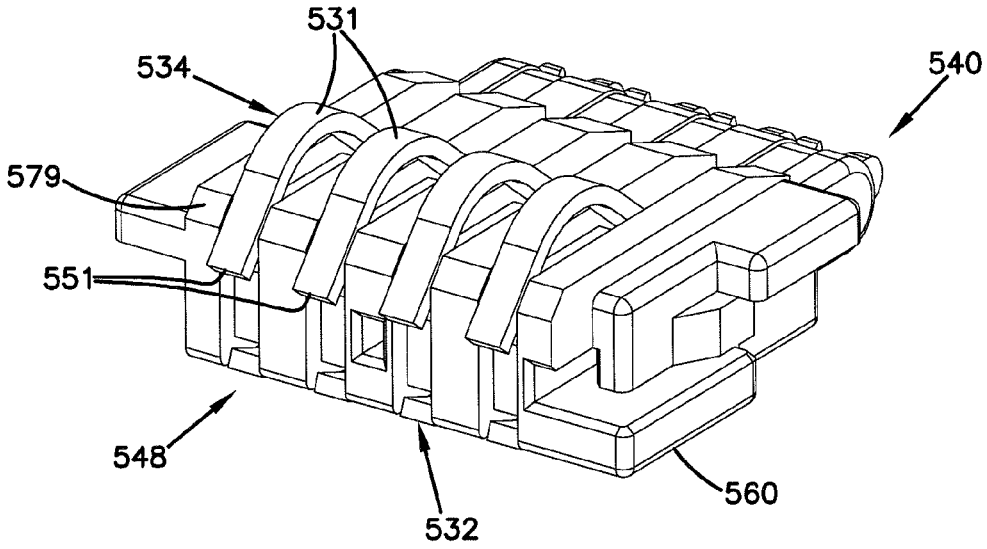
Figure 14:
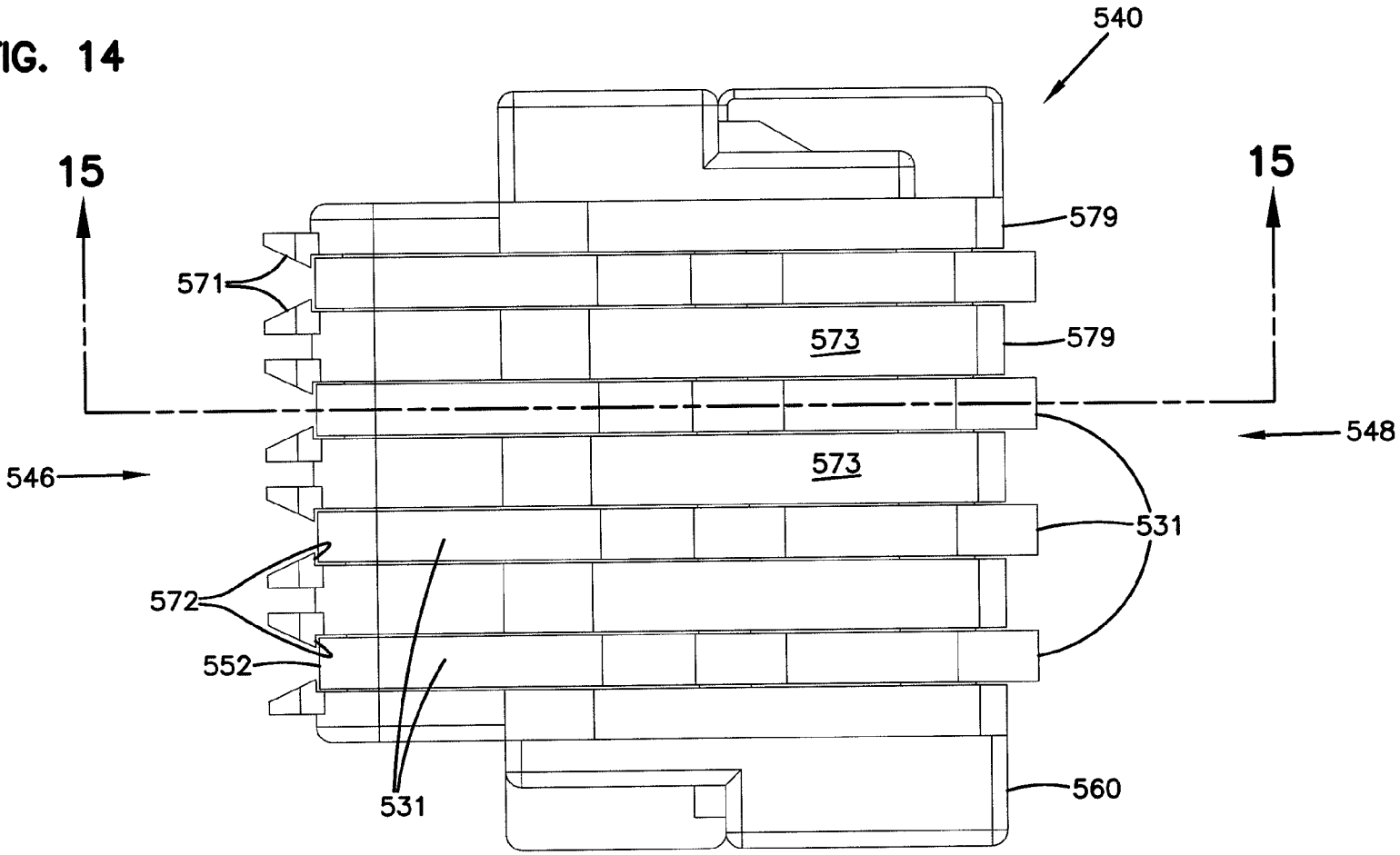
FIG. 14 is a top plan view of the media reading interface of FIGS. 12 and 13.

The second section 568 defines a curved or contoured surface at the first end 563 of the support body 560. As shown in FIGS. 12 and 16, the bent or contoured intermediate section 552 of each contact member body 550 seats in one of the channels 569 on the contoured section of the second section 568 of the support body 560. In some implementations, the support body 560 includes securing members 570 at the first end 563 thereof. The securing members 570 extend outwardly from the second end 563 of the support body 560 on either side of each channel 569.

Each securing member 570 includes a ramped surface 571 that directs the intermediate section 552 of each contact member 531 toward the respective channel 569. In some implementations, the securing members 570 define ramped surfaces 571 on opposite sides of each channel 569. The ramped surfaces 571 converge as the surfaces 571 extend toward the channel 569. Each securing member 570 also defines a shoulder 572 (FIG. 32) facing the channel 569. The intermediate section 552 of each contact member 531 latches (e.g., snap-fits) behind the shoulder 572 when installed on the support body 560 (e.g., see FIG. 14).

In some implementations, a single securing member 570 is positioned between two adjacent channels 569. Each securing member 570 defines two ramp surfaces 571 and two shoulders 572 (e.g., one facing toward each side of the support body 565, 566). In other implementations, two securing members 570 are positioned around each channel 569 with each securing member 570 being associated with only one channel 569. Each securing member 570 defines a single ramp surface 571 and a single shoulder 572 (e.g., see FIGS. 32-33).

Ribs 573 extend outwardly from the top and bottom 561, 562 of the first section 567 of the support body 560 to further define the channels 569. The ribs 573 are positioned between the channels 569 on the first section 567. In certain implementations, the first section 567 also includes raised ribs 573 bordering the outermost channels 569 (e.g., see FIG. 26). In certain implementations, each of the ribs 573 of the support body 560 define forward ramped surfaces 578 and rearward ramped surfaces 579 (see FIGS. 28-31). In some implementations, the ribs 573 are located only on the first section 567 of the support body 560. In other implementations, however, ribs can be formed on the top and/or bottom 561, 562 the second section 568 of the support body 560.

The first and second portions of the contact member body 550 extend along the channels 569 between the ribs 573. Distal ends 551, 553 of the contact members 531 extend partially over the second side 564 of the support body 560 (see FIG. 15). When pressure is applied to one or both contact surfaces 554, 555 of the contact members 531, the distal ends 551, 553 of the contact members 531 move vertically toward the support body 561 and horizontally away from the second end 564 of the support body 560.

The base section 556, 558 of each contact body portion extends at least partially over the second section 558 of the support body 560 toward the second end 564 of the support body 560. In one example, the first base section 556 also extends over at least a portion of the first section 567, whereas the second base section 558 extends over only the second section 568 (see FIG. 15). The spring section 557, 559 of each body portion extends at least partially over the first section 567 of the support body 560 between the ribs 573.

In some implementations, the contact members 557, 559 of the contact members 531 bow outwardly from the support body 560. In some implementations, the contact members 557, 559 are rigidly formed. In other implementations, the contact members 557, 559 form contact springs as described above. For example, the bowed portions of the contact members 557, 559 can flex toward the support body 560 and the distal ends 551, 553 of the contact member bodies 550 can flex away from the second side 564 of the support body 560 when contacts from the plug storage device 430 and/or the printed circuit board 460 press against the contact surfaces 554, 555, respectively.

In some implementations, the channel 569 extending across the top 561 of the support body 560 has a first section 574 and a second section 575. The second section 575 is raised above (i.e., extends outwardly from) the first section 574 relative to the support body 560. In some implementations, the first section 574 of the channel 569 ramps up to the second section 575 of the channel 569. In other implementations, the second section 575 is stepped up from the first section 574. In the example shown in FIG. 15, the second section 575 steps and ramps up from the first section 574.

The channel 569 extend across the bottom 562 of the support body 560 has a first section 576 and a second section 577. The second section 577 is raised above (i.e., extends outwardly from) the first section 576 relative to the support body 560. In some implementations, the first section 576 ramps up to the second section 577. In other implementations, the second section 577 is stepped up from the first section 576. In other implementations, the second section 576 curves or otherwise contours up to the second section 577.

The first base section 556 of each contact member 531 extends along the first section 574 at the top of one of the channels 569 and the second base section 558 of each contact member 531 extends along the first section 576 at the bottom of one of the channels 569. The first contact section 557 of each contact member 531 extends along the second section 575 at the top of the respective channel 569 and the second contact section 559 of each contact member 531 extends along the second section 577 at the bottom of the respective channel 569. The first ends 551 of each contact member 531 extends over the second end 564 of the support body 560.

The support body 560 also includes a mounting arrangement 580 located on the opposite sides 565, 566 of the support body 560 to secure the support body 560 to the jack module 510 or other connector assembly (e.g., a patch panel). In the example shown, each mounting arrangement 580 includes a first guide 581 and a second guide 582 defining a channel 583 therebetween. The guide members 581, 582 and channels 583 extend between the first and second ends 563, 564 of the support body 560. The guide members 581, 582 are configured to slide over the top and bottom surfaces of the interface guides 516 of the jack module 510 to mount the media reading interface 540 to the jack module 510. More specifically, the interface guides 516 on the jack module 510 are configured to slide within the channels 583 between the first and second guides 581, 582 to retain the media reading interface 540 at the jack module 510.

Figure 27:
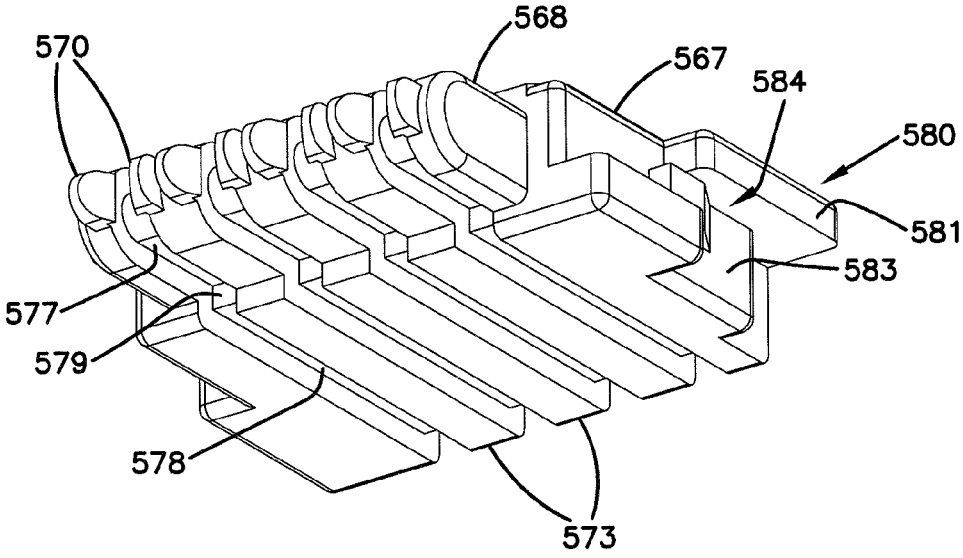
Figure 28:
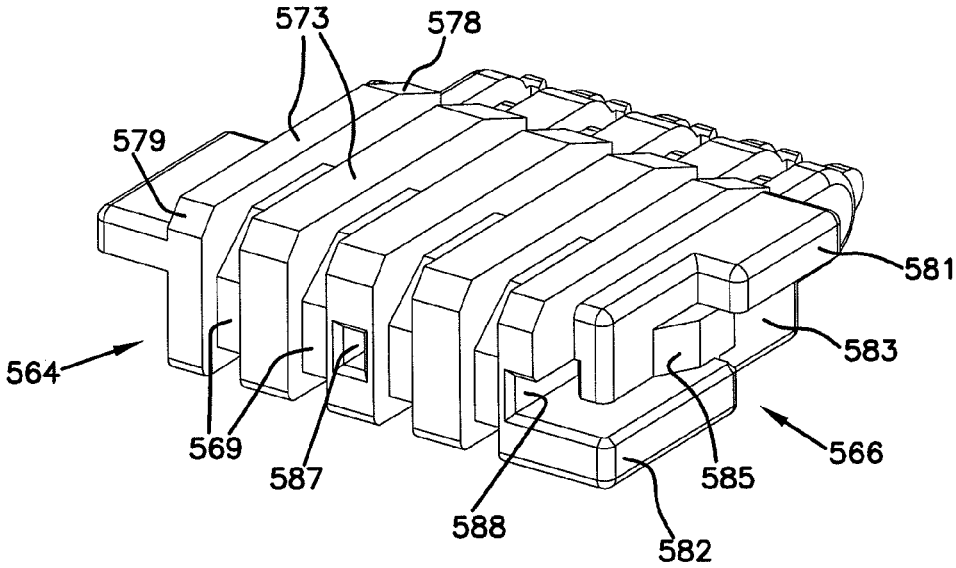
Figure 29:
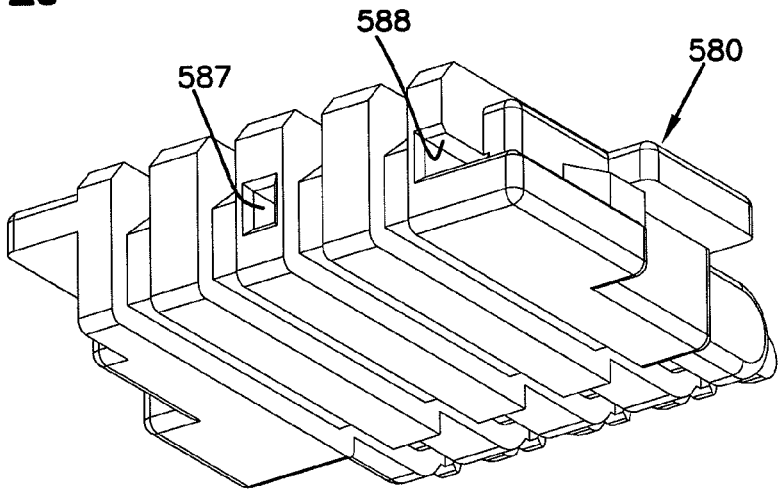
Figure 31:
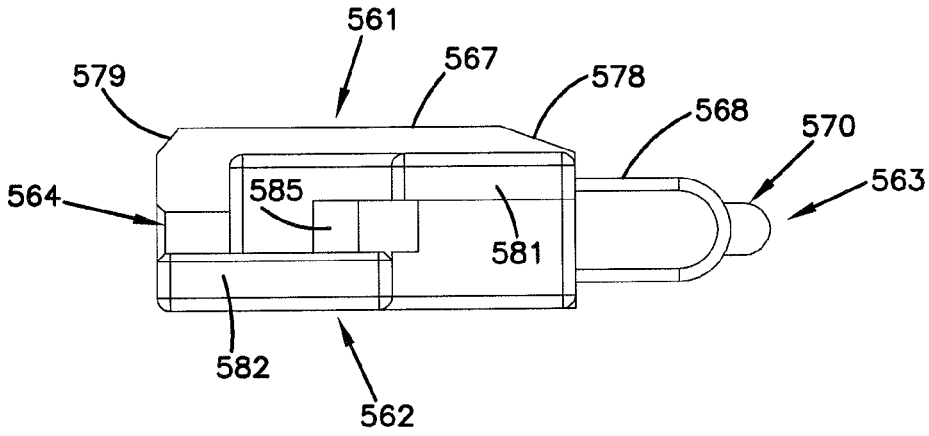
FIGS. 30-31 are side elevational views of the support body of FIGS. 26-29.
Figure 30:
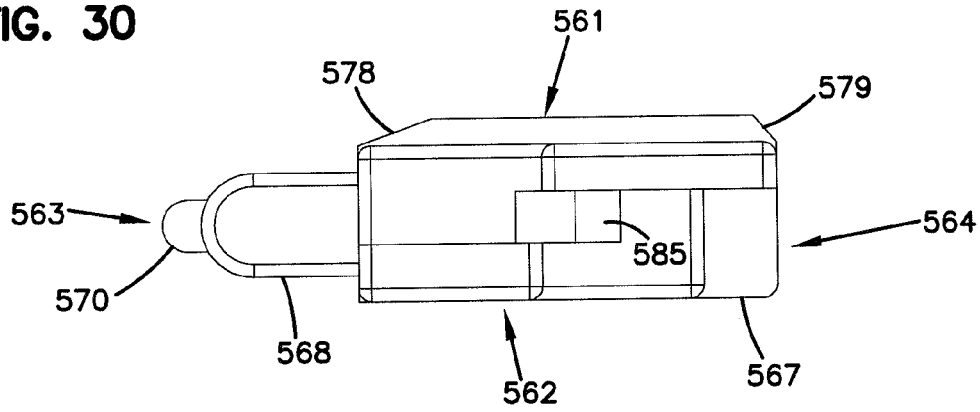
Figure 32:
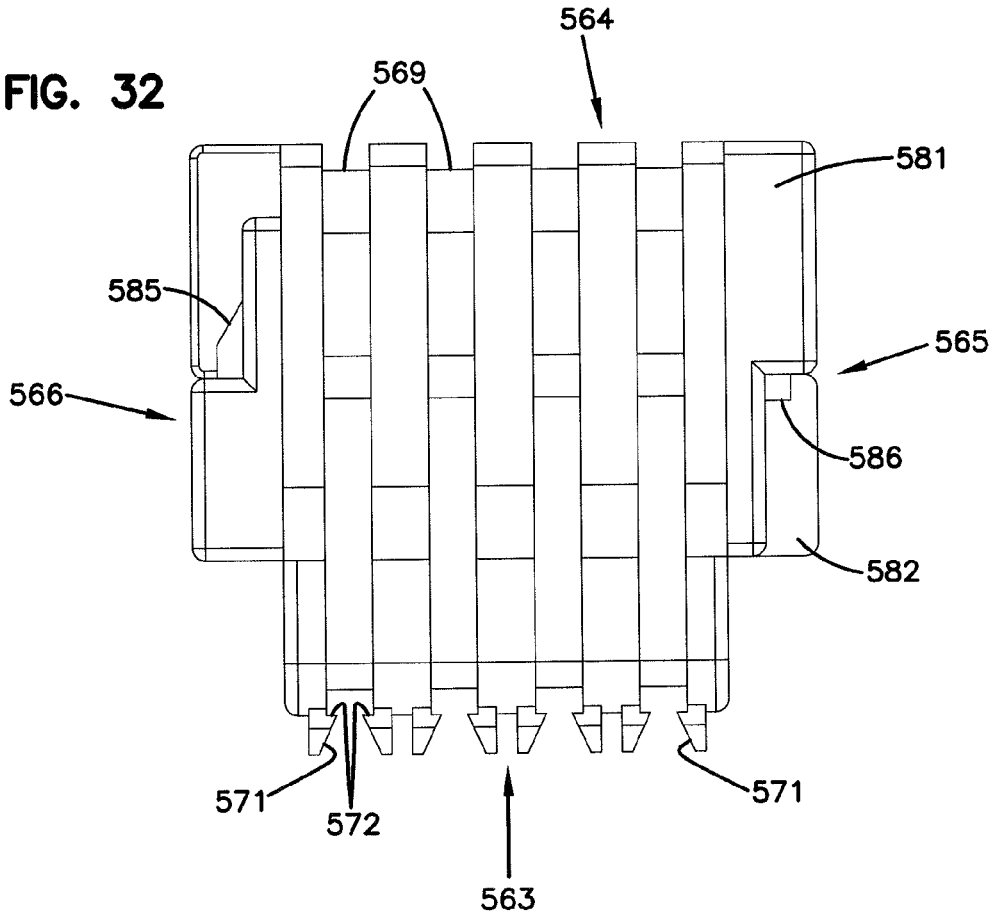
FIGS. 32-33 are top and bottom plan views of the support body of FIGS. 26-29.
Figure 33:
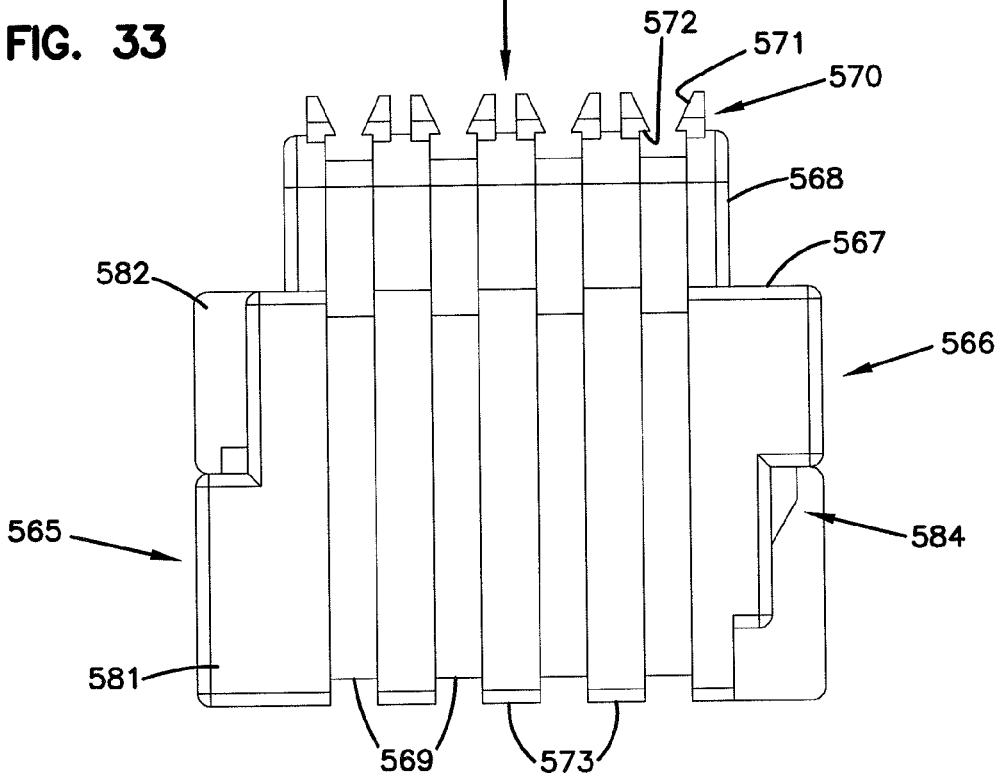
Figure 34:
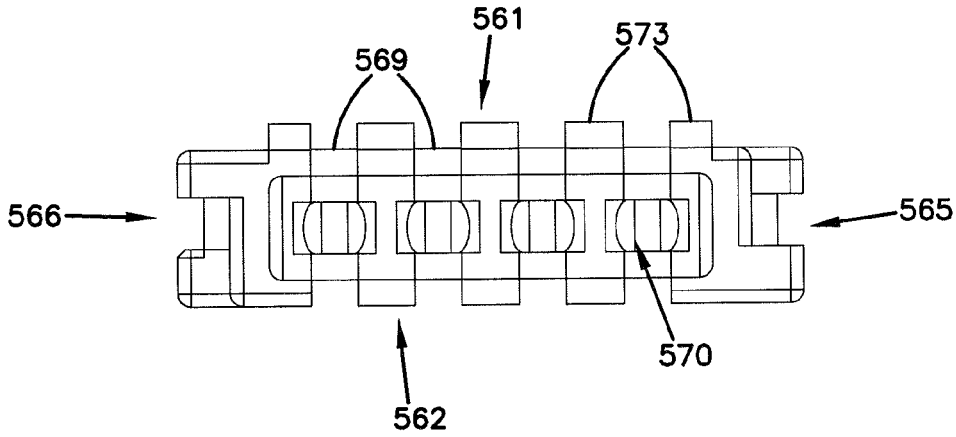
FIGS. 34-35 are front and rear elevational views of the support body of FIGS. 26-29.
Figure 35:
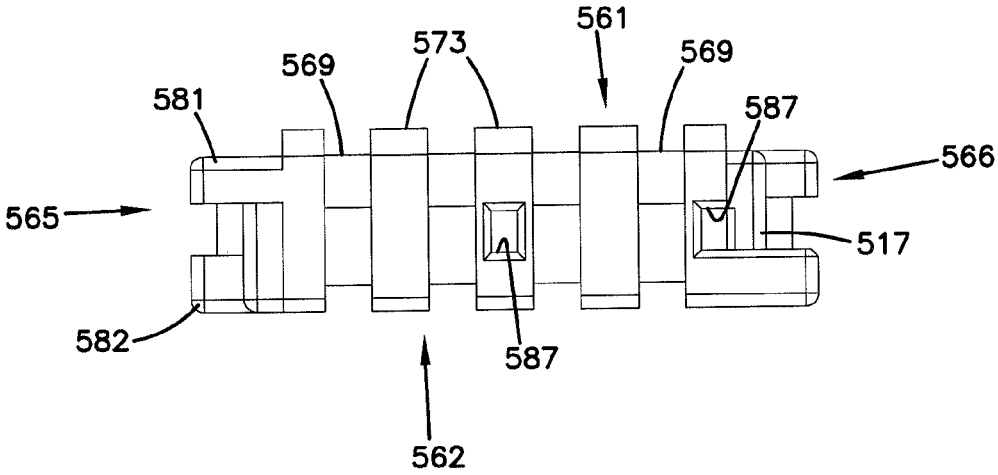

In some implementations, the mounting arrangements 580 include securement arrangements 584 (FIG. 27). One example securement arrangement 584 includes a ramp 585 (FIG. 28) and a shoulder 586 (FIG. 26) positioned within each channel 583. The ramp 585 faces one direction and the shoulder 586 faces in the opposite direction. In the example shown, the ramp 585 faces toward the second side 564 of the support body 560 and the shoulder 586 faces toward the first side 563 of the support body 560. The ramps 585 cam against the ramped surfaces at the front of the interface guides 516 to aid in sliding the interface 540 over the guides 516. Each securement arrangement 584 snaps into the notch 517 defined in the respective interface guide 516. Each shoulder 586 abuts against the notched surface 517 of one of the interface guides 516 to secure the media reading interface 540 to the guides 516.

Figure 36:
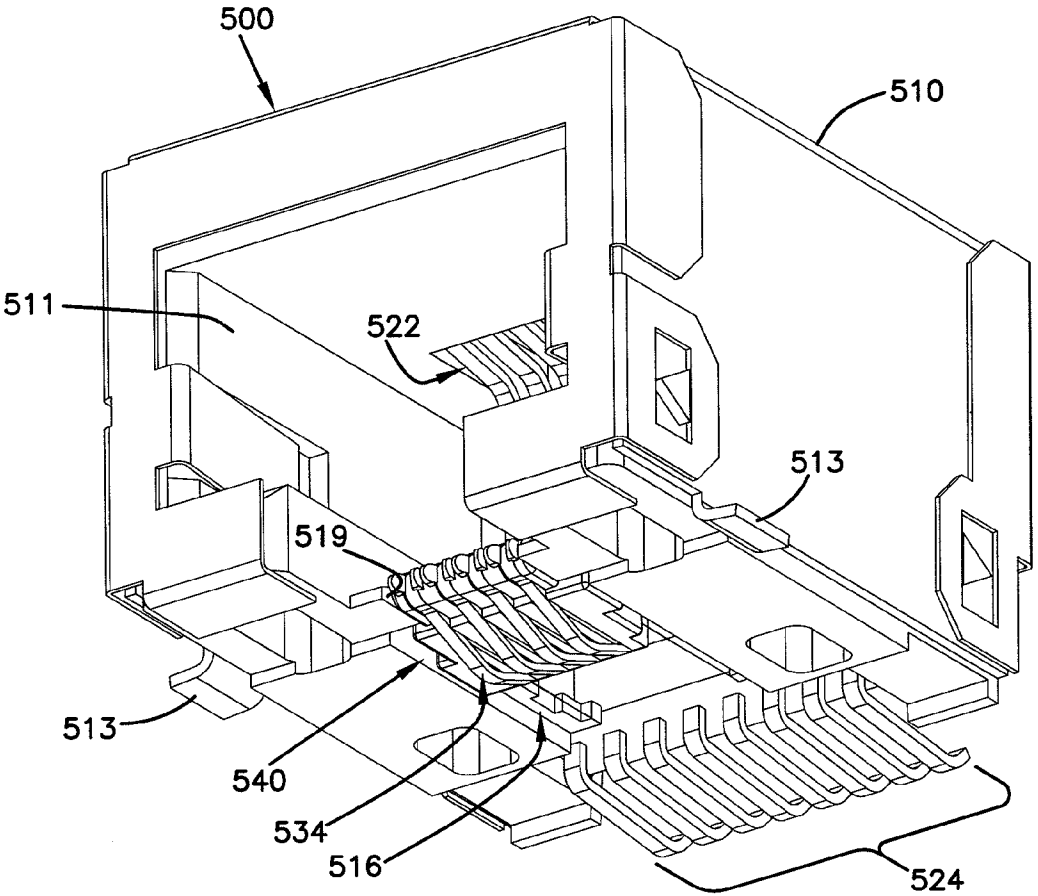
FIG. 36 is a front, bottom perspective view of an example jack module with an example media reading interface being installed thereon in accordance with aspects of the present disclosure.
Figure 37:
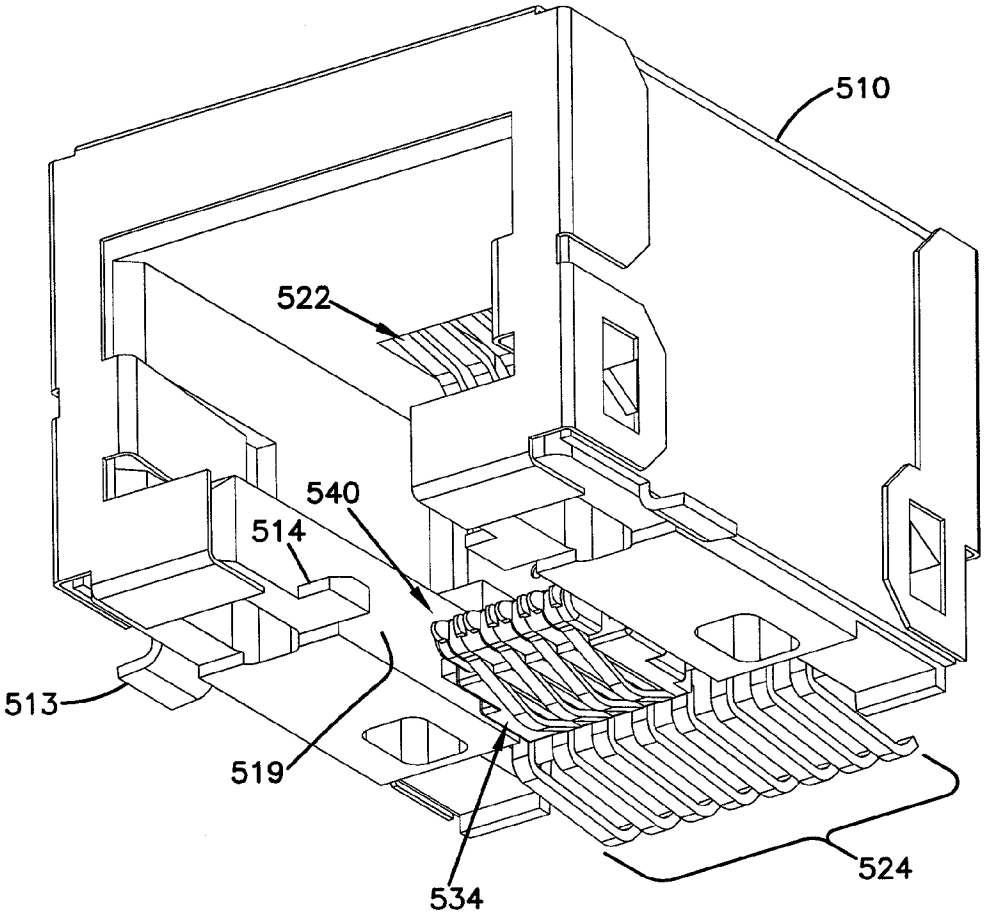
FIG. 37 shows the jack module of FIG. 36 with the media reading interface installed thereon in accordance with aspects of the present disclosure.
Figure 38:
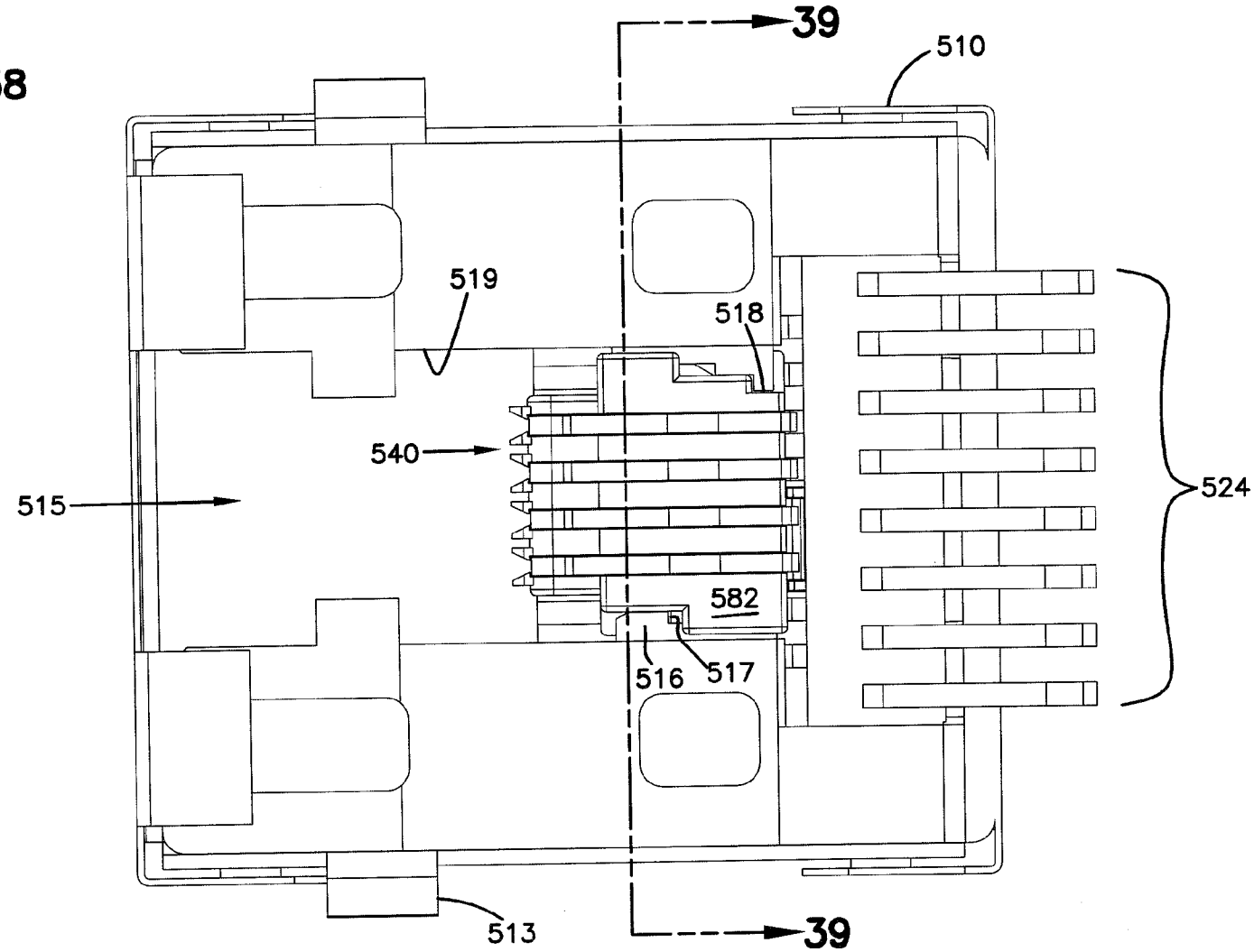
FIG. 38 is a bottom plan view of the jack module of FIG. 37.

FIGS. 36 and 37 show one example media reading interface 540 being installed on one example jack module 510. As shown in FIG. 36, in some implementations, the media reading interface 540 may be inserted into the opening 519 defined in the bottom of the jack module 510 at a position forward of the interface guides 516. For example, in one implementation, the first end 563 of the support body 560 of the media reading interface 540 is aligned with the plug guides 514 (see FIGS. 36 and 37). The support body 560 is pushed rearwardly along the opening 519 to position the media reading interface 540 within the jack module 510.

In some implementations, the ramp 585 of each securement arrangement 584 passes (e.g., cams) over an inward edge of one of the guides 516 and snaps into the respective latching area 517. In other implementations, the interface guide 516 flex outwardly to cam over the ramp 585 and the latching surface 517 of the guide 516 snaps behind the shoulder 586 of the securement arrangement 584 to lock the support body 560 into position on the jack module 510. FIGS. 38-43 show various views of the jack module 510 with the media reading interface 540 in the rearward, latched position within the opening 519 in the jack module 510.

Figure 45:
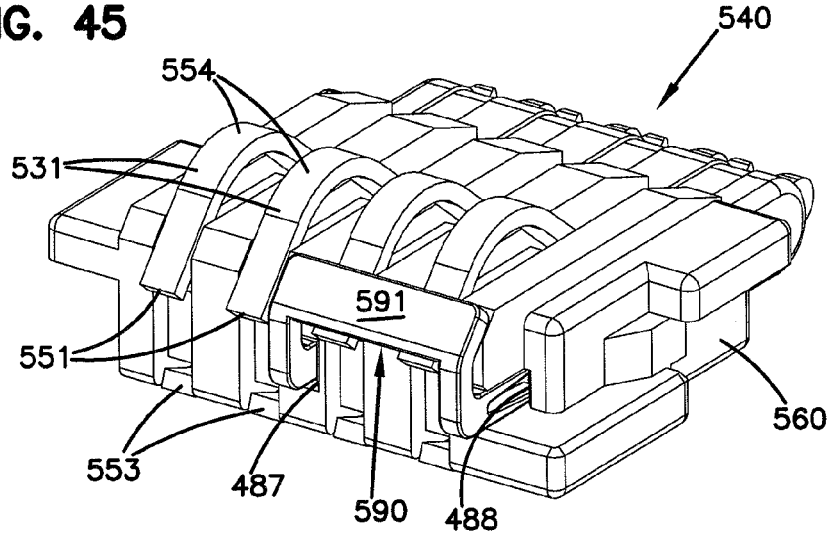
FIGS. 44-45 are perspective views showing one example media reading interface with a presence sensing member installed thereon in accordance with aspects of the present disclosure.
Figure 44:
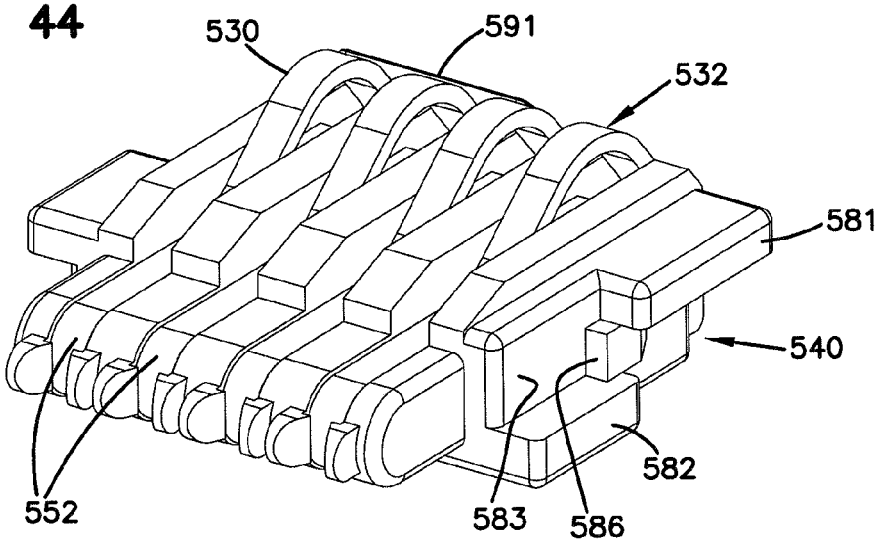
Figure 46:
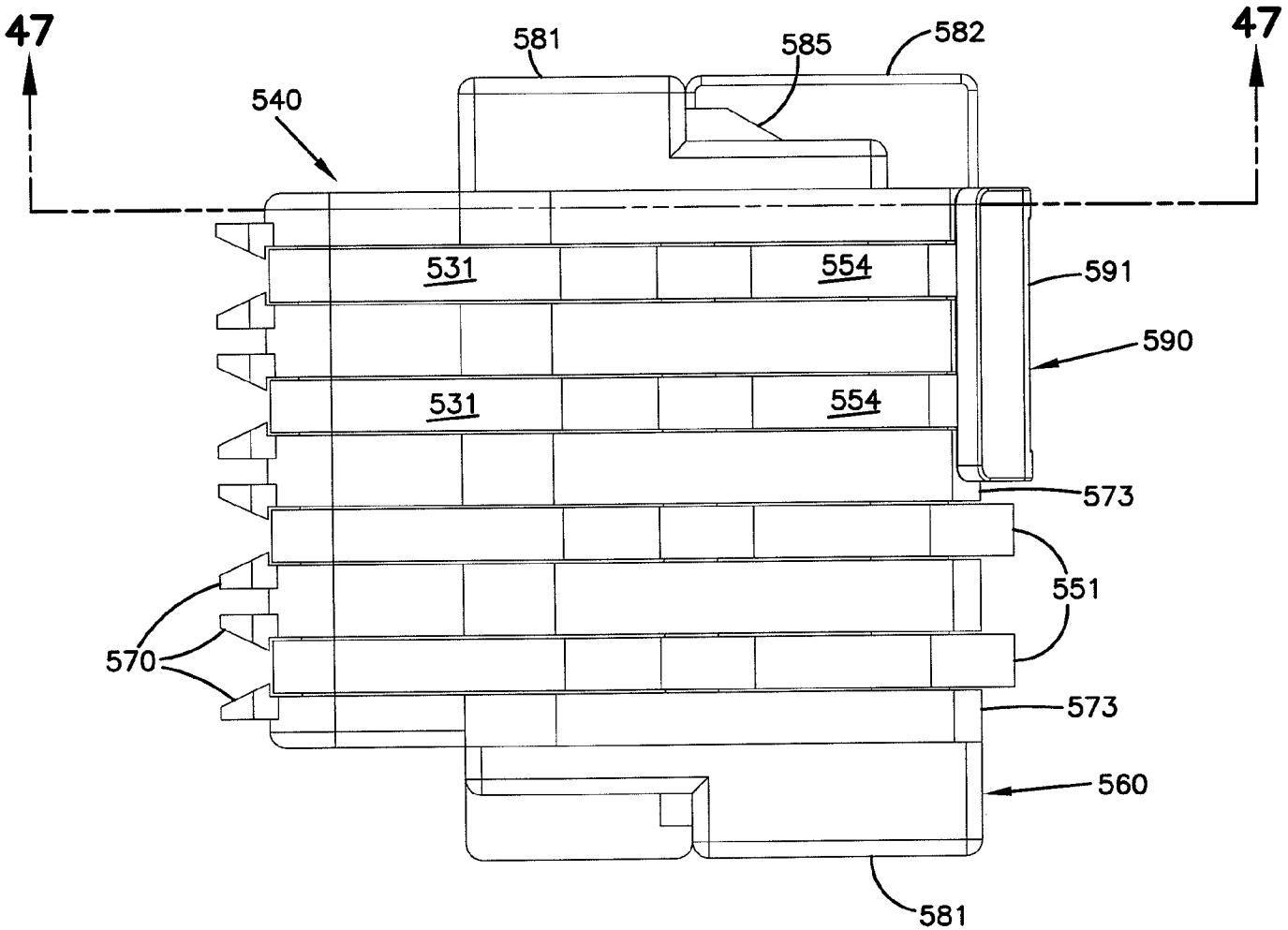
FIG. 46 is a top plan view of the media reading interface of FIGS. 44-45.

In accordance with some aspects, the media reading interface 540 includes a presence sensing member 590 that enables a processor in electrical communication with the media reading interface 540 to determine whether a plug 402 has been inserted into the jack module socket 515 (see FIGS. 44-45). In some implementations, the processor may pull information from the storage device 430 of the plug 402 when the processor determines that a plug 402 has been inserted into the jack module 510. The presence sensing member 590 includes a conductive member 591 that is configured to short together two or more contact members 531 of the second contact arrangement 530. The processor determines that a plug 402 has been inserted into the socket 515 when the processor detects a change in status of the contact members 531 configured to be shorted.

In some implementations, the conductive member 591 is positioned so that the contact members 531 to be shorted touch the conductive member 591 when the jack module socket 515 is empty, thereby creating the electrical short between the contact members 531. In the example shown, the conductive member 591 touches two of the contact members 531. In other implementations, the conductive member 591 can touch three of more contact members 531. The conductive member 591 is positioned and configured so that the insertion of the plug 402 into the socket 515 will push the contact members 531 out of engagement with the conductive member 591, thereby breaking the circuit. Accordingly, the processor determines that a plug 402 has been inserted when the circuit is broken.

In other implementations, the conductive member 591 is positioned so that none of the contact members 531 touch the conductive member 591 when the jack module socket 515 is empty. More specifically, the conductive member 591 is initially spaced from the contact members 531. The conductive member 591 is positioned and configured so that the insertion of the plug 402 into the socket 515 will push the contact members 531 into engagement with the conductive member 591, thereby creating short-circuit. In such implementations, the processor determines that a plug 402 has been inserted when the circuit is shorted.

Figure 56:
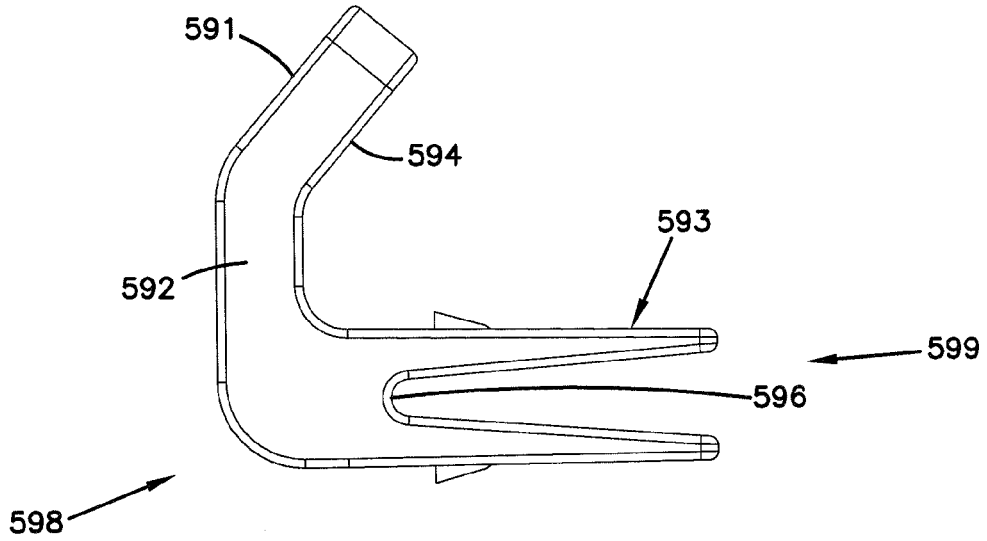
FIGS. 56 and 57 are side elevational views of the example presence sensing member of FIGS. 48-51.
Figure 57:
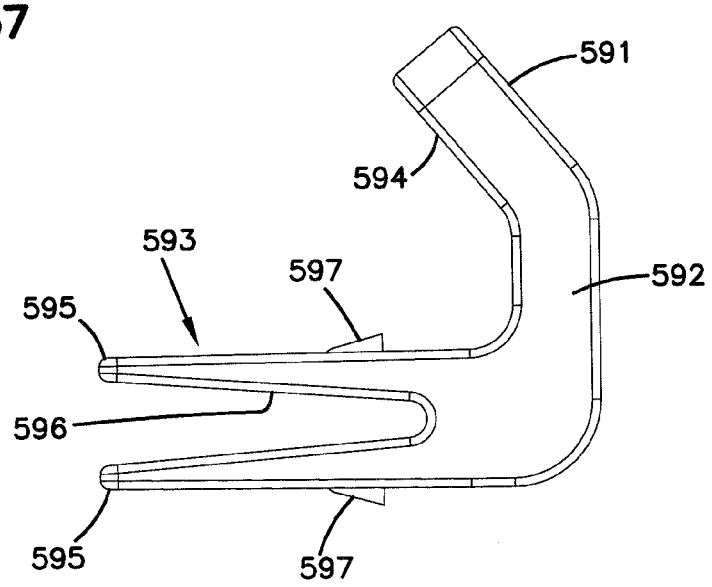

FIGS. 48-57 show one example presence sensing member 590 having a first end 598 and a second end 599 (FIG. 56). The presence sensing member 590 includes a conductive member (e.g., a metal or metal-coated bar) 591 extending between two legs 592. In the example shown, the conductive member 591 is sufficiently long to extend across two contact members 531 of the media reading interface 540. In other implementations, however, the conductive member 591 is sufficiently long to extend across three or more contact members 531.

The conductive member 591 defines a contact surface 594 that faces the contact members 531 on the media reading interface 540. In some implementations, the contact surface 594 extends across the entire surface of the conductive member 591. In other implementations, the contact surface 594 extends over only a portion of the second end 599 of the conductive member 591. In certain implementations, the conductive member 591 extends toward the contact members 531 when mounted to the media reading interface 540 to facilitate engagement between the contact surface 594 and the contact members 531. For example, in one implementation, the conductive member 591 extends at an angle from the legs 592 toward the second end 599 of the presence sensing member 590 (see FIGS. 56-57).

The presence sensing member 590 also includes one or more mounting members 593 with which the presence sensing member 590 may be secured to the support body 560 of the media reading interface 540. In some implementations, the mounting members 593 are connected to the legs 592 opposite the conductive member 591. In one implementation, the presence sensing member 590 is monolithic (e.g., formed from a single piece of material). In other implementations, the mounting members 593 may be attached to the legs 592 and/or the conductive member 591 may be attached to the legs 592.

In some implementations, the mounting members 593 include feet 595 that extend toward the second end 599 of the presence sensing member 591. In certain implementations, each mounting member 593 defines two feet 595 separated by a channel 596. In the example shown, the feet 595 of each mounting member 593 are vertically aligned (see FIG. 53). In certain implementations, the feet 595 are configured to flex toward each other. For example, in some implementations, the feet 595 narrow as they extend outwardly from the legs 592 to allow for greater space in which to flex (see FIGS. 56-57).

Figure 47:
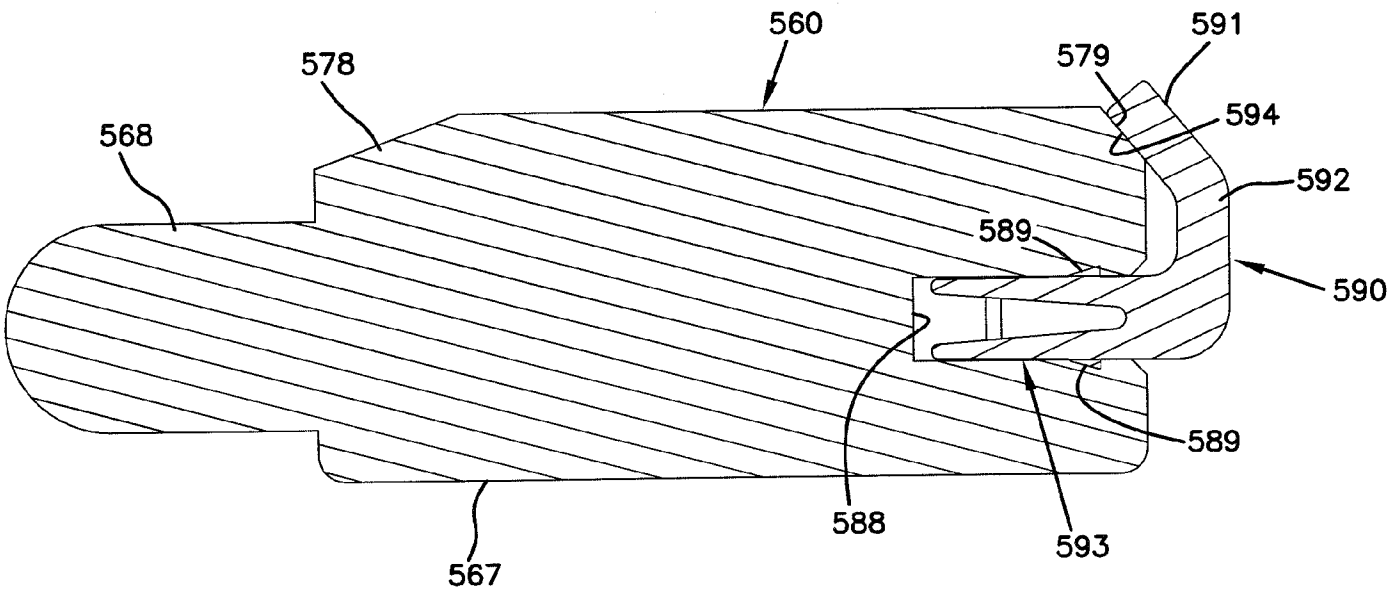
FIG. 47 is a cross-sectional view taken along the 47-47 line of FIG. 46.
Figure 48:
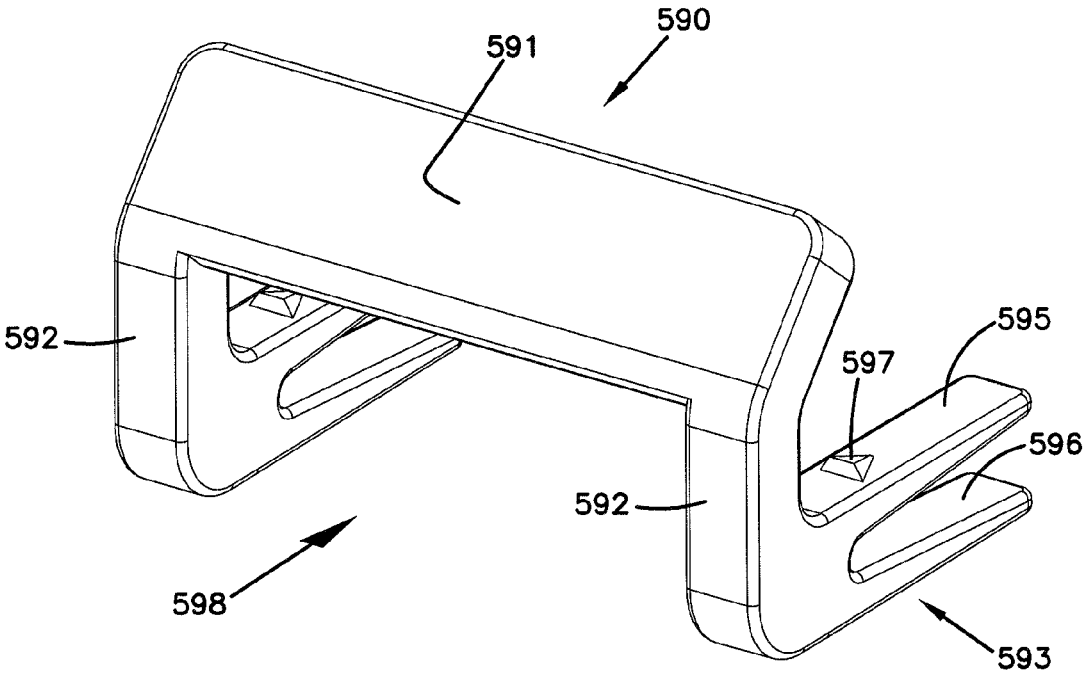
FIGS. 48-51 are perspective views of an example presence sensing member suitable for mounting to a media reading interface in accordance with aspects of the present disclosure.
Figure 49:
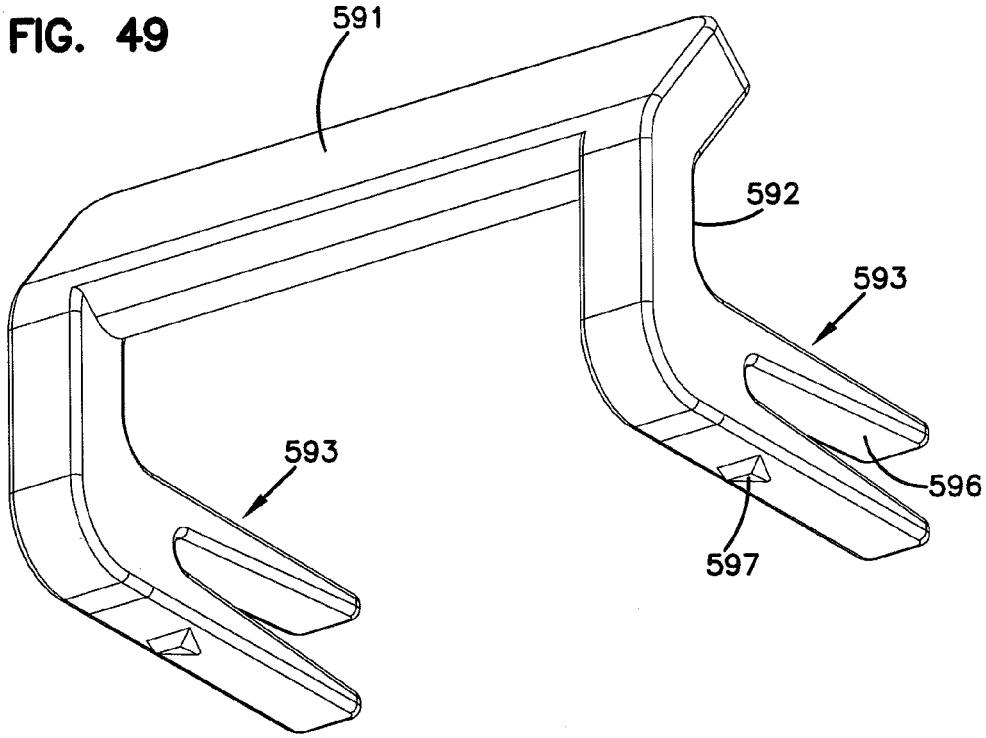
Figure 50:
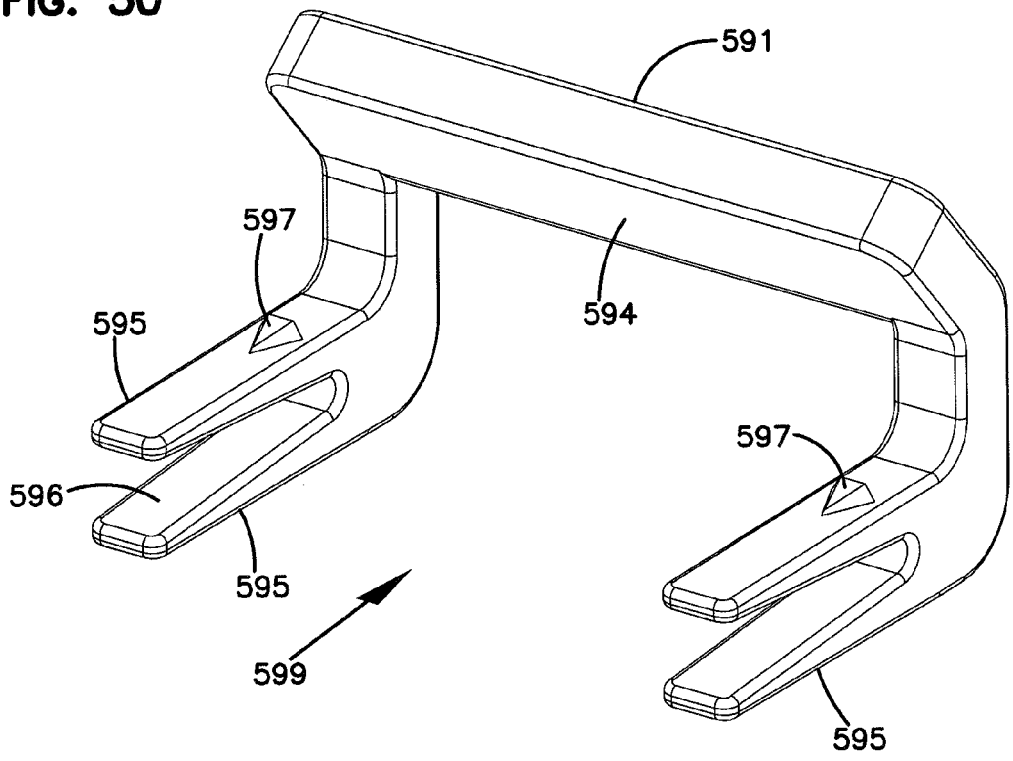
Figure 51:
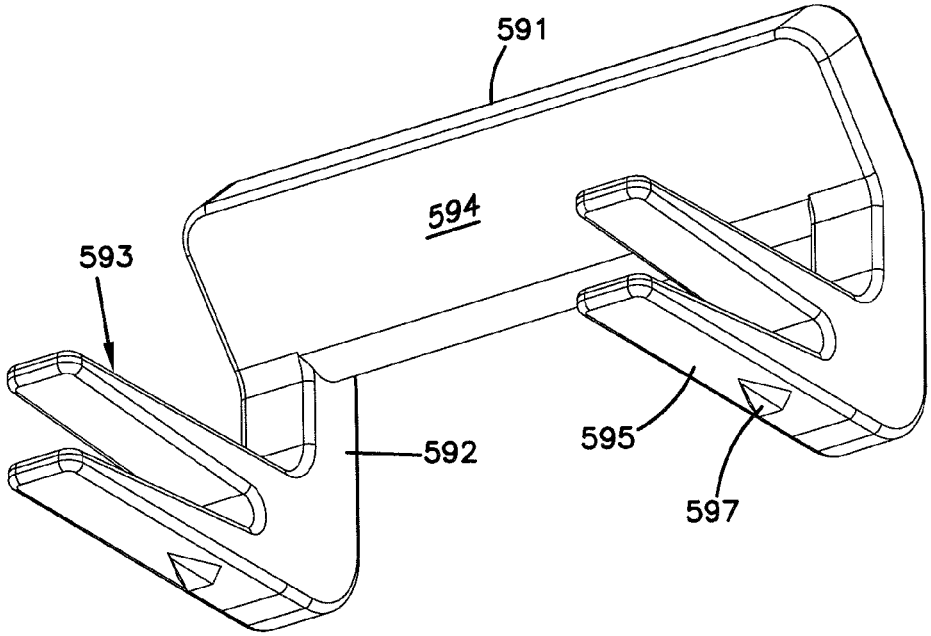
Figure 53:
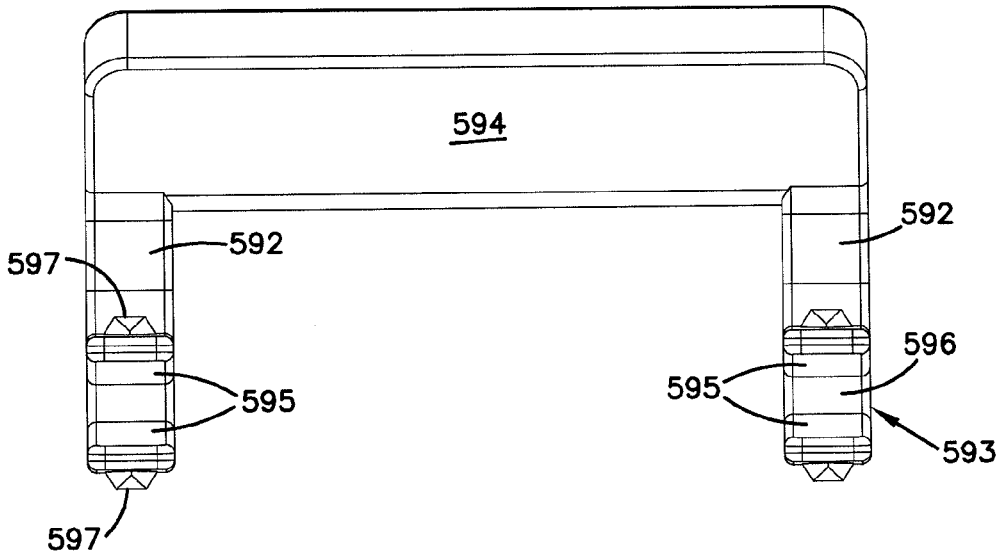
FIGS. 52 and 53 are front and rear elevational views, respectively, of the example presence sensing member of FIGS. 48-51.
Figure 52:
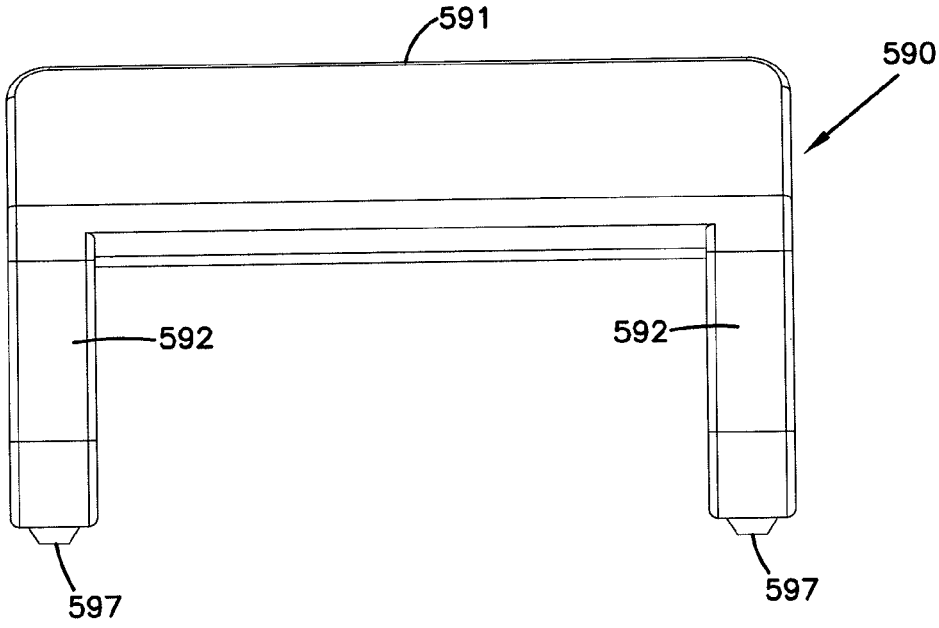
Figure 54:
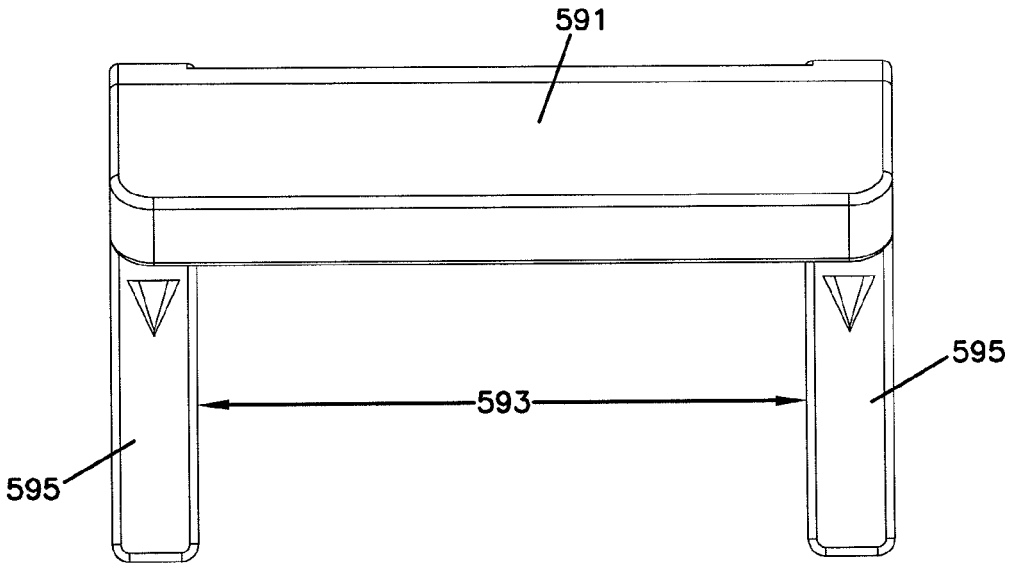
FIGS. 54-55 are top and bottom plan views, respectively, of the example presence sensing member of FIGS. 48-51.
Figure 55:
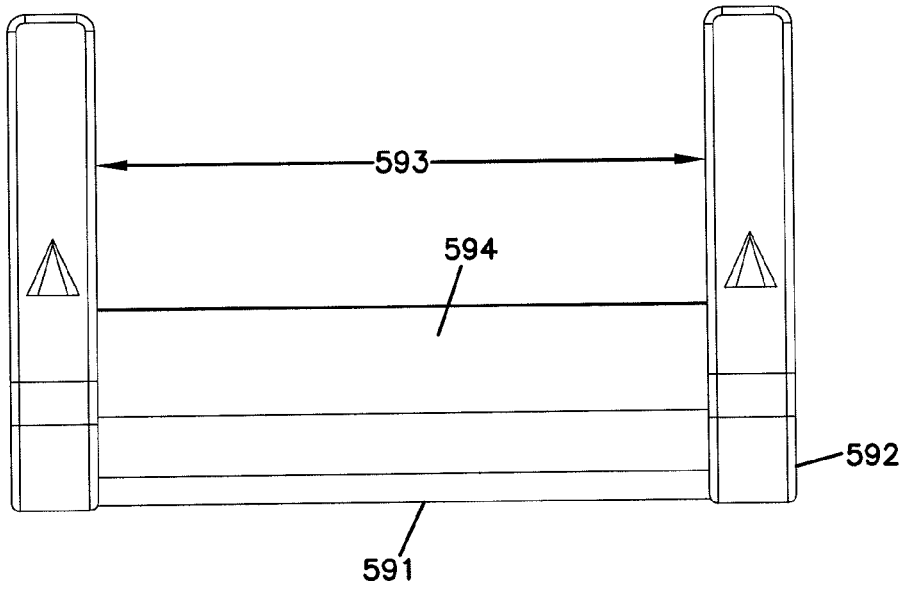

The support body 560 of the media reading interface 540 defines one or more receiving channels configured to receive the mounting members 593 of the presence sensing member 590. The receiving channels define open ports at the second end 564 of the support body. In some implementations, the support body 560 defines a first receiving channel 587 spaced from a second receiving channel 588. The first and second receiving channels 587, 588 are configured to receive the two mounting members 593 of the presence sensing device 590 (e.g., see FIGS. 45 and 47). In the example shown, the conductive member 591 of the presence sensing member 590 is configured to seat against the rearward ramped surface 579 of the ribs 573 of the support body 560 when the mounting members 593 are inserted into the receiving channels 587, 588 (see FIG. 47).

The receiving channels 587, 588 are located so as to position the conductive member 591 across the appropriate contact members 531. In the example shown, the first receiving channel 587 defines a passage in the middle rib 573 of the support body 560 and the second receiving channel 588 is defined partially by an outer rib 573 and partially by a side of the first section 567 of the support body 560. The conductive member 591 extends across a power contact and a grounding contact. In other implementations, the conductive member 591 may extend across a data contact, a presence sensing contact, a power contact, a grounding contact, an otherwise unassigned contact, or any combination thereof.

In some implementations, the mounting members 593 of the presence sensing device 590 latch within the receiving channels 587, 588 of the support body 560. For example, the interior surface of each of the receiving channels 587, 588 may define a latching member (e.g., a tab or a notch). In the example shown in FIG. 47, the interior surface of each receiving channel 587, 588 defines a notch 589. Latching tabs 597, which are provided on the mounting members 593 of the presence sensing member 590, are configured to snap-fit or otherwise secure to the notches 589 when the mounting members 593 are inserted into the receiving channels 587, 588.

In the example shown in FIGS. 48-57, each mounting member 593 includes a top and bottom tabs 597 that engage top and bottom notches 589 in the channels 587, 588. In other implementations, each mounting member 593 may include a single tab 597 at either the top or the bottom. In certain implementations, the tabs 597 cam into the notches 589 when the feet 595 of each mounting member 593 flex inwardly towards each other as described above.

In other implementations, the tabs 597 of the mounting members 593 may pierce and/or cut into the interior surfaces of the receiving channels 587, 588 to aid in securing the presence sensing device 590 to the support body 560. The flex between the feet 595 of the mounting members 593 maintains pressure on the tabs 597, which function as barbs digging into the channels 587, 588 when an outward force is applied to the presence sensing device 590. For example, inserting a plug into the socket may apply a force on the contacts 531, which may apply a force on the conductive member 591, which may apply an outward force on the mounting members 593.

Figure 58:
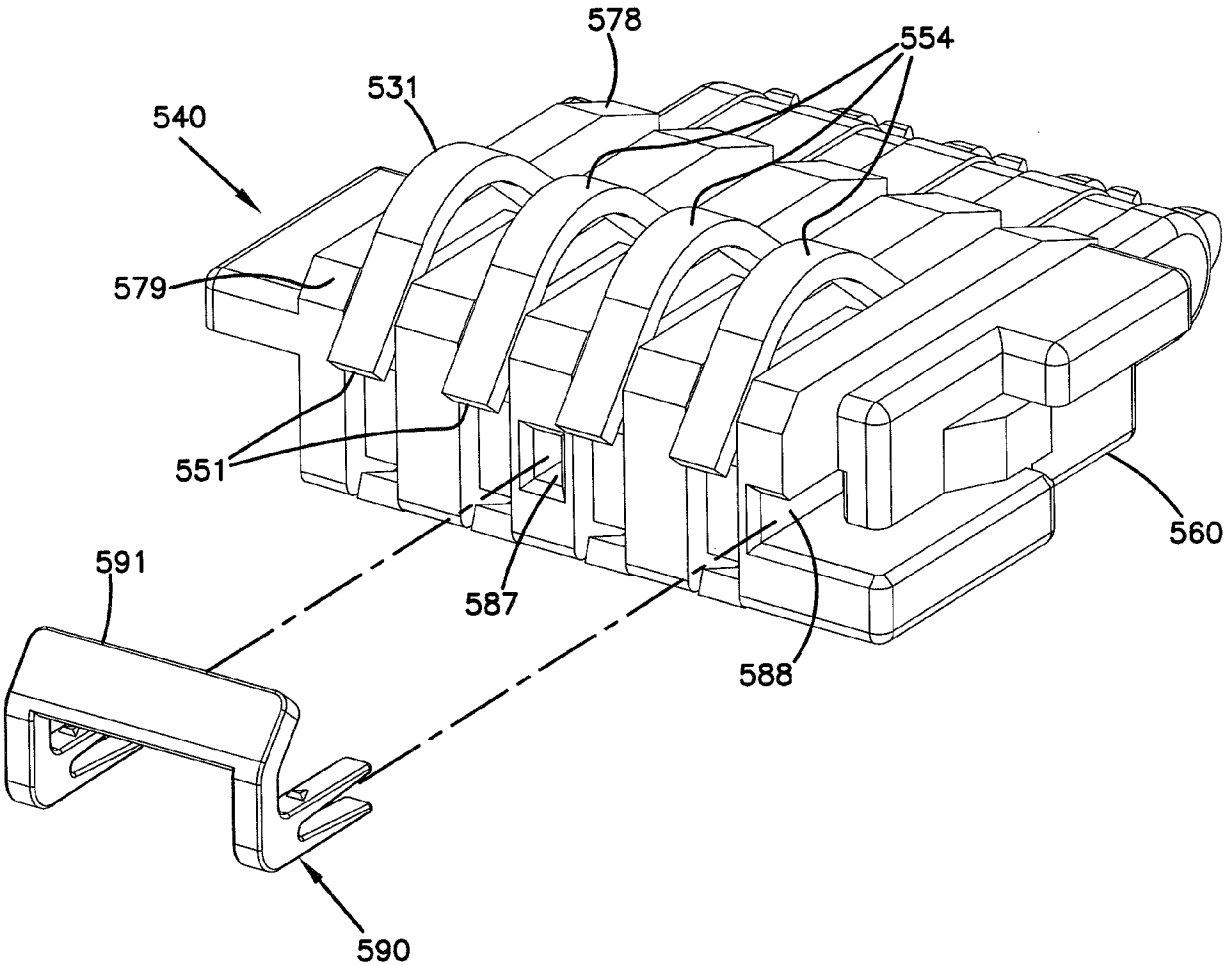
FIG. 58 shows the example media reading interface of FIGS. 44-45 with the presence sensing member exploded from the support body of the media reading interface to show receiving channels into which the presence sensing member can be mounted in accordance with aspects of the present disclosure.
Figure 59:
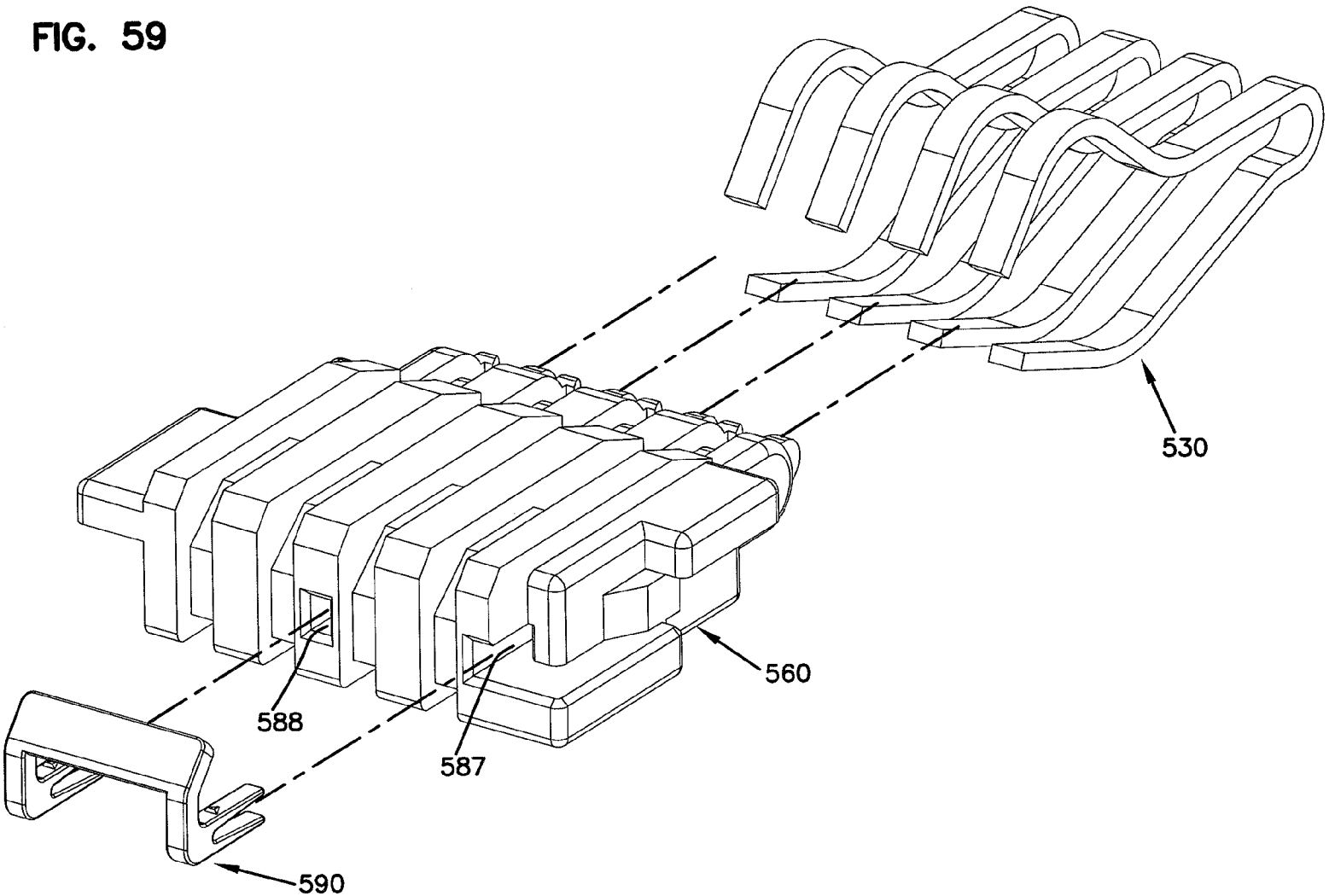
FIGS. 59-60 are perspective views showing the media reading interface of FIGS. 44-45 with the second contact arrangement and the presence sensing device exploded from the support body.
Figure 60:
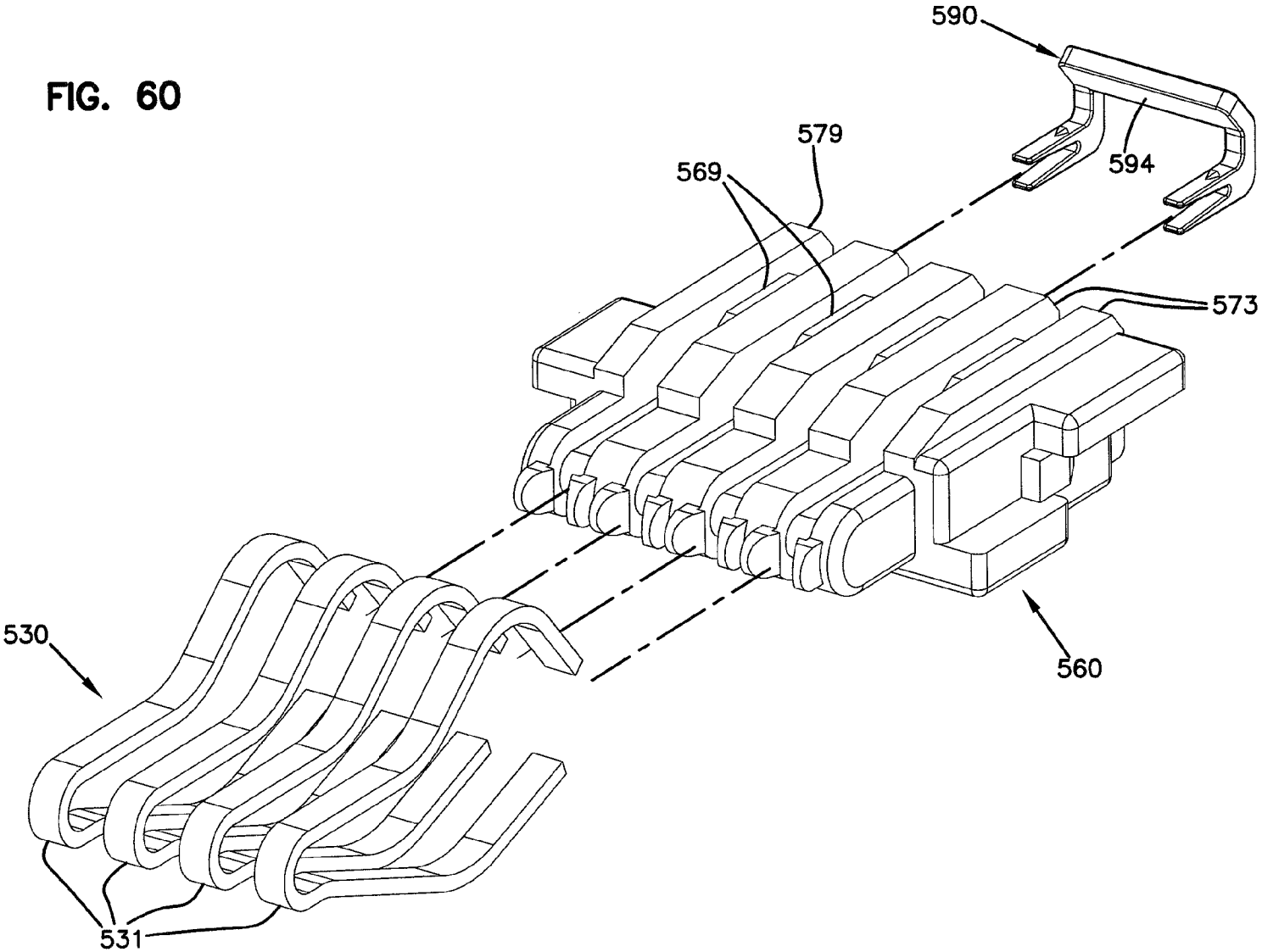
Figure 61:
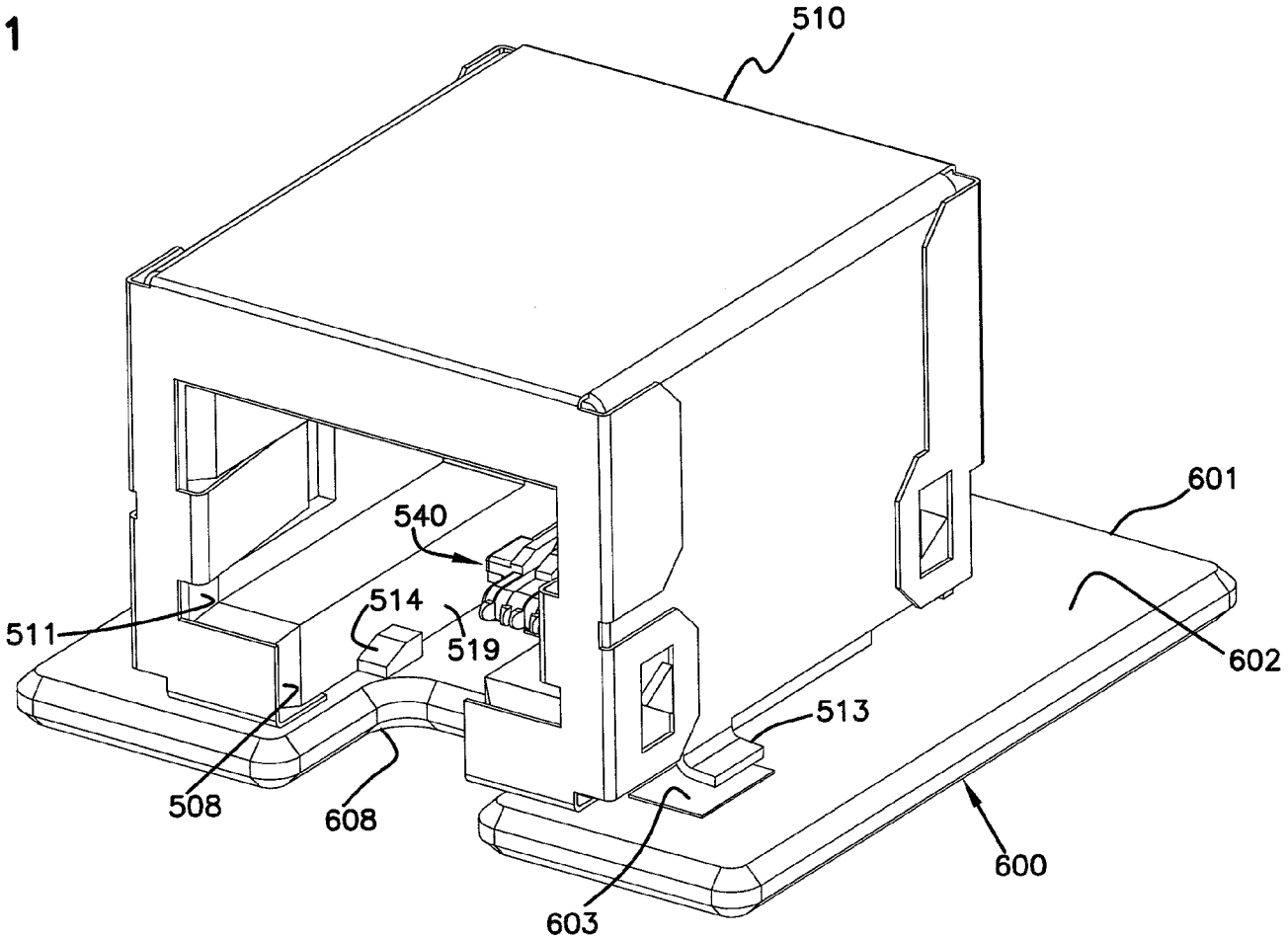
FIGS. 61-64 show an example jack module with an example media reading interface about to be mounted to (e.g., hovering over) an example circuit board.
Figure 62:
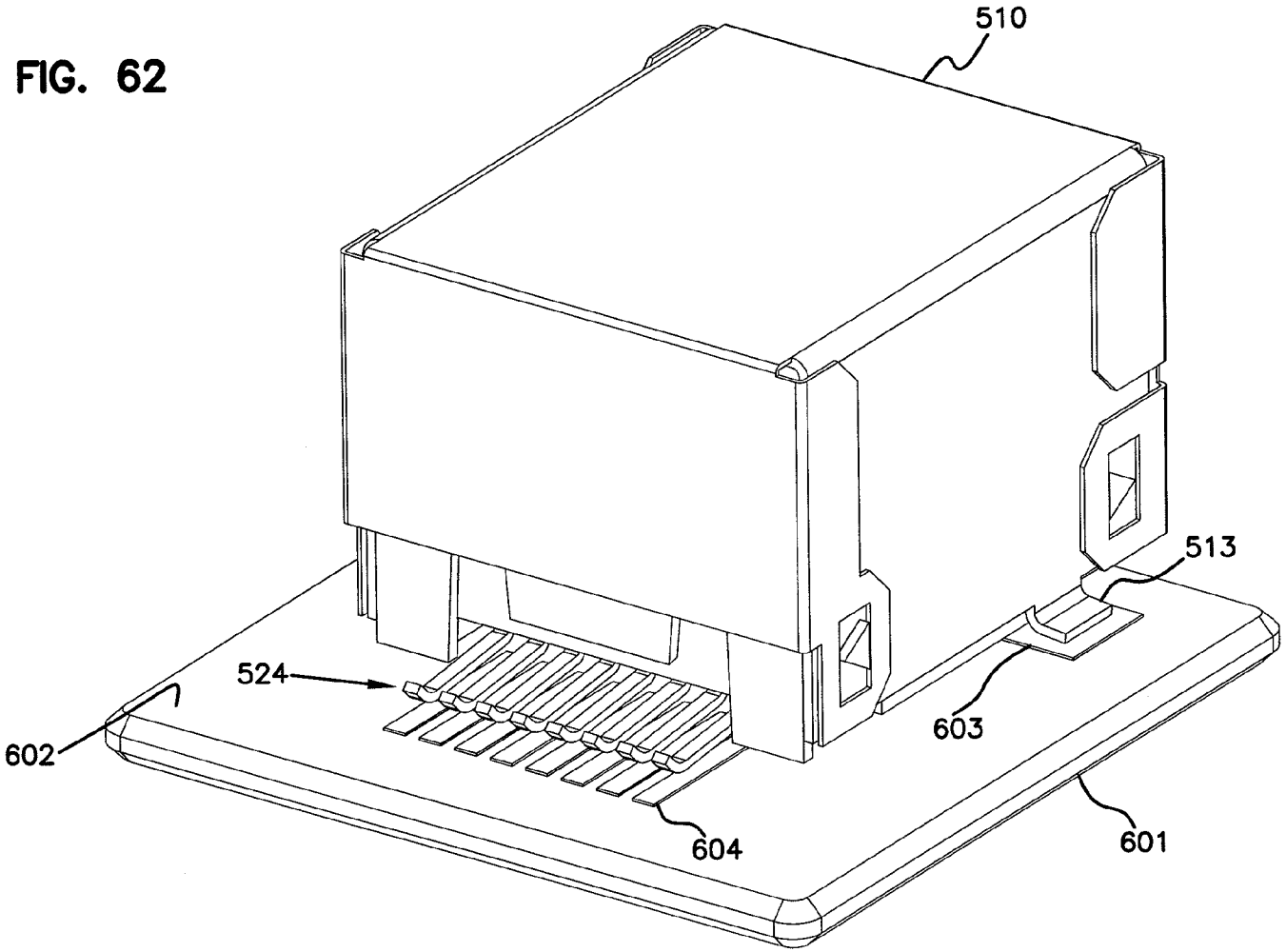
Figure 63:
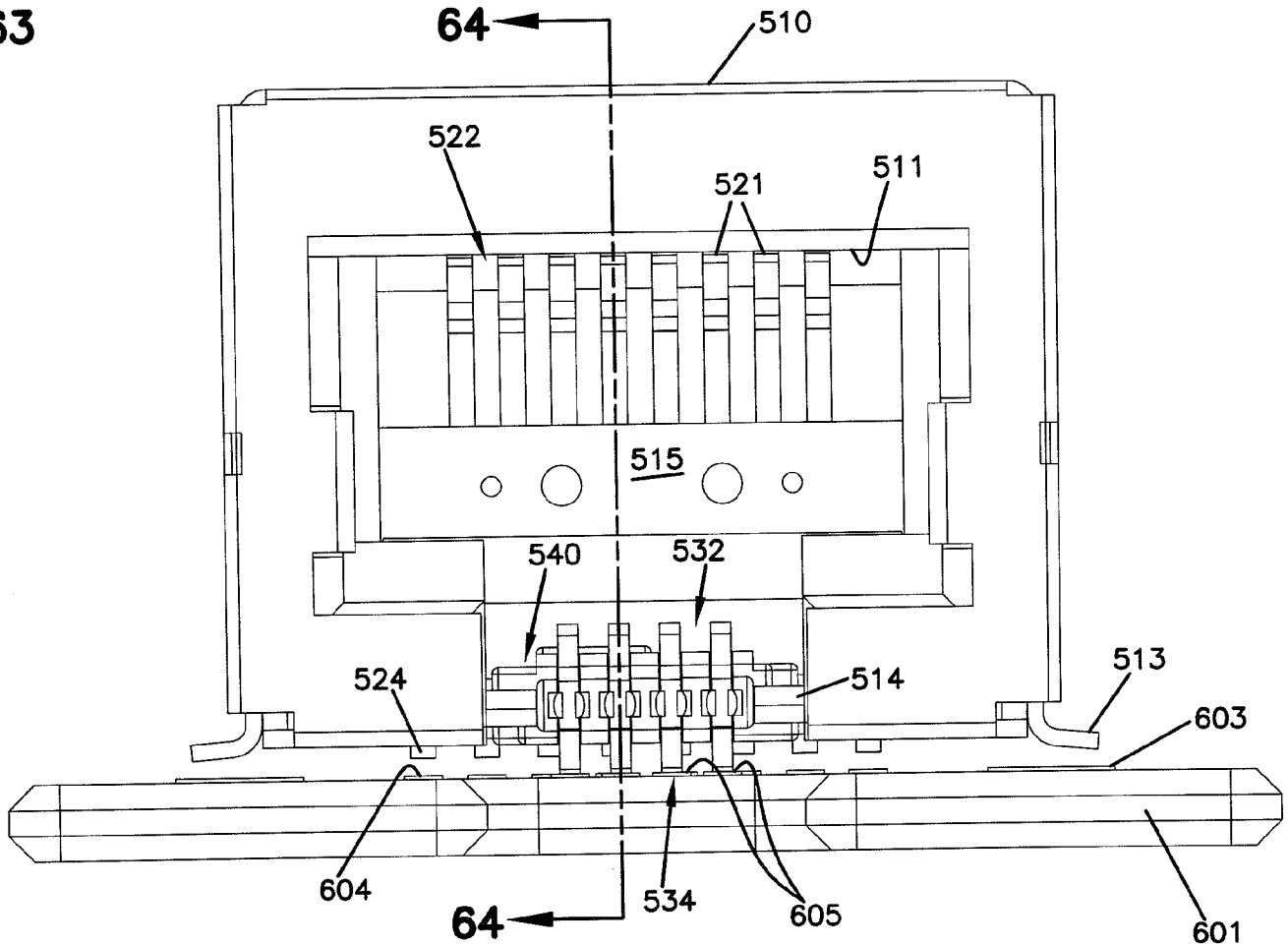
Figure 64:
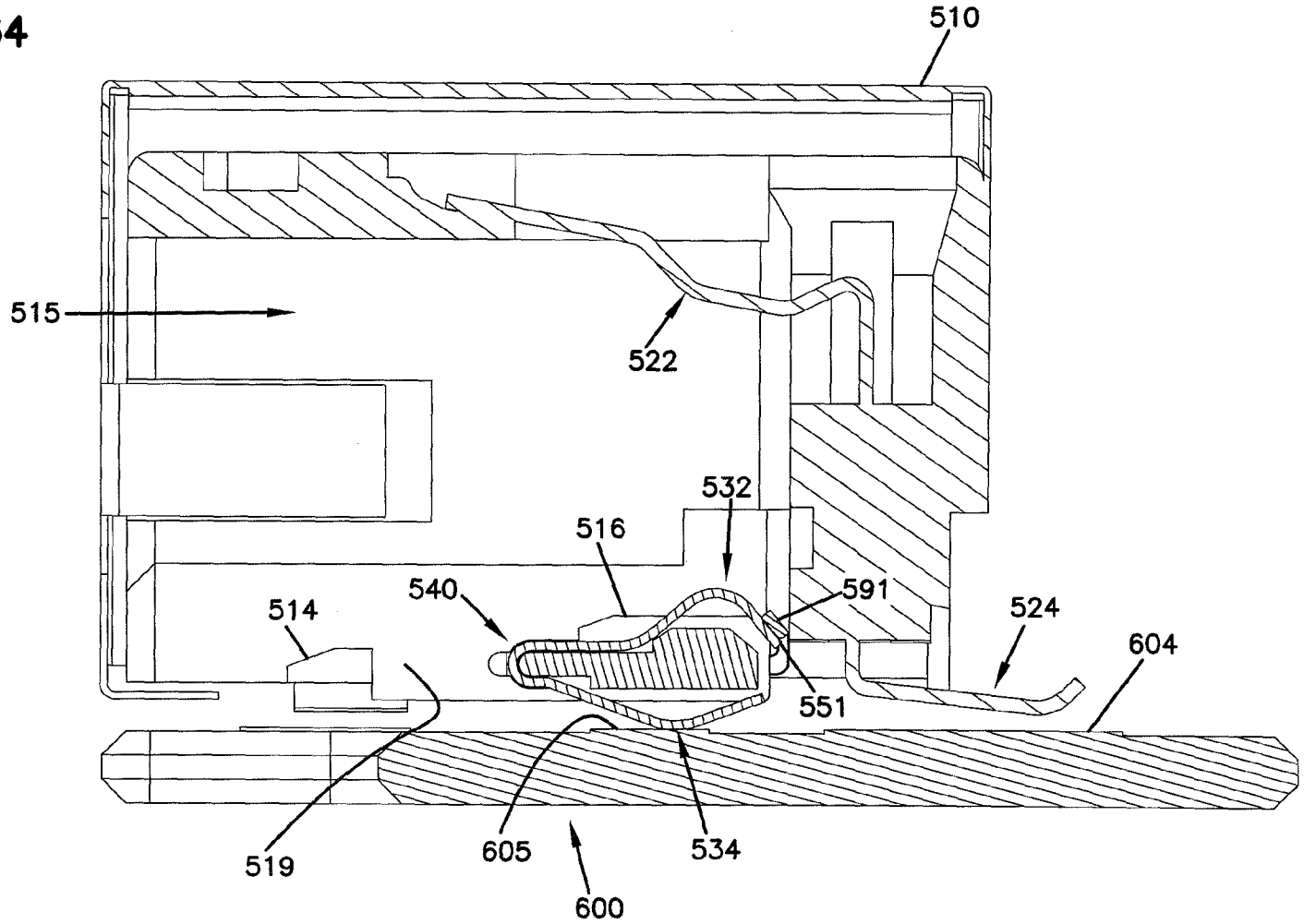
Figure 65:
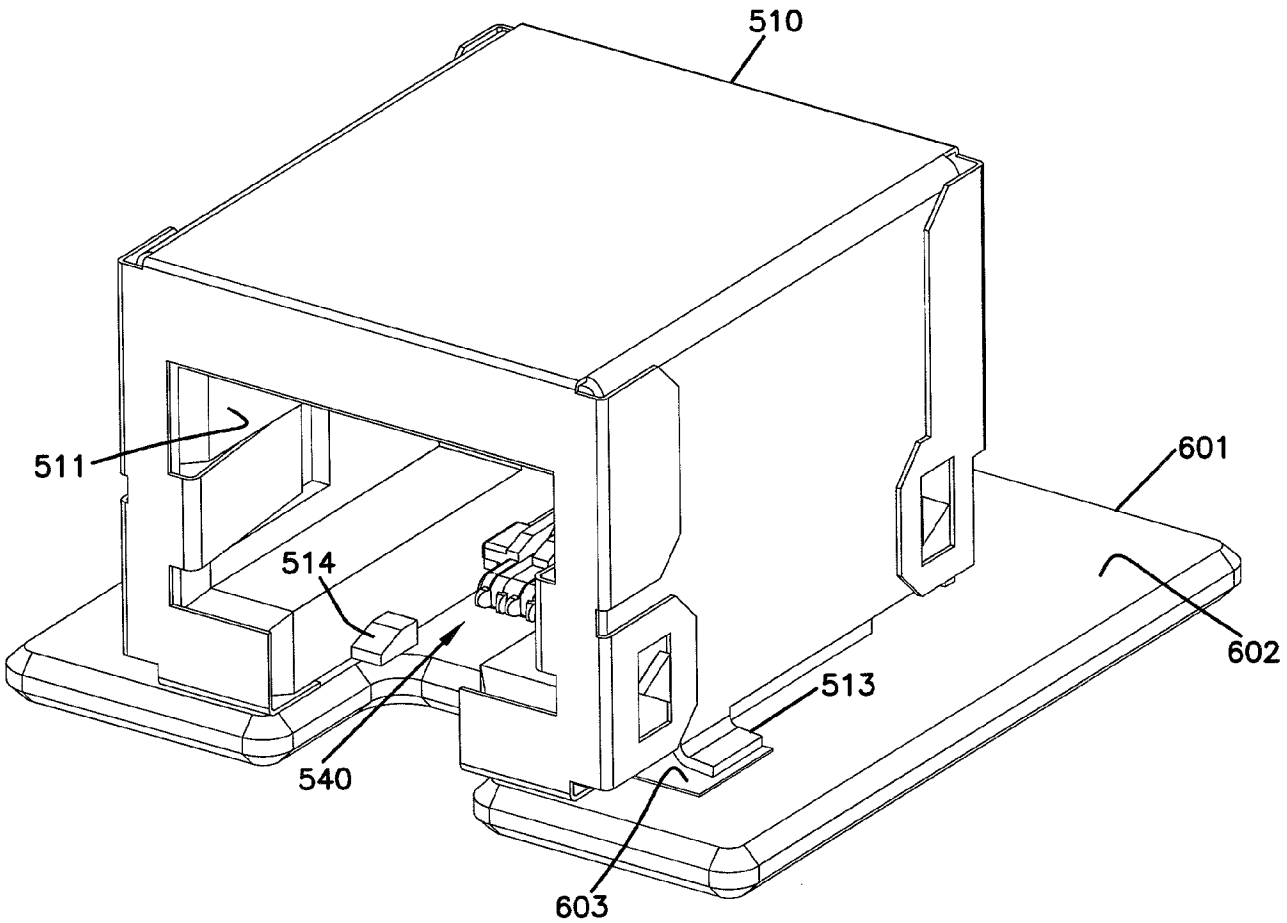
FIGS. 65-68 show the jack module of FIGS. 61-64 seated on the circuit board.
Figure 66:
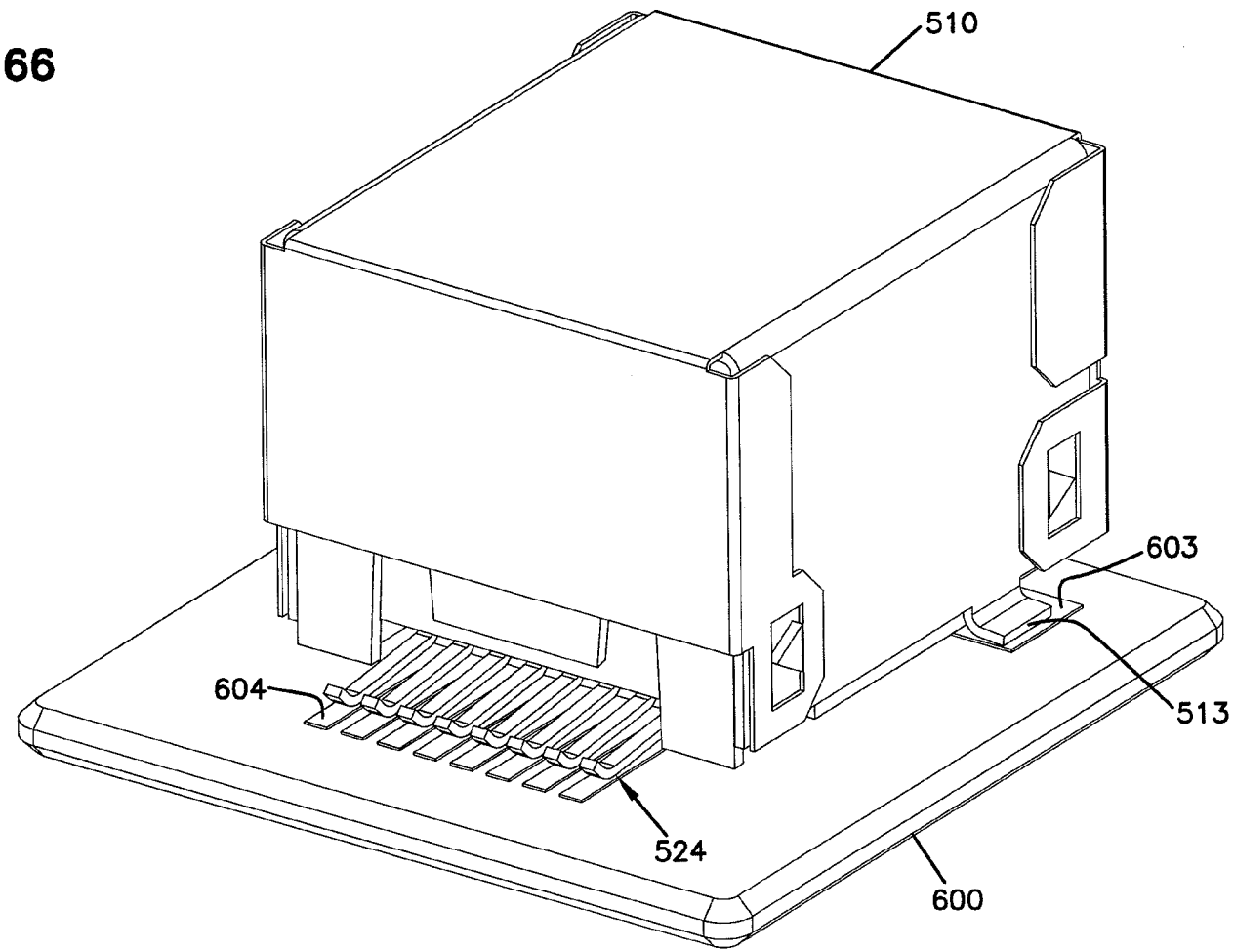
Figure 67:
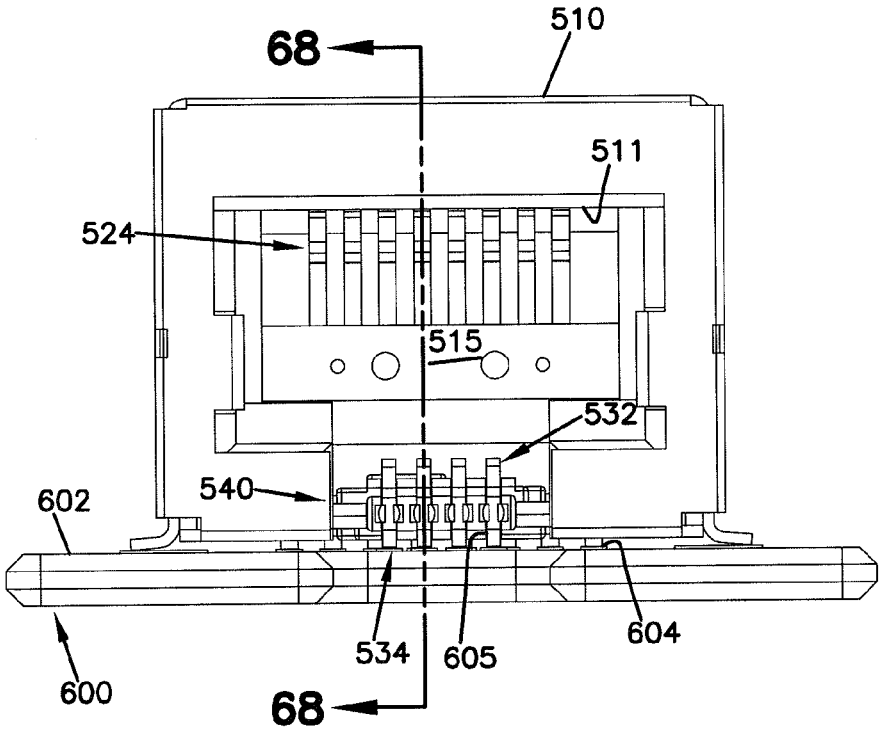

As shown in FIGS. 58-60, the presence sensing member 590 is mounted to the support body 560 of the media reading interface 540 after the second contact arrangement 530 has been mounted to the support body 560. The second contact arrangement 530 is slid onto the support body 560 from the first end 563. The presence sensing member 590 is slid into the support body 560 from the second end 564. The contact surface 594 of the presence sensing member 590 seats on the ramped shoulders 579 of the ribs 573 of the support body 560 when installed.

In the example shown, the first ends 551 of two of the contact members 531 are generally flush with the ramped ends 579 of the ribs 573. Accordingly, the first ends 551 touch the contact surface 594 of the conductive member 591 when the presence sensing member 590 is installed. Physical contact between the first ends 551 of the contact members 531 and the contact surface 594 of the conductive member 591 is broken when pressure is applied (e.g., by a plug 402) to the first contact surfaces 554 of the contact member 531, thereby moving the first ends 551 downwardly away from the conductive member 591 (e.g., see FIG. 11).

FIGS. 61-64 show an example jack module 510 with an example media reading interface 540 about to be mounted to (e.g., hovering over) an example circuit board 600. The second portions 524, 534 of the contact arrangements 520, 530 are shown aligned with the corresponding landings 604, 605 of the circuit board 600. FIGS. 65-68 show the jack module 510 seated on the circuit board 600. The second portions 524, 534 of the contact arrangements 520, 530 seat on the corresponding landings 604, 605 of the circuit board 600 (e.g., see FIG. 68).

The jack module 510 mounts to the circuit board 600 with the opening 519 facing the top 602 of the circuit board body 601. In certain implementations, the circuit board body 601 defines a notch or cut-out portion 608 that is configured to align with the open port 511 and/or the opening 519 of the jack module. The notch 608 is configured to accommodate the finger tab 450 of the plug 402 when the plug 402 is inserted within the socket 515 of the jack module 510. In one implementation, the front of the jack module 510 defines an open channel 508 extending between the open port 511 and the opening 519. The open channel 508 cooperates with the jack opening 519 and the circuit board notch 608 to accommodate the finger tab 450 when the plug 402 is inserted into the jack module 510.

A number of embodiments of the invention defined by the following claims have been described. Nevertheless, it will be understood that various modifications to the described embodiments may be made without departing from the spirit and scope of the claimed invention. Accordingly, other embodiments are within the scope of the following claims.

The invention claimed is:

1. A jack module comprising:

a jack module housing having a front, a rear, a first end, and a second end, the front of the jack module defining an open port leading to a socket, the second end of the jack module housing defining an interface opening;

a first contact arrangement having a first portion and a second portion, the first portion of the first contact arrangement extending into the socket at the first end of the jack module, and the second portion of the first contact arrangement extending external of the jack module housing at the second end of the jack module housing; and a media reading interface installed at the interface opening of the jack module housing, the media reading interface including a second contact arrangement having a first portion and a second portion, the first portion of the second contact arrangement extending into the socket at the second end of the jack module housing, and the second portion of the second contact arrangement extending external of the jack module housing at the second end of the jack module housing.

2. The jack module of claim 1, wherein the second contact arrangement includes a plurality of contact members separately mounted to a support body, wherein the first portion of the second contact arrangement is positioned on a first side of the support body and the second portion of the second contact arrangement is positioned on a second, opposite side of the support body.

3. The jack module of claim 1, wherein the jack module defines a right-angle jack.

4. The jack module of claim 1, further comprising a shield installed around the jack module housing, the shield including engagement tabs extending outwardly from opposite sides of the jack module housing at the second end of the jack module housing.

5. The jack module of claim 1, wherein the jack module housing includes interface guides positioned at the interface opening, the interface guides including planar surfaces along which the media reading interface is configured to slide when installed on the jack module.

6. The jack module of claim 5, wherein the interface guides each include a notch configured to receive a latching tab of the media reading interface to secure the media reading interface to the jack module housing.

7. The jack module of claim 5, wherein the jack module housing includes at least one plug guide set inwards from the open port at the front of the jack module housing, the plug guide being positioned forward of the interface guides, and the plug guide defines a ramped surface facing the front of the jack module housing.

8. A connector system comprising:

a plug connector including a plug housing holding a first set of contacts and a second set of contacts, the first set of contacts being electrically connected to a cable terminated at the plug connector, the second set of contacts being electrically connected to a storage device installed on the plug housing;

a circuit board including a first set of landings, a second set of landings, and a third set of landings arranged on a first side of the circuit board;

a jack module housing mounted to the first side of the circuit board, the jack module housing defining a socket configured to receive the plug housing, the jack module housing also defining a front port through which the plug housing accesses the socket and an interface opening facing the circuit board, the jack module housing holding a first contact arrangement configured to engage with the first set of contacts of the plug housing;

a media reading interface installed at the interface opening of the jack module, the media reading interface having a first side facing toward the socket of the jack module and a second side facing toward the circuit board, the media reading interface including a second contact arrangement having a first portion and a second portion, the first portion of the second contact arrangement extending away from the first side of the media reading interface into the socket to engage the second set of contacts of the plug housing, the second portion of the second contact arrangement extending away from the second side of the media reading interface to engage the third set of landings of the circuit board.

9. The connector system of claim 8, wherein the jack module housing includes plug guides positioned inwardly from the front port, the plug guides defining ramped surfaces configured to direct the plug housing into the socket so that the second set of contacts of the plug housing align with the first portion of the second contact arrangement.

10. The connector system of claim 8, wherein the first contact arrangement extends through the jack module housing toward the circuit board, wherein ends of the first contact arrangement engage the second landings on the circuit board.

11. The connector system of claim 10, wherein the jack module housing includes a shield having engagement tabs that engage the first landings of the circuit board when the jack module housing is mounted to the circuit board.

12. The connector system of claim 10, wherein the media reading interface including a presence sensing member that is configured to determine whether the plug housing is received within the socket.

13. The connector system of claim 12, wherein the presence sensing member includes a conductive member that extends across at least two contact members of the second contact arrangement of the media reading interface.

14. The connector system of claim 13, wherein the plug housing biases the contact members of the second contact arrangement away from the conductive member of the presence sensing member when the plug housing is received within the socket of the jack module housing.

15. A media reading interface comprising:

a support body having a top, a bottom, a first end, and a second end, the support body defining channels wrapping around the top, the first end, and the bottom of the support body, the support body also including raised ribs that further define the channels on the top and bottom of the support body;

a plurality of contact members installed in the channels of the support body, each contact member including a first portion extending from a first end of the contact member to an intermediate section of the contact member and a second portion extending from the intermediate portion of the contact member to a second end of the contact member, each portion of the contact member defining a contact surface, the first portion of each contact member extending along the top of the support body and the second portion of each contact member extending along the bottom of the support body; and a presence sensing member mounted to the second end of the support body, the presence sensing member including a conductive member positioned to extend across the first ends of at least two of the contact members.

16. The media reading interface of claim 15, wherein the support body includes a mounting arrangement at opposite sides of the support body, each mounting arrangement including guides defining a channel, each mounting arrangement also including a securement arrangement, each securement arrangement including a ramp and a shoulder.

17. The media reading interface of claim 15, wherein the contact surfaces of each contact member protrude beyond the raised ribs of the support body when the contact members are installed on the support body.

18. The media reading interface of claim 15, wherein the raised ribs define ramped surfaces against which the conductive member of the presence sensing member seats when the presence sensing member is installed on the support body.

19. The media reading interface of claim 15, wherein conductive member of the presence sensing member extends between first ends of two legs, wherein a mounting arrangement is connected to second ends of the two legs, wherein each mounting arrangement is configured to mount to a receiving channel defined in the support body.

20. The media reading interface of claim 19, wherein each mounting arrangement includes two vertically aligned feet that are configured to flex inwardly with respect to each other.

* * * * *